US009543109B2

(12) United States Patent
Yun et al.

(10) Patent No.: US 9,543,109 B2
(45) **Date of Patent: *Jan. 10, 2017**

(54) X-RAY SOURCES USING LINEAR ACCUMULATION

(71) Applicant: Sigray, Inc., Concord, CA (US)

(72) Inventors: Wenbing Yun, Walnut Creek, CA (US); Sylvia Jia Yun Lewis, San Francisco, CA (US); Janos Kirz, Berkeley, CA (US); Alan Francis Lyon, Berkeley, CA (US)

(73) Assignee: Sigray, Inc., Concord, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/999,147

(22) Filed: Apr. 1, 2016

(65) Prior Publication Data

US 2016/0268094 A1 Sep. 15, 2016

Related U.S. Application Data

(63) Continuation-in-part of application No. 14/490,672, filed on Sep. 19, 2014, now Pat. No. 9,390,881.
(Continued)

(51) Int. Cl.
*H01J 35/08* (2006.01)
*H01J 35/10* (2006.01)
(Continued)

(52) U.S. Cl.
CPC ..... *H01J 35/106* (2013.01); *G21K 1/06* (2013.01); *H01J 35/08* (2013.01); *H01J 35/14* (2013.01);
(Continued)

(58) Field of Classification Search
CPC ..... A61K 2039/505; A61K 2039/545; C07K 16/30; C07K 2317/24; C07K 2317/34; C07K 2317/56; C07K 2317/73; C07K 2317/732; C07K 2317/92; G01N 33/574; G21K 1/06; H01J 2235/081; H01J 2235/086; H01J 35/08; H01J 35/106; H01J 35/14
See application file for complete search history.

(56) References Cited

U.S. PATENT DOCUMENTS 9,448,190 B2 * 9/2016 Yun ..... G01N 23/2076
9,449,781 B2 * 9/2016 Yun ..... H01J 35/08
(Continued)

*Primary Examiner* — David J Makiya
*Assistant Examiner* — John Corbett
(74) *Attorney, Agent, or Firm* — Franklin Schellenberg

(57) ABSTRACT

A compact source for high brightness x-ray generation is disclosed. The higher brightness is achieved through electron beam bombardment of multiple regions aligned with each other to achieve a linear accumulation of x-rays. This may be achieved by aligning discrete x-ray sub-sources, or through the use of x-ray targets that comprise microstructures of x-ray generating materials fabricated in close thermal contact with a substrate with high thermal conductivity. This allows heat to be more efficiently drawn out of the x-ray generating material, and in turn allows bombardment of the x-ray generating material with higher electron density and/or higher energy electrons, leading to greater x-ray brightness. The orientation of the microstructures allows the use of an on-axis collection angle, allowing the accumulation of x-rays from several microstructures to be aligned to appear to have a single origin, also known as "zero-angle" x-ray radiation.

20 Claims, 43 Drawing Sheets

Related U.S. Application Data

(60) Provisional application No. 61/880,151, filed on Sep. 19, 2013, provisional application No. 61/894,073, filed on Oct. 22, 2013, provisional application No. 61/931,519, filed on Jan. 24, 2014, provisional application No. 62/008,856, filed on Jun. 6, 2014, provisional application No. 62/141,847, filed on Apr. 1, 2015, provisional application No. 62/155,449, filed on Apr. 30, 2015.

(51) Int. Cl.
*H01J 35/18* (2006.01)
*H01J 35/14* (2006.01)
*G21K 1/06* (2006.01)

(52) U.S. Cl.
CPC ..... *H01J 35/18* (2013.01); *H01J 2235/081* (2013.01); *H01J 2235/086* (2013.01)

(56) References Cited

U.S. PATENT DOCUMENTS

2011/0026680 A1* 2/2011 Sato ..... H01J 35/06 378/119
2015/0247811 A1* 9/2015 Yun ..... G01B 15/02 378/45

* cited by examiner

X-RAY SOURCES USING LINEAR ACCUMULATION

CROSS-REFERENCE TO RELATED APPLICATIONS

The Present Patent Application is a continuation-in-part of U.S. patent application Ser. No. 14/490,672, filed Sep. 19, 2014 and entitled X-RAY SOURCES USING LINEAR ACCUMULATION, which claims the benefit of U.S. Provisional Patent Application No. 61/880,151, filed on Sep. 19, 2013, 61/894,073, filed on Oct. 22, 2013, 61/931,519, filed on Jan. 24, 2014, and 62/008,856, filed on Jun. 6, 2014, all of which are incorporated herein by reference in their entirety. The Present Patent Application also claims the benefit of U.S. Provisional Patent Application No. 62/141,847, filed Apr. 1, 2015 and entitled ADDITIONAL X-RAY SOURCE DESIGNS USING MICROSTRUCTURED TARGETS, and U.S. Provisional Patent Application No. 62/155,449, filed Apr. 30, 2015 and entitled X-RAY TARGET FABRICATION, both of which are incorporated herein by reference in their entirety.

FIELD OF THE INVENTION

The embodiments of the invention disclosed herein relate to high-brightness sources of x-rays. Such high brightness sources may be useful for a variety of applications in which x-rays are employed, including manufacturing inspection, metrology, crystallography, structure and composition analysis and medical imaging and diagnostic systems.

BACKGROUND OF THE INVENTION

The initial discovery of x-rays by Röntgen in 1895 [W. C. Röntgen, "Eine Neue Art von Strahlen (Wurzburg Verlag, 1896); "On a New Kind of Rays," Nature, Vol. 53, pp. 274-276 (Jan. 23, 1896)] occurred by accident when Röntgen was experimenting with electron bombardment of targets in vacuum tubes. These high energy, short wavelength photons are now routinely used for medical applications and diagnostic evaluations, as well as for security screening, industrial inspection, quality control and failure analysis, and for scientific applications such as crystallography, tomography, x-ray fluorescence analysis and the like.

The laboratory x-ray source was later improved by Coolidge in the early $20^{th}$ century [see, for example, William D. Coolidge, U.S. Pat. No. 1,211,092, issued Jan. 2, 1917, U.S. Pat. No. 1,917,099, issued Jul. 4, 1933, and U.S. Pat. No. 1,946,312, issued Feb. 6, 1934], and, later in the $20^{th}$ century, systems generating very intense beams of x-rays using synchrotrons or free electron lasers (FELs) have been developed. These synchrotron or FEL systems, however, are physically very large systems, requiring large buildings and acres of land for their implementation. For compact, practical lab-based systems and instruments, most x-ray sources today still use the fundamental mechanism of the Coolidge tube.

An example of the simplest x-ray source, a transmission x-ray source 08, is illustrated in FIG. 1 The source comprises a vacuum environment (typically $10^{-6}$ torr or better) commonly provided by a sealed vacuum tube 02 or active pumping, manufactured with sealed electrical leads 21 and 22 that pass from the negative and positive terminals of a high voltage source 10 outside the tube to the various elements inside the vacuum tube 02. The source 08 will typically comprise mounts 03 which secure the vacuum tube 02 in a housing 05, and the housing 05 may additionally comprise shielding material, such as lead, to prevent x-rays from being radiated by the source 08 in unwanted directions.

Inside the vacuum tube 02, an emitter 11 connected through the lead 21 to the high voltage source 10 serves as a cathode and generates a beam of electrons 111, often by running a current through a filament. The target 01 is electrically connected to the opposite high voltage lead 22, and therefore serves as an anode. The emitted electrons 111 accelerate towards the target 01 and collide with it at high energy, with the energy of the electrons determined by the magnitude of the accelerating voltage. The collision of the electrons 111 into the solid target 01 induces several effects, including the generation of x-rays 888, some of which exit the vacuum tube 02 through a window 04 designed to transmit x-rays. In the configuration shown in FIG. 1, the target 01 is deposited or mounted directly on the window 04 and the window 04 forms a portion of the wall of the vacuum chamber. In other prior art embodiments, the target may be formed as an integral part of the window 04 itself.

Another example of a common x-ray source design is the reflection x-ray source 80, is illustrated in FIG. 2. Again, the source comprises a vacuum environment (typically $10^{-6}$ torr or better) commonly maintained by a sealed vacuum tube 20 or active pumping, and manufactured with sealed electrical leads 21 and 22 that pass from the negative and positive terminals of a high voltage source 10 outside the tube to the various elements inside the vacuum tube 20. The source 80 will typically comprise mounts 30 which secure the vacuum tube 20 in a housing 50, and the housing 50 may additionally comprise shielding material, such as lead, to prevent x-rays from being radiated by the source 80 in unwanted directions.

Inside the tube 20, an emitter 11 connected through the lead 21 to the high voltage source 10 serves as a cathode and generates a beam of electrons 111, often by running a current through a filament. A target 100 supported by a target substrate 110 is electrically connected to the opposite high voltage lead 22 and target support 32, and therefore serves as an anode. The electrons 111 accelerate towards the target 100 and collide with it at high energy, with the energy of the electrons determined by the magnitude of the accelerating voltage. The collision of the electrons 111 into the target 100 induces several effects, including the generation of x-rays, some of which exit the vacuum tube 20 and are transmitted through a window 40 that is transparent to x-rays.

In an alternative prior art embodiment for a reflective x-ray source (not shown in FIG. 2), the target 100 and substrate 110 may be integrated or comprise a solid block of the same material, such as copper (Cu). Also not shown in FIGS. 1 and 2, but commonly employed in practice, electron optics (electrostatic or electromagnetic lenses) may be provided to guide and shape the path of the electrons, forming a more concentrated, focused beam at the target. Likewise, electron sources comprising multiple emitters may be provided to provide a larger, distributed source of electrons.

When the electrons collide with a target 100, they can interact in several ways. These are illustrated in FIG. 3. The electrons in the electron beam 111 collide with the target 100 at its surface 102, and the electrons that pass through the surface transfer their energy into the target 100 in an interaction volume 200, generally defined by the incident electron beam footprint (area) times the electron penetration depth. For an incident electron beam of very small size (e.g. a beam diameter <100 nm) the interaction volume 200 is typically "pear" or "teardrop" shaped in three dimensions, and symmetric around the electron propagation direction.

For a larger beam, the interaction volume will be represented by the convolution of this "teardrop" shape with the lateral beam intensity profile.

An equation commonly used to estimate the penetration depth for electrons into a material is Pott's Law [P. J. Potts, Electron Probe Microanalysis, Ch. 10 of *A Handbook of Silicate Rock Analysis*, Springer Netherlands, 1987, p. 336)], which states that the penetration depth x in microns is related to the 10% of the value of the electron energy $E_0$ in keV raised to the 3/2 power, divided by the density of the material:

$$x(\mu m) = 0.1 \times \frac{E_0^{1.5}}{\rho} \quad \text{[Eqn. 1]}$$

For less dense material, such as a diamond substrate, the penetration depth is much larger than for a material with greater density, such as most elements used for x-ray generation.

There are several energy transfer mechanisms that can occur. Throughout the interaction volume 200, electron energy may simply be converted into heat. Some absorbed energy may excite the generation of secondary electrons, typically detected from a region 221 located near the surface, while some electrons may also be backscattered, which, due to their higher energy, can be detected from a somewhat larger region 231.

Throughout the interaction volume 200, including in the regions 221 and 231 near the surface and extending approximately 3 times deeper into the target 100, x-rays 888 are generated and radiated outward in all directions. The x-ray radiation can have a complex energy spectrum. As the electrons penetrate the material, they decelerate and lose energy, and therefore different parts of the interaction volume 200 produce x-rays with different properties. A typical x-ray radiation spectrum for radiation from the collision of 100 keV electrons with a tungsten target is illustrated in FIG. 4.

As shown in FIG. 4, the broad spectrum x-ray radiation 388 arises from electrons that were diverted from their initial trajectory, depending on how close they pass to various nuclei and other electrons. The reduction in electron energy and the change momentum associated with the change in direction generate the radiation of x-rays. Because a wide range of deflections and decelerations can occur, due to the proximity statistics of the electron collisions with the atoms of the target material, the change in energy is a continuum, and therefore, the energy of the generated x-rays also is a continuum. Greater radiation occurs at the low end of the energy spectrum, with far less occurring at higher energy, and reaching an absolute limit of no x-rays with energy larger than the original electron energy (in this example, 100 keV). Due to their origin in deceleration of electrons, this kind of continuum x-ray radiation 388 is commonly called bremsstrahlung, after the German word "bremsen" for "braking".

These continuum x-rays 388 are generated throughout the interaction volume, shown in FIG. 3 as the largest shaded portion 288 of the interaction volume 200. At lower energy, the bremsstrahlung x-rays 388 are typically radiated isotropically, i.e. with little variation in intensity with radiation direction [see, for example, D. Gonzales, B. Cavness, and S. Williams, "Angular distribution of thick-target bremsstrahlung produced by electrons with initial energies ranging from 10 to 20 keV incident on Ag", Phys. Rev. A, vol. 84, 052726 (2011)], higher energy excitation can have increased radiation normal to the electron beam, i.e. at "0 degrees" for an incident beam at 90 degrees with respect to the target surface. [See, for example, J. G. Chervenak and A. Liuzzi, "Experimental thick-target bremsstrahlung spectra from electrons in the range 10 to 30 kev", Phys. Rev. A, vol. 12(1), pp. 26-33 (July, 1975).]

As was shown in FIGS. 1 and 2, the x-ray source 08 or 80 will typically have a window 04 or 40. This window 04 or 40 may additionally comprise a filter, such as a sheet or layer of aluminum, that attenuates the low energy x-rays, producing the modified energy spectrum 488 shown in FIG. 4.

When the electron energy is larger than the binding energy of an inner-shell (core-shell) electron of an element within the target, ejection of the electron (ionization) from the shell may occur, creating a vacancy. Electrons from less strongly bound outer shell(s) are then free to transition to the vacant inner shell, filling the vacancy. As the filling electron moves down to the lower energy level, the excess energy is radiated in the form of an x-ray photon. This is known as "characteristic" radiation because the energy of the photon is characteristic of the chemical element that generates the photon.

In the example shown in FIG. 4, an electron of 100 keV may ionize a K-shell electron of a tungsten atom, which has a binding energy of 69.5 keV. If the vacancy is filled by an electron from the L-shell, which has a binding energy of 10.2 keV, the x-ray photon has an energy equal to the energy difference between these two levels, or $K_{\alpha 1}$=59.3 keV. Likewise, a transition from the M-shell to the K-shell is denoted as $K_{\beta 1}$=67.2 keV. Splittings can occur in the various levels, giving rise to slight variations in energy, e.g. $K_{\beta 1}$, $K_{\beta 2}$, $K_{\beta 3}$ etc.

Because these discrete spectral lines depend on the atomic structure of the target material, the radiation is generally called "characteristic lines", since they are a characteristic of the particular material. The sharp lines 988 in the example of an x-ray radiation spectrum shown in FIG. 4 are "characteristic lines" for tungsten. Individual characteristic lines can be quite bright, and may be monochromatized with an appropriate filter or crystal monochromator where a monochromatic source is desired. The relative x-ray intensity (flux) ratio of the characteristic line(s) to the bremsstrahlung radiation depends on the element and the incident electron energy, and can vary substantially. In general, a maximum ratio for a given target material is obtained when the incident electron energy is 3 to 5 times the ionization energy of the inner shell electrons.

Returning to FIG. 3, these characteristic x-rays 388 are primarily generated in a fraction of the electron penetration depth, shown as the second largest shaded portion 248 of the interaction volume 200. The relative depth is influenced in part by the energy of the electrons 111, which typically falls off with increasing depth. If the electron energy does not exceed the binding energy for electrons within the target, no characteristic x-rays will be generated at all. The greatest radiation of characteristic lines may occur under bombardment with electrons having three to five times the energy of the characteristic x-ray photons. Because these characteristic x-rays result from atomic transitions between electron shells, the radiation will generally be entirely isotropic. The actual dimensions of this interaction volume 200 may vary, depending on the energy and angle of incidence of the electrons, the surface topography and other properties (including local charge density), and the density and atomic composition of the target material.

For some applications, broad-spectrum x-rays may be appropriate. For other applications, a monochromatic source may be desired or even necessary for the sensitivity or resolution required. In general, the composition of the target material is selected to provide x-ray spectra with ideal characteristics for a specific application, such as strong characteristic lines at particular wavelengths of interest, or bremsstrahlung radiation over a desired bandwidth.

Control of the x-ray radiation properties of a source may be governed by the selection of an electron energy (typically changed by varying the accelerating voltage), x-ray target material selection, and by the geometry of x-ray collection from the target.

Although the x-rays may be radiated isotropically, as was illustrated in FIG. 3, only the x-ray radiation 888 within a small solid angle in the direction of window 440 in the source, as shown in FIGS. 5A-C, will be collected. The x-ray brightness, (also called "brilliance" by some), defined as the number of x-ray photons per second per solid angle in $mrad^2$ per area of the x-ray source in $mm^2$ (some measures may also include a bandwidth window of 0.1% in the definition), is an important figure-of-merit for a source, as it relates to obtaining good signal-to-noise ratios for downstream applications.

The brightness can be increased by adjusting the geometric factors to maximize the collected x-rays. As illustrated in FIGS. 5A-C, the surface of a target 100 in a reflection x-ray source is generally mounted at an angle θ (as was also shown in FIG. 2) and bombarded by a distributed electron beam 111. X-ray radiation through a window 440 is shown for a set of five equally spaced radiation spots 408 for three target angles: θ=60° in FIG. 5A, θ=45° in FIG. 5B, and θ=30° in FIG. 5C. For a source at a high angle θ, for a solid angle centered at the window 440, the five spots are more spread out and brightness is reduced, while for low angle θ, the five source spots appear to be closer together, thus radiating more x-rays into the same solid angle and resulting in an increased brightness.

In principle, it may appear that a source mounted at θ=0° would have all sources apparently overlapping, accumulating the generated x-rays, and therefore would have the largest possible brightness. In practice, radiation at 0° occurs parallel to the surface of a solid metal target for conventional sources, and since the x-rays must propagate along a long length of the target material before emerging, most of the produced x-rays will be attenuated (reabsorbed) by the target material, reducing brightness. In practice, a source with take-off angle of around 6° to 15° (depending on the source configuration, target material, and electron energy) will often provide the greatest practical brightness, concentrating the apparent size of the source while reducing re-absorption within the target material and is therefore commonly used in commercial x-ray sources.

The effective source area is the projected area viewed along the direction along which x-ray are collected for use, i.e. along the axis of the x-ray beam. Because of the limited electron penetration depth, the effective source area for an incident electron beam with a size comparable or larger than the electron penetration depth is dependent on the angle between the axis of the x-ray beam and the surface of the target, referred to as the "take-off angle". When the electron beam size is much larger than the electron penetration depth, the effective source area decreases with decreasing take-off angle. This effect has been used to increase x-ray source brightness. However, with an extensive flat target, there is a limit to this benefit, due to the increasing absorption of x-rays from their production points inside the target as they propagate to the surface, which increases with a smaller take-off angle. Typically, a compromise between improved brightness from a lower angle and reduced brightness from reabsorption is reached around a take-off angle of ~6 degrees.

Another way to increase the brightness of the x-ray source for bremsstrahlung radiation is to use a target material with a higher atomic number Z, as efficiency of x-ray production for bremsstrahlung radiation scales with increasingly higher atomic number materials. Furthermore, the x-ray radiating material should ideally have good thermal properties, such as a high melting point and high thermal conductivity, in order to allow higher electron power loading on the source to increase x-ray production. For these reasons, targets are often fabricated using tungsten, with an atomic number Z=74. Table I lists several materials that are commonly used for x-ray targets, several additional potential target materials (notably useful for specific characteristic lines of interest), and some materials that may be used as substrates for target materials. Melting points, and thermal and electrical conductivities are presented for values near 300° K (27° C.). Most values are taken from the *CRC Handbook of Chemistry and Physics, 90th ed* [CRC Press, Boca Raton, Fla., 2009]. Other values are taken from various sources found on the Internet. Note that, for some materials, such as sapphire for example, thermal conductivities an order of magnitude larger may be possible when cooled to temperatures below that of liquid nitrogen (77° K) [see, for example, Section 2.1.5, *Thermal Properties*, of E. R. Dobrovinskaya et al., *Sapphire: Material, Manufacturing, Applications*, Springer Science+Business Media, LLC (2009)].

Other ways to increase the brightness of the x-ray source are: increasing the electron current density, either by increasing the overall current or by focusing the electron beam to a smaller spot using, for example, electron optics; or by increasing the electron energy by increasing the accelerating voltage (which increases x-ray production per unit electron energy deposited in the target, and may excite more radiation in the characteristic lines as well).

However, these improvements have a limit, in that all can increase the amount of heat generated in the interaction volume. The problem is exacerbated by having the target in a vacuum, so no air cooling from the surface by convection may occur. If too much heat is generated within the target, the target material may undergo phase changes, even as far as melting or evaporating. Because the vast majority of the energy deposited into the target by an electron beam becomes heat, thermal management techniques are an important tool for building better x-ray sources.

One prior art technology that has been developed to address this problem is the rotating anode system, illustrated in FIGS. 6A and 6B. In FIG. 6A, a cross-section is shown for a rotating anode x-ray source 580 comprising a target anode 500 that typically

TABLE I

Various Target and Substrate Materials and Selected Properties.

| Material (Elemental Symbol) | Atomic Number Z | Melting Point ° C. (1 atm) | Thermal Conductivity (W/(m ° C.)) | Electrical Conductivity (MS/m) |
|---|---|---|---|---|
| Common Target Materials: | | | | |
| Chromium (Cr) | 24 | 1907 | 93.7 | 7.9 |
| Iron (Fe) | 26 | 1538 | 80.2 | 10.0 |
| Cobalt (Co) | 27 | 1495 | 100 | 17.9 |

TABLE I-continued

Various Target and Substrate Materials and Selected Properties.

| Material (Elemental Symbol) | Atomic Number Z | Melting Point ° C. (1 atm) | Thermal Conductivity (W/(m ° C.)) | Electrical Conductivity (MS/m) |
|---|---|---|---|---|
| Copper (Cu) | 29 | 1085 | 401 | 58.0 |
| Molybdenum (Mo) | 42 | 2623 | 138 | 18.1 |
| Silver (Ag) | 47 | 962 | 429 | 61.4 |
| Tungsten (W) | 74 | 3422 | 174 | 18.4 |
| Other Possible Target Materials: | | | | |
| Titanium (Ti) | 22 | 1668 | 21.9 | 2.6 |
| Gallium (Ga) | 35 | 30 | 40.6 | 7.4 |
| Rhodium (Rh) | 45 | 1964 | 150 | 23.3 |
| Indium (In) | 49 | 157 | 81.6 | 12.5 |
| Cesium (Cs) | 55 | 28 | 35.9 | 4.8 |
| Rhenium (Re) | 75 | 3185 | 47.9 | 5.8 |
| Gold (Au) | 79 | 1064 | 317 | 44.0 |
| Lead (Pb) | 82 | 327 | 35.3 | 4.7 |
| Other Potential Substrate Materials with low atomic number: | | | | |
| Beryllium (Be) | 4 | 1287 | 200 | 26.6 |
| Carbon (C): Diamond | 6 | * | 2300 | $10^{-19}$ |
| Carbon (C): Graphite \|\| | 6 | * | 1950 | 0.25 |
| Carbon (C): Nanotube (SWNT) | 6 | * | 3180 | 100.0 |
| Carbon (C): Nanotube (bulk) | 6 | * | 200 | |
| Boron Nitride (BN) | B = 5 N = 7 | ** | 20 | $10^{-17}$ |
| Silicon (Si) | 14 | 1414 | 124 | $1.56 \times 10^{-9}$ |
| Silicon Carbide (β-SiC) | Si = 14 C = 6 | 2798 | 0.49 | $10^{-9}$ |
| Sapphire ($Al_2O_3$) \|\| C | Al = 13 O = 8 | 2053 | 32.5 | $10^{-20}$ |

* Carbon does not melt at 1 atm; it sublimes at ~3600° C.

** BN does not melt at 1 atm; it sublimes at ~2973° C.

rotates between 3,300 and 10,000 rpm. The target anode 500 is connected by a shaft 530 to a rotor 520 supported by conducting bearings 524 that connect, through its mount 522, to the lead 22 and the positive terminal of the high voltage supply 10. The rotation of the rotor 520, shaft 530 and anode 500, all within the vacuum chamber 20, is typically driven inductively by stator windings 525 mounted outside the vacuum.

The surface of the target anode 500 is shown in more detail in FIG. 6B. The edge 510 of the rotating target anode 500 is sometimes beveled at an angle, and the source of the electron beam 511 is in a position to direct the electron beam onto the beveled edge 510 of the target anode 500, generating x-rays 888 from a target spot 501. As the target spot 501 generates x-rays, it heats up, but as the target anode 500 rotates, the heated spot moves away from the target spot 501, and the electron beam 511 now irradiates a cooler portion of the target anode 500. The hot spot has the time of one rotation to cool before becoming heated again when it passes through the hot spot 501. By continuously rotating the target anode 500, x-rays are generated from a fixed single spot, while the total area of the target illuminated by the electron beam is substantially larger than the electron beam spot, effectively spreading the electron energy deposition over a larger area (and volume).

Another approach to mitigating heat is to use a target with a thin layer of target x-ray generating material deposited onto a substrate with high heat conduction. Because the interaction volume is thin, for electrons with energies up to 100 keV the target material itself need not be thicker than a few microns, and can be deposited onto a substrate, such as diamond, sapphire or graphite that conducts the heat away quickly. However, as noted in Table I, diamond is a very poor electrical conductor, so the design of any anode fabricated on a diamond substrate must still provide an electrical connection between the target material of the anode and the positive terminal of the high voltage. [Diamond mounted anodes for x-ray sources have been described by, for example, K. Upadhya et al. U.S. Pat. No. 4,972,449; B. Spitsyn et. al. U.S. Pat. No. 5,148,462; and M. Fryda et al., U.S. Pat. No. 6,850,598].

The substrate may also comprise channels for a coolant, for example liquids such as water or ethylene glycol, or a gas such as hydrogen or helium, that remove heat from the substrate [see, for example, Paul E. Larson, U.S. Pat. No. 5,602,899]. Water-cooled anodes are used for a variety of x-ray sources, including rotating anode x-ray sources.

The substrate may in turn be mounted to a heat sink comprising copper or some other material chosen for its thermally conducting properties. The heat sink may also comprise channels for a coolant, to transport the heat away [see, for example, Edward J. Morton, U.S. Pat. No. 8,094,784]. In some cases, thermoelectric coolers or cryogenic systems have been used to provide further cooling to an x-ray target mounted onto a heat sink, again, all with the goal of achieving higher x-ray brightness without melting or damaging the target material through excessive heating.

Another approach to mitigating heat for microfocus sources is to use a target created by a jet of liquid metal. Electrons bombard a conducting jet of liquid gallium (Z=31), and because the heated gallium flows away from the electron irradiation volume with the jet, higher current densities are possible. [See, for example, M. Otendal, et al., "A 9 keV electron-impact liquid-gallium-jet x-ray source", Rev. Sci. Instrum., vol. 79, 016102, (2008)].

Although effective in certain circumstances, there is still room for improvement. Jets of liquid metal require an elaborate plumbing system and consumables, are limited in the materials (and thus values of Z and their associated spectra) that may be used, and are difficult to scale to larger output powers. In the case of thin film targets of uniform solid material coated onto diamond substrates, there is still a limitation in the amount of heat that can be tolerated before damage to the film may occur, even if used in a rotating anode configuration. Conduction of heat only occurs through the bottom of the film. In a lateral dimension, the same conduction problem exists as exists in the bulk material.

There is therefore a need for an x-ray source that may be used to achieve higher x-ray brightness through the use of a higher electron current density, but that is still compact enough to fit in a laboratory or table-top environment, or even be useful in portable devices. Such brighter sources would enable x-ray based tools that offer better signal to noise ratios for imaging and other scientific and diagnostic applications.

BRIEF SUMMARY OF THE INVENTION

This disclosure presents novel x-ray sources that have the potential of being up to several orders of magnitude brighter than existing commercial x-ray technologies. The higher brightness is achieved in part through the use of novel configurations for x-ray targets used in generating x-rays from electron beam bombardment. The x-ray target configurations may comprise a number of microstructures of one or more selected x-ray generating materials fabricated in close thermal contact with (such as embedded in or buried in) a substrate with high thermal conductivity, such that the heat is more efficiently drawn out of the x-ray generating material. This in turn allows bombardment of the x-ray generating material with higher electron density and/or higher energy electrons, which leads to greater x-ray brightness.

A significant advantage to some embodiments is that the orientation of the microstructures allows the use of an on-axis collection angle, allowing the accumulation of x-rays from several microstructures to be aligned to appear to originate at a single origin, and can be used for alignments at "zero-angle" x-ray radiation. The linear accumulation of x-rays from the multiple origins leads to greater x-ray brightness.

Some embodiments of the invention additionally comprise x-ray optical elements that collect the x-rays radiated from one structure and re-focus them to overlap with the x-rays from a second structure. This relaying of x-rays can also lead to greater x-ray brightness.

Some embodiments of the invention comprise an additional cooling system to transport the heat away from the anode or anodes. Some embodiments of the invention additionally comprise rotating the anode or anodes comprising targets with microstructured patterns in order to further dissipate heat and increase the accumulated x-ray brightness.

DETAILED DESCRIPTIONS OF EMBODIMENTS OF THE INVENTION

1. A Basic Embodiment of the Invention

Figure 7:
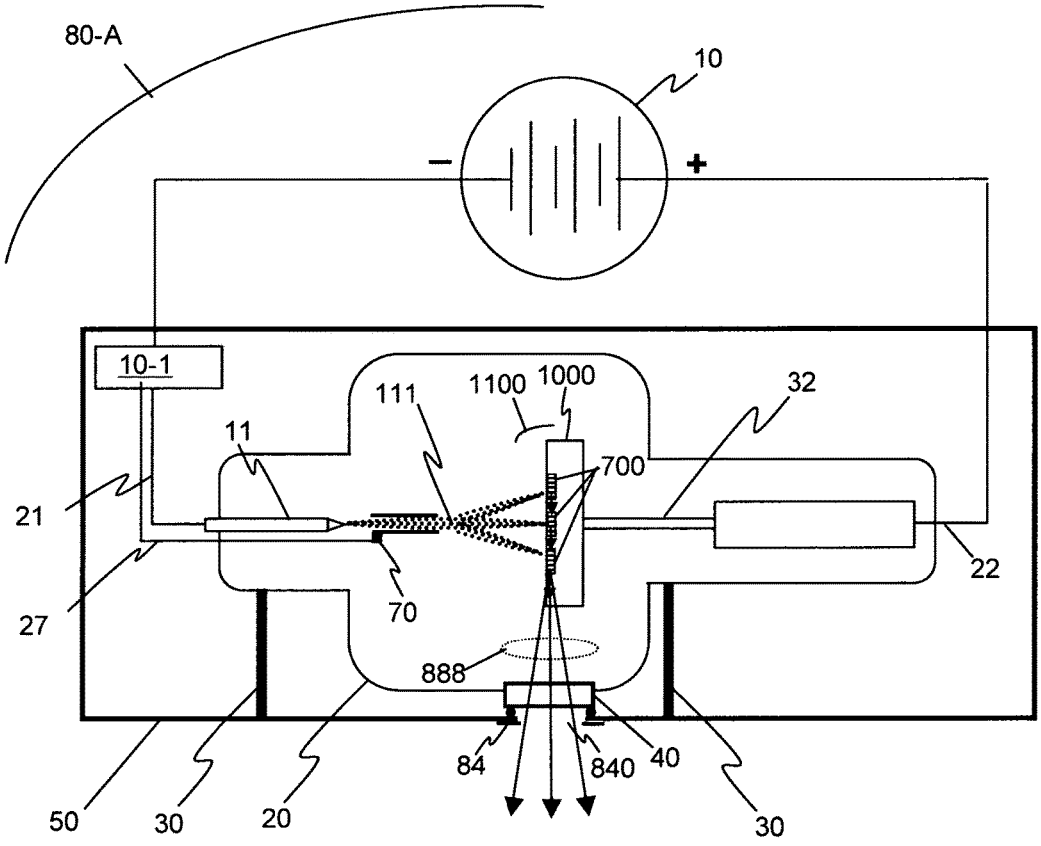
FIG. 7 illustrates a schematic cross-section view of an embodiment of an x-ray system according to the invention.

FIG. 7 illustrates an embodiment of a reflective x-ray system 80-A according to the invention. As in the prior art reflective x-ray system 80 described above, the source comprises a vacuum environment (typically $10^{-6}$ torr or better) commonly maintained by a sealed vacuum chamber 20 or active pumping, and manufactured with sealed electrical leads 21 and 22 that pass from the negative and positive terminals of a high voltage source 10 outside the tube to the various elements inside the vacuum chamber 20. The source 80-A will typically comprise mounts 30 which secure the vacuum chamber 20 in a housing 50, and the housing 50 may additionally comprise shielding material, such as lead, to prevent x-rays from being radiated by the source 80-A in unwanted directions.

As before, inside the chamber 20, an emitter 11 connected through the lead 21 to the negative terminal of a high voltage source 10 serves as a cathode and generates a beam of electrons 111, often by running a current through a filament. Any number of prior art techniques for electron beam generation may be used for the embodiments of the invention disclosed herein. Additional known techniques used for electron beam generation include heating for thermionic emission, Schottky emission (a combination of heating and field emission), emitters comprising nanostructures such as carbon nanotubes), and by use of ferroelectric materials. [For more on electron emission options for electron beam generation, see Shigehiko Yamamoto, "Fundamental physics of vacuum electron sources", Reports on Progress in Physics vol. 69, pp. 181-232 (2006); Alireza Nojeh, "Carbon Nanotube Electron Sources: From Electron Beams to Energy Conversion and Optophononics", ISRN Nanomaterials vol. 2014, Art. ID 879827, 23 pages (2014); and H. Riege, "Electron Emission from Ferroelectrics—A Review", CERN Report CERN AT/93-18, Geneva Switzerland, July 1993.]

As before, a target 1100 comprising a target substrate 1000 and regions 700 of x-ray generating material is electrically connected to the opposite high voltage lead 22 and target support 32, thus serving as an anode. The electrons 111 accelerate towards the target 1100 and collide with it at high energy, with the energy of the electrons determined by the magnitude of the accelerating voltage. The collision of the electrons 111 into the target 1100 induces several effects, including the generation of x-rays, some of which exit the vacuum tube 20 and are transmitted through a window 40 that is transparent to x-rays.

However, in some embodiments of the invention, there may also be an electron beam control mechanism 70 such as an electrostatic lens system or other system of electron optics that is controlled and coordinated with the electron dose and voltage provided by the emitter 11 by a controller 10-1 through a lead 27. The electron beam 111 may therefore be scanned, focused, de-focused, or otherwise directed onto a target 1100 comprising one or more microstructures 700 fabricated to be in close thermal contact with a substrate 1000.

As illustrated in FIG. 7, the alignment of the microstructures 700 may be arranged such that the bombardment of several of the microstructures 700 by the electron beam or beams 111 will excite radiation in a direction orthogonal to the surface normal of the target in such a manner that the intensity in the direction of view will add or accumulate. The direction may also be selected by means of an aperture 840 in a screen 84 for the system to form the directional beam 888 that exits the system through a window 40. In some embodiments, the aperture 840 may be positioned outside the vacuum chamber, or, more commonly, the window 40 itself may serve as the aperture 840. In some embodiments, the aperture may be inside the vacuum chamber.

Targets such as those to be used in x-ray sources according to the invention disclosed herein have been described in detail in the co-pending US Patent Application entitled STRUCTURED TARGETS FOR X-RAY GENERATION (U.S. patent application Ser. No. 14/465,816, filed Aug. 21, 2014), which is hereby incorporated by reference in its entirety. Any of the target designs and configurations disclosed in the above referenced co-pending application may be considered for use as a component in any or all of the x-ray sources disclosed herein.

Figure 8:
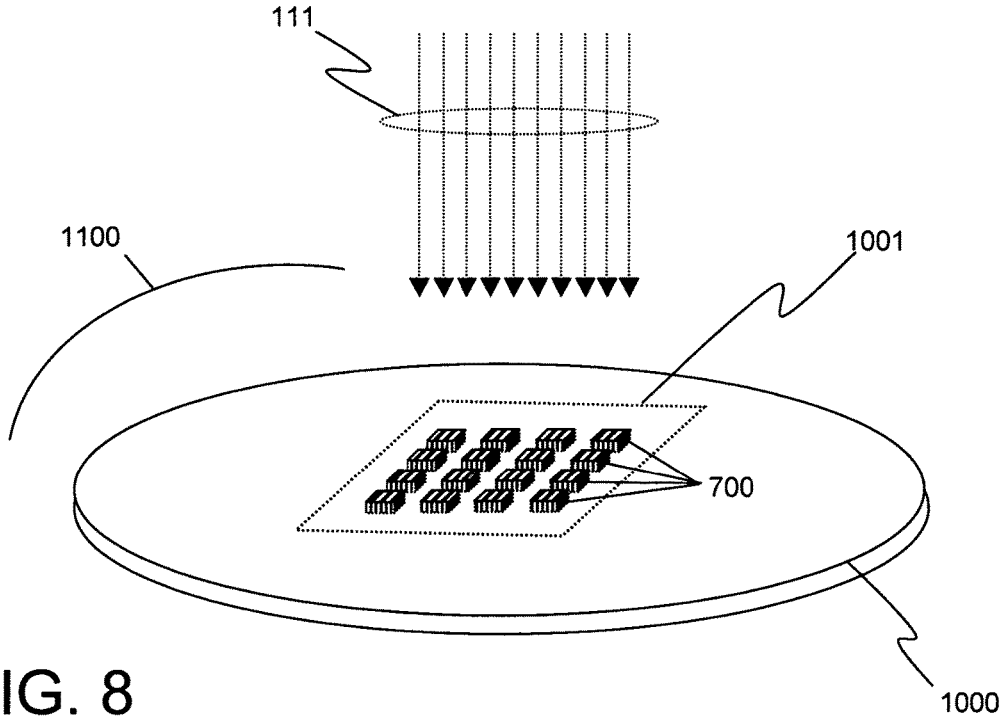
FIG. 8 illustrates a perspective view of a target comprising a grid of embedded rectangular target microstructures on a larger substrate that may be used in some embodiments of the invention.

FIG. 8 illustrates a target 1100 as may be used in some embodiments of the invention. In this figure, a substrate 1000 has a region 1001 that comprises an array of microstructures 700 comprising x-ray generating material (typically a metallic material) that are arranged in a regular array of right rectangular prisms. In a vacuum, electrons 111 bombard the target from above, and generate heat and x-rays in the microstructures 700. The material in the substrate 1000 is selected such that it has relatively low energy deposition rate for electrons in comparison to the x-ray generating microstructure material (typically by selecting a low Z material for the substrate), and therefore will not generate a significant amounts of heat and x-rays. The material of the substrate 1000 may also be chosen to have a high thermal conductivity, typically larger than 100 W/(m ° C.), and the microstructures are typically embedded within the substrate, i.e. if the microstructures are shaped as rectangular prisms, it is preferred that at least five of the six sides are in close thermal contact with the substrate 1000, so that heat generated in the microstructures 700 is effectively conducted away into the substrate 1000. However, targets used in other embodiments may have fewer direct contact surfaces. In general, when the term "embedded" is used in this disclosure, at least half of the surface area of the microstructure will be in close thermal contact with the substrate.

Figure 1:
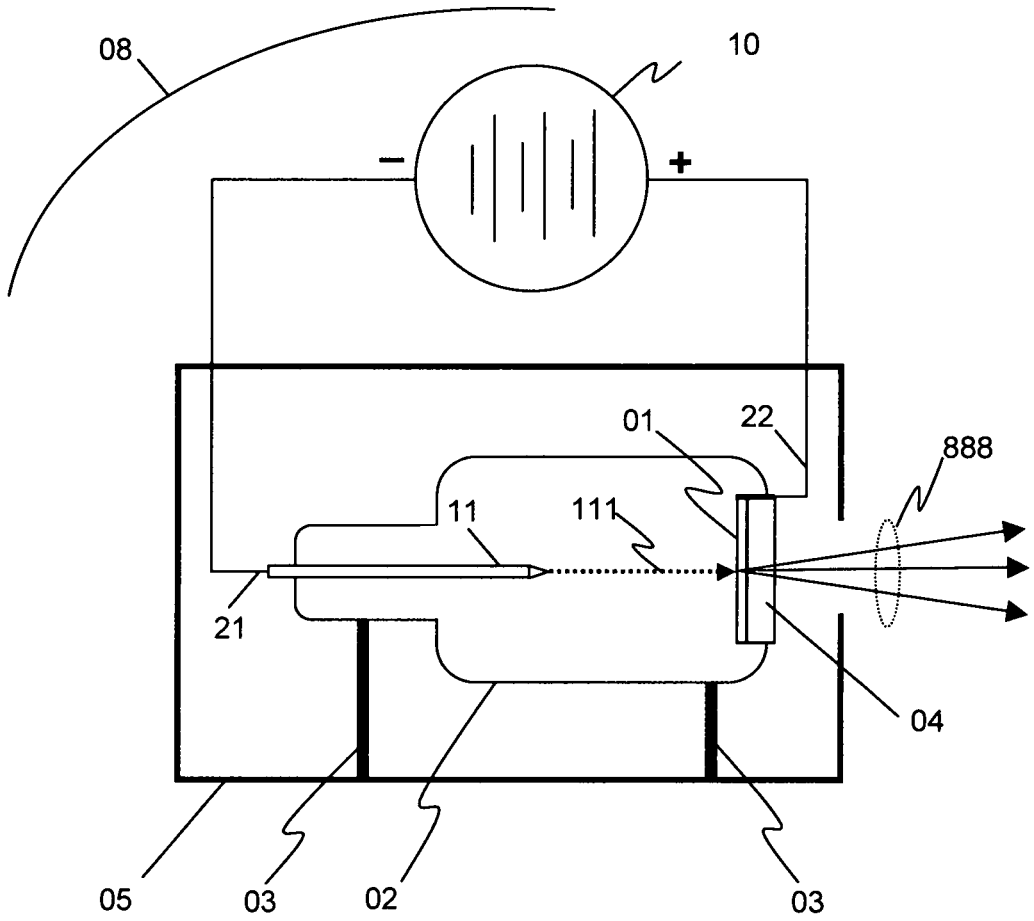
FIG. 1 Prior Art
FIG. 1 illustrates a schematic cross-section diagram of a standard prior art transmission x-ray source.
Figure 2:
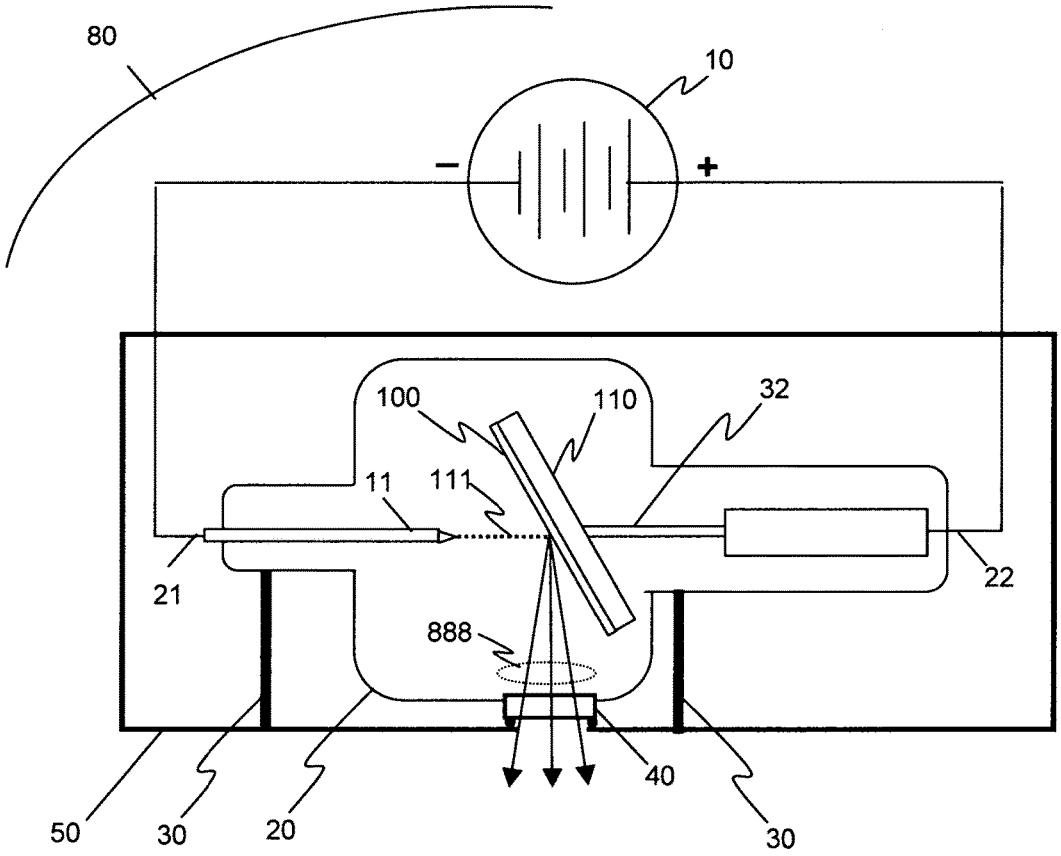
FIG. 2 Prior Art
FIG. 2 illustrates a schematic cross-section diagram of a standard prior art reflection x-ray source.
Figure 3:
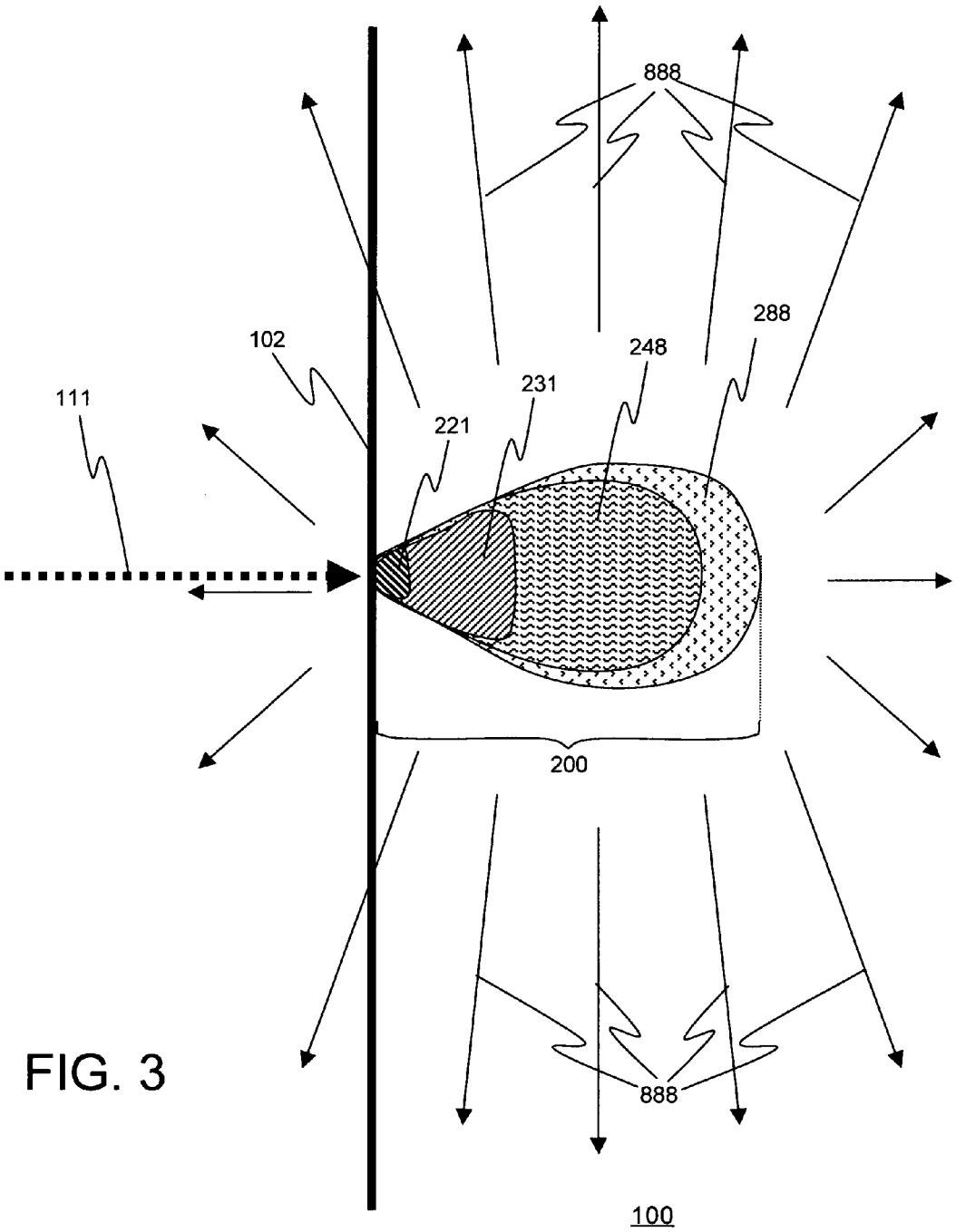
FIG. 3 Prior Art
FIG. 3 illustrates a cross-section diagram the interaction of electrons with a surface of a material in a prior art x-ray source.
Figure 4:
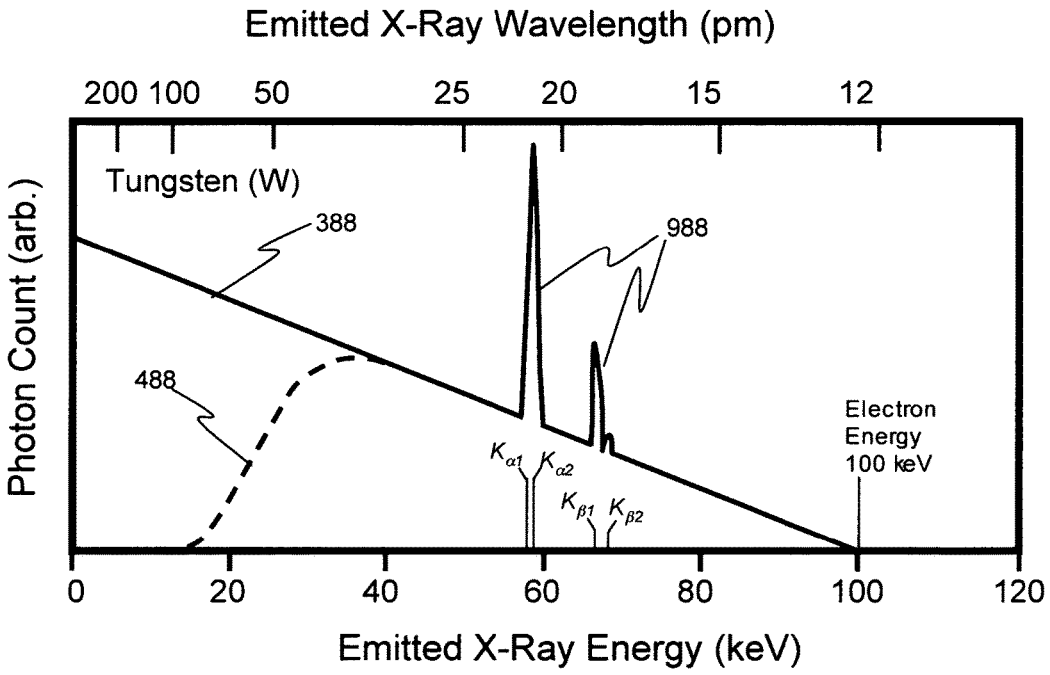
FIG. 4 Prior Art
FIG. 4 illustrates the typical x-ray radiation spectrum for a tungsten target.
Figure 6A:
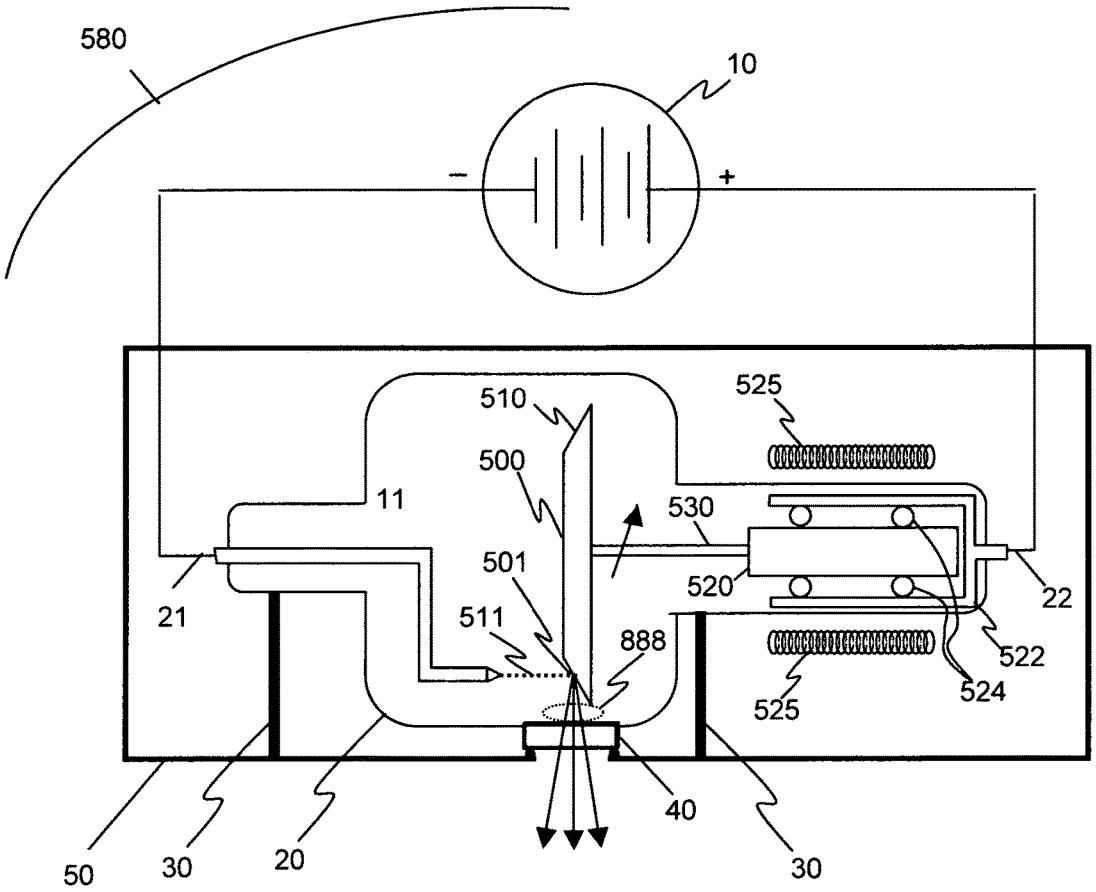
FIG. 6A illustrates a schematic cross-section view of a prior art rotating anode x-ray source.
Figure 6B:
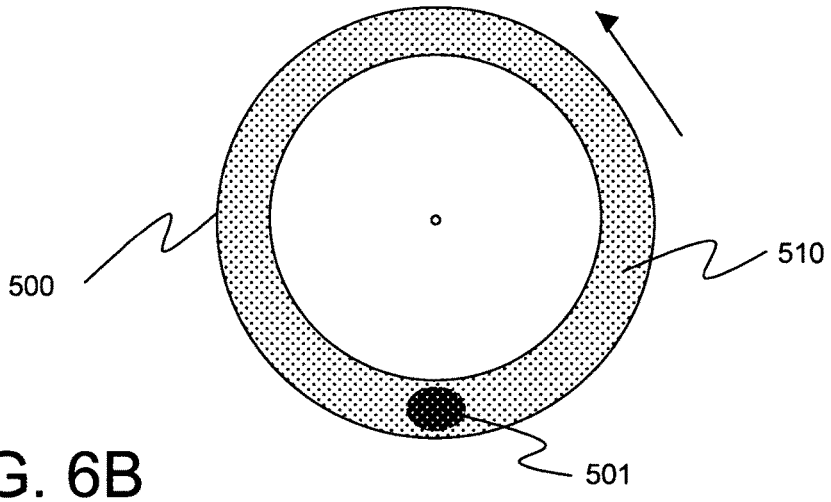
FIG. 6B Prior Art
FIG. 6B illustrates a top view of the anode for the rotating anode system of FIG. 6A.

A target 1100 according to the invention may be inserted as a replacement for the target 01 for the transmission x-ray source 08 illustrated in FIG. 1, or for the target 100 illustrated in the reflecting x-ray source 80 of FIG. 2, or adapted for use as the target 500 used in the rotating anode x-ray source 580 of FIGS. 6A and 6B.

It should be noted here that, when the word "microstructure" is used herein, it is specifically referring to microstructures comprising x-ray generating material. Other structures, such as the cavities used to form the x-ray microstructures, have dimensions of the same order of magnitude, and might also be considered "microstructures". As used herein, however, other words, such as "structures", "cavities", "holes", "apertures", etc. may be used for these structures when they are formed in materials, such as the substrate, that are not selected for their x-ray generating properties. The word "microstructure" will be reserved for structures comprising materials selected for their x-ray generating properties.

Likewise, it should be noted that, although the word "microstructure" is used, x-ray generating structures with dimensions smaller than 1 micron, or even as small as nano-scale dimensions (i.e. greater than 10 nm) may also be described by the word "microstructures" as used herein.

Figure 9:
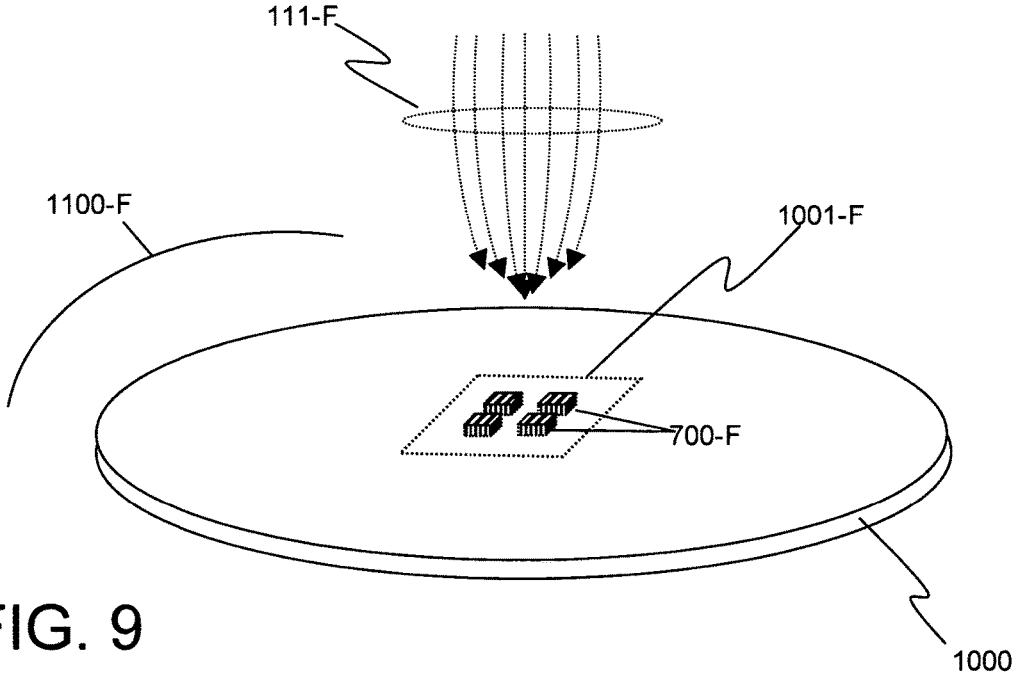
FIG. 9 illustrates a perspective view of a variation of a target comprising a grid of embedded rectangular target microstructures on a larger substrate for use with focused electron beam that may be used in some embodiments of the invention.

FIG. 9 illustrates another target 1100-F as may be used in some embodiments of the invention in which the electron beam 111-F is directed by electrostatic lenses to form a more concentrated, focused spot. For this situation, the target 1100-F will still comprise a region 1001-F comprising an array of microstructures 700-F comprising x-ray generating material, but the size and dimensions of this region 1001-F can be matched to regions where electron exposure will occur. In these targets, the "tuning" of the source geometry and the x-ray generating material can be controlled such that the designs mostly limit the amount of heat generated to the microstructured region 1001-F, while also reducing the design and manufacturing complexity. This may be especially useful when used with electron beams focused to form a micro-spot, or by more intricate systems that form a more complex electron exposure pattern.

Figure 10:
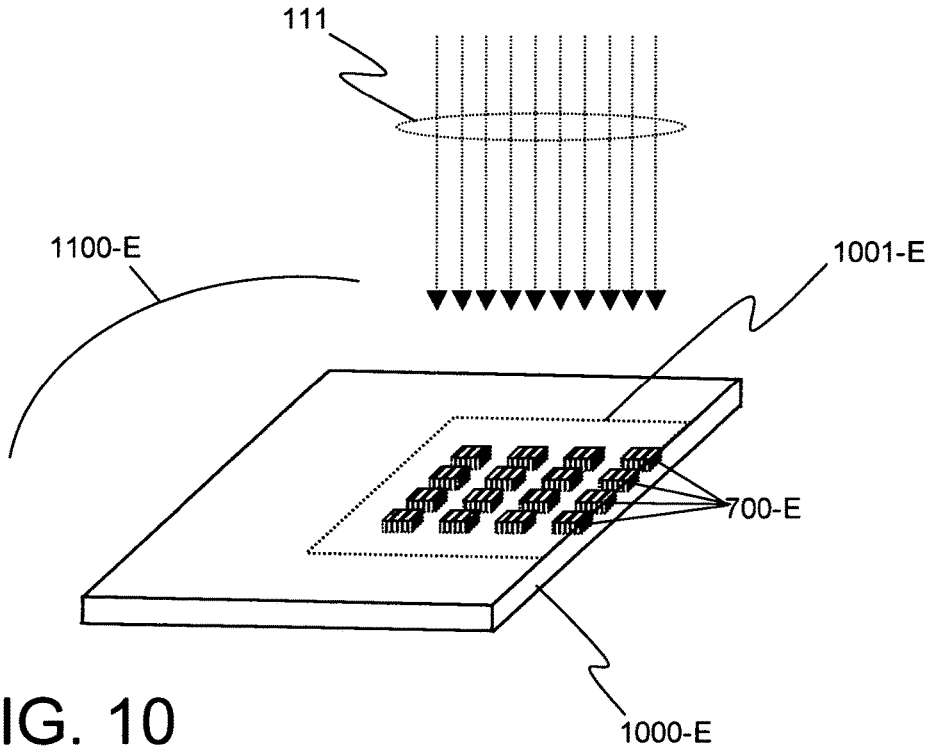
FIG. 10 illustrates a perspective view of a variation of a target comprising a grid of embedded rectangular target microstructures on a truncated substrate as may be used in some embodiments of the invention.

FIG. 10 illustrates another target 1100-E as may be used in some embodiments of the invention, in which the target 1100-E still has a region 1001-E with an array of microstructures 700-E comprising x-ray generating material that produce x-rays when exposed to electrons 111, but the region 1001-E is positioned flush with or near the edge of the substrate 1000-E. This configuration may be useful in targets where the substrate comprises a material that absorbs x-rays, and so radiation at near-zero angles would be significantly attenuated in a configuration as was shown in FIG. 8.

A disadvantage of the target of FIG. 10, however, as compared to FIG. 8 is that a significant portion of the substrate on one side of the microstructures 700-E is gone. Heat therefore is not carried away from the microstructures symmetrically, and the local heating may increase, impairing heat flow.

Figure 11:
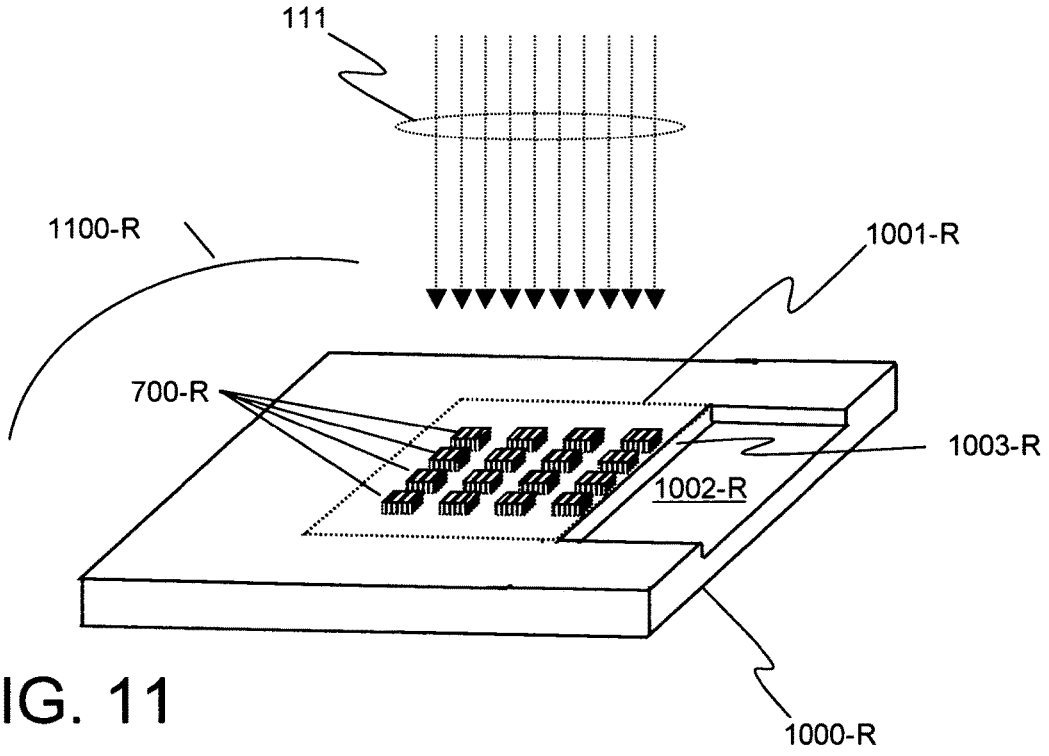
FIG. 11 illustrates a perspective view of a variation of a target comprising a grid of embedded rectangular target microstructures on a substrate with a recessed shelf that may be used in some embodiments of the invention.

To address this, some targets as may be used in some embodiments of the invention may use a configuration like that shown in FIG. 11. Here, the target 1100-R comprises a substrate 1000-R with a recessed shelf 1002-R. This allows the region 1001-R comprising an array of microstructures 700-R to be positioned flush with, or close to, a recessed edge 1003-R of the substrate, and produce x-rays at or near zero angle without being reabsorbed by the substrate 1000-

R, yet provides a more symmetric heat sink for the heat generated when exposed to electrons 111.

Figure 12:
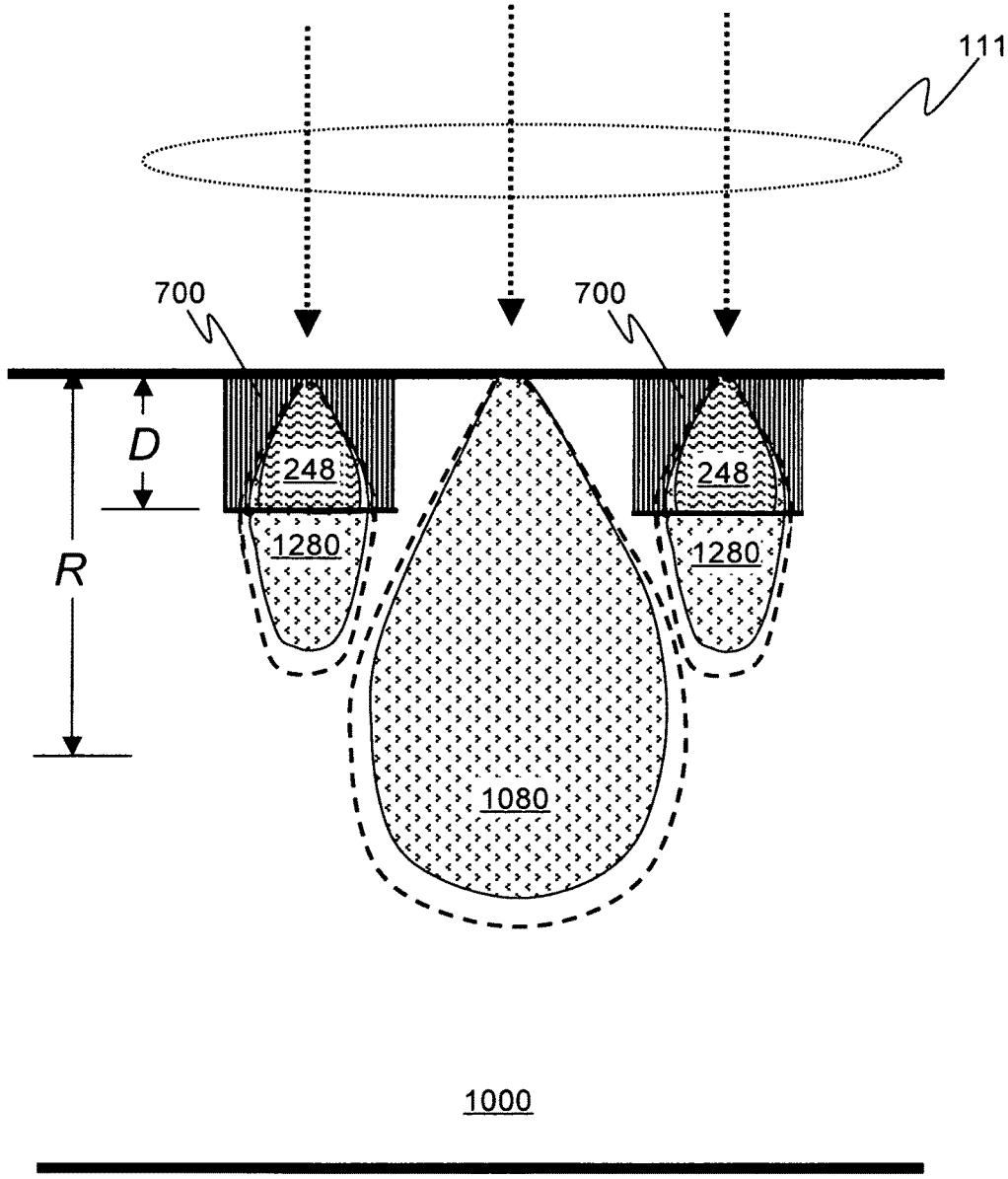
FIG. 12 illustrates a cross-section view of electrons entering a target comprising target microstructures on a larger substrate that may be used in some embodiments of the invention.

FIG. 12 illustrates the relative interaction between a beam of electrons 111 and a target comprising a substrate 1000 and microstructures 700 of x-ray generating material. As illustrated, only three electron paths are shown, with two representing electrons bombarding the two shown microstructures 700, and one representing electrons interacting with the substrate.

As discussed in Eqn. 1 above, the depth of penetration can be estimated by Pott's Law. Using this formula, Table II illustrates some of the estimated penetration depths for some common x-ray target materials.

TABLE II

Estimates of penetration depth for 60 keV electrons into some materials.

| Material | Z | Density ($g/cm^3$) | Penetration Depth (μm) |
|---|---|---|---|
| Diamond | 6 | 3.5 | 13.28 |
| Copper | 29 | 8.96 | 5.19 |
| Molybdenum | 42 | 10.28 | 4.52 |
| Tungsten | 74 | 19.25 | 2.41 |

For the illustration in FIG. 12, if 60 keV electrons are used, and diamond (Z=6) is selected as the material for the substrate 1000 and copper (Z=29) is selected as the x-ray generating material for the microstructures 700, the dimension marked as R to the left side of FIG. 12 corresponds to a reference dimension of 10 microns, and the depth D in the x-ray generating material, which, when set to be ⅔ (66%) of the electron penetration depth for copper, becomes D≈3.5 μm.

The majority of characteristic Cu K x-rays are generated within depth D. The electron interactions below that depth typically generate few characteristic K-line x-rays but will contribute to the heat generation, thus resulting in a low thermal gradient along the depth direction. It is therefore preferable in some embodiments to set a maximum thickness for the microstructures in the target in order to limit electron interaction in the material and optimize local thermal gradients. One embodiment of the invention limits the depth of the microstructured x-ray generating material in the target to between one third and two thirds of the electron penetration depth at the incident electron energy. In this case, the lower mass density of the substrate leads to a lower energy deposition rate in the substrate material immediately below the x-ray generating material, which in turn leads to a lower temperature in the substrate material below. This results in a higher thermal gradient between the x-ray generating material and the substrate, enhancing heat transfer. The thermal gradient is further enhanced by the high thermal conductivity of the substrate material.

For similar reasons, selecting the depth D to be less than the electron penetration depth is also generally preferred for efficient generation of bremsstrahlung radiation, because the electrons below that depth have lower energy and thus lower x-ray production efficiency.

Note: Other choices for the dimensions of the x-ray generating material may also be used. In targets as used in some embodiments of the invention, the depth of the x-ray generating material may be selected to be 50% of the electron penetration depth. In other embodiments, the depth of the x-ray generating material may be selected to be 33% of the electron penetration depth. In other embodiments, the depth D for the microstructures may be selected related to the "continuous slowing down approximation" (CSDA) range for electrons in the material. Other depths may be specified depending on the x-ray spectrum desired and the properties of the selected x-ray generating material.

Note: In other targets as may be used in some embodiments of the invention, a particular ratio between the depth and the lateral dimensions (such as width W and length L) of the x-ray generating material may also be specified. For example, if the depth is selected to be a particular dimension D, then the lateral dimensions W and/or L may be selected to be no more than 5×D, giving a maximum ratio of 5. In other targets as may be used in some embodiments of the invention, the lateral dimensions W and/or L may be selected to be no more than 2×D. It should also be noted that the depth D and lateral dimensions W and L (for width and length of the x-ray generating microstructure) may be defined relative to the axis of electron propagation, or defined with respect to the orientation of the surface of the x-ray generating material. For normal incidence electrons, these will be the same dimensions. For electrons incident at an angle, care must be taken to make sure the appropriate projections are used.

Figure 13:
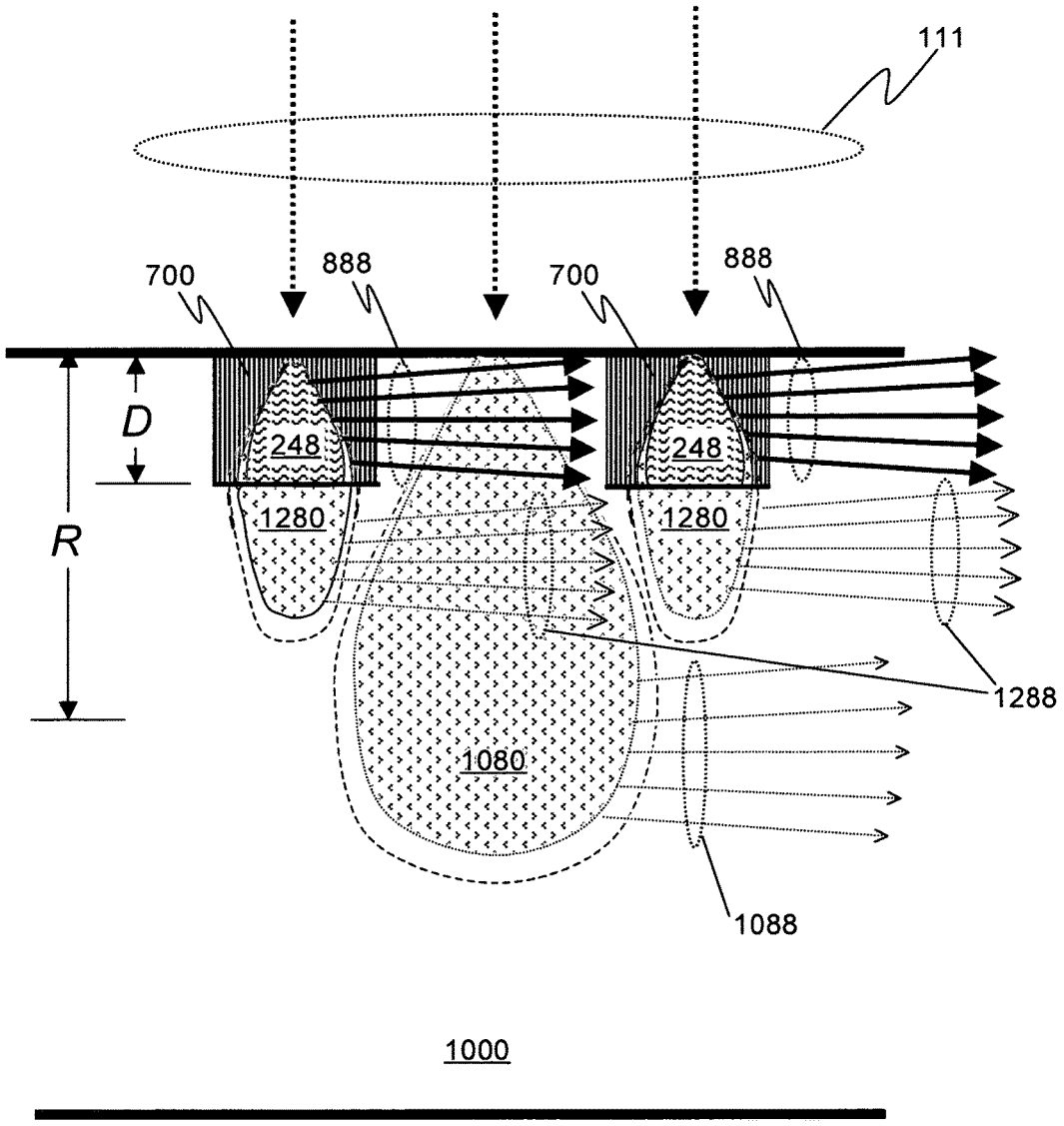
FIG. 13 illustrates a cross-section view of some of the x-rays radiated by the target of FIG. 12.

FIG. 13 illustrates the relative x-ray generation from the various regions shown in FIG. 12. X-rays 888 comprise characteristic x-rays generated from the region 248 where they are generated in the microstructures 700 of x-ray generating material, while the regions 1280 and 1080 where the electrons interact with the substrate generate characteristic x-rays of the substrate element(s) (but not characteristic x-rays of the element(s) of the x-ray generating region 248 of the microstructures 700). Additionally, bremsstrahlung radiation x-rays radiated from the region 248 of the microstructures 700 of the x-ray generating material are typically much stronger than in the regions 1280 and 1080 where electrons encounter only the low Z substrate, which produce weak continuum x-rays 1088 and 1228.

Figure 5A:
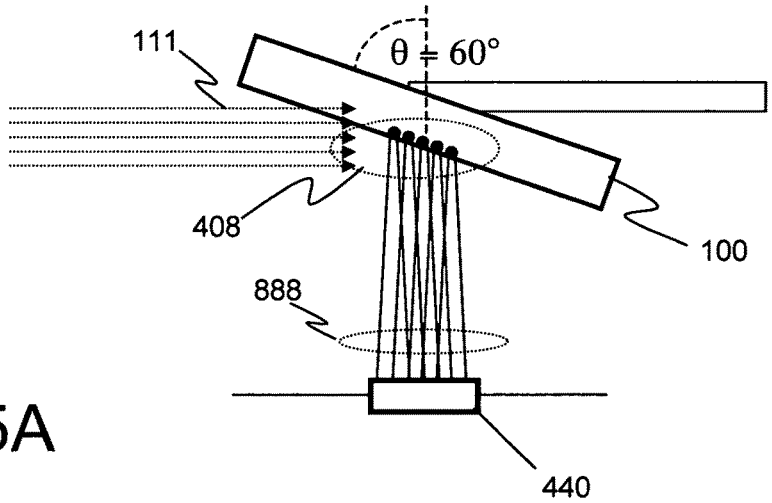
FIG. 5A illustrates x-ray radiation from a prior art target for a target at a tilt angle of 60 degrees.
Figure 5B:
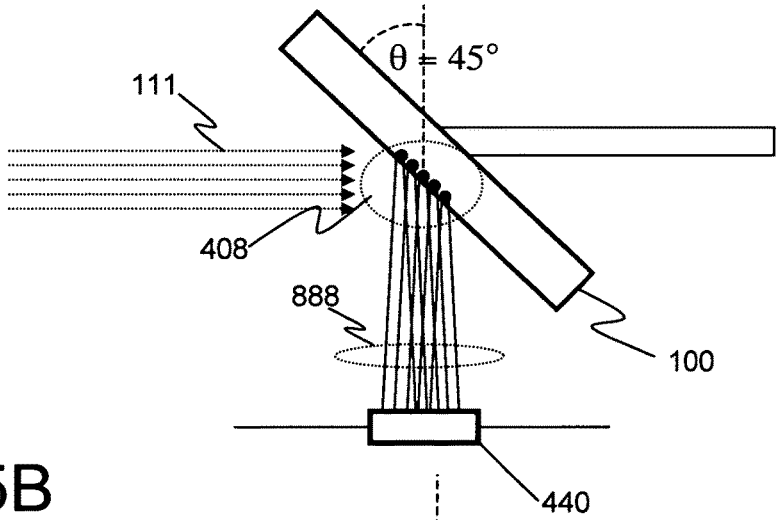
FIG. 5B illustrates x-ray radiation from a prior art target for a target at a tilt angle of 45 degrees.
Figure 5C:
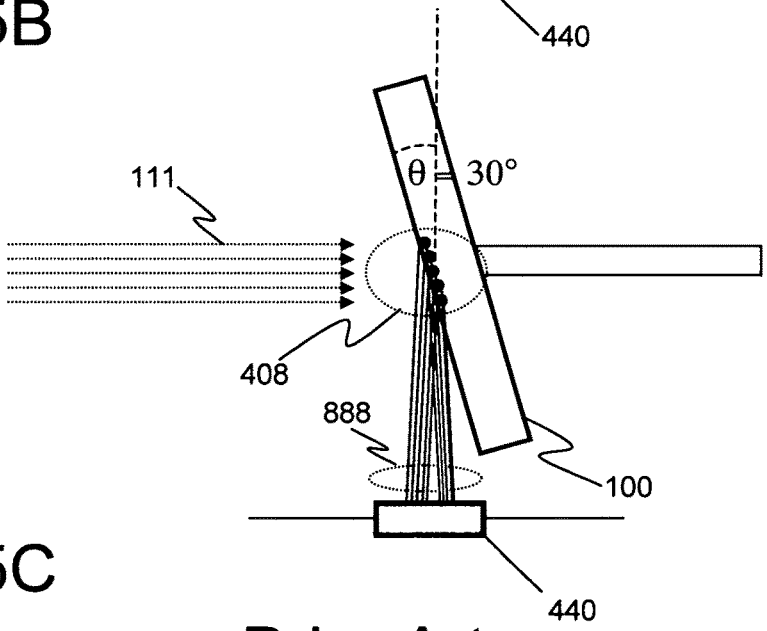
FIG. 5C Prior Art
FIG. 5C illustrates x-ray radiation from a prior art target for a target at a tilt angle of 30 degrees.

It should be noted that, although the illustration of FIG. 13 shows x-rays radiated only to the right, this is in anticipation of a window or collector being placed to the right, when this target is used in the low-angle high-brightness configuration discussed in FIGS. 5A-C. X-rays are in fact typically radiated in all directions from these regions.

It should also be noted that materials are relatively transparent to their own characteristic x-rays, so that FIG. 13 illustrates an arrangement that allows the linear accumulation of characteristic x-rays along the microstructures and therefore can produce a relatively strong characteristic x-ray signal. However, many lower energy x-rays will be attenuated by the target materials, which will effectively act as an x-ray filter. Other selections of materials and geometric parameters may be chosen (e.g. a non-linear scheme) if non-characteristic, continuum x-rays are desired, such as applications in which a bandpass of low energy x-rays are desired (e.g. for imaging or fluorescence analysis of low Z materials).

Up to this point, targets that are arranged in planar configurations have been presented. These are generally easier to implement, since equipment and process recipes for deposition, etching and other planar processing steps are well known from processing devices for microelectromechanical systems (MEMS) applications using planar diamond, and from processing silicon wafers for the semiconductor industry.

However, in some embodiments, a target with a surface with additional properties in three dimensions (3-D) may be desired. As discussed previously, when the electron beam is larger than the electron penetration depth, the apparent x-ray source size and area is at minimum (and brightness maximized) when viewed parallel to surface, i.e. at a zero degree (0°) take-off angle. As a consequence, the x-ray radiation is apparently brightest when viewed at 0° take-off angle. The radiation from within the x-ray generating material will accumulate as it propagates at 0° through the material.

With an extended target of substantially uniform material, the attenuation of x-rays between their points of origin inside the target as they propagate through the material to the surface increases with decreasing take-off angle, due to the longer distance traveled within the material, and often becomes largest at or near 0° take-off angle. Reabsorption may therefore counterbalance any increased brightness that viewing at near 0° achieves. The distance through which an x-ray beam will be reduced in intensity by 1/e is called the x-ray attenuation length, and therefore, a configuration in which the generated x-rays pass through as little additional material as possible, with the distance selected to be related to the x-ray attenuation length, may be desired.

Figure 14:
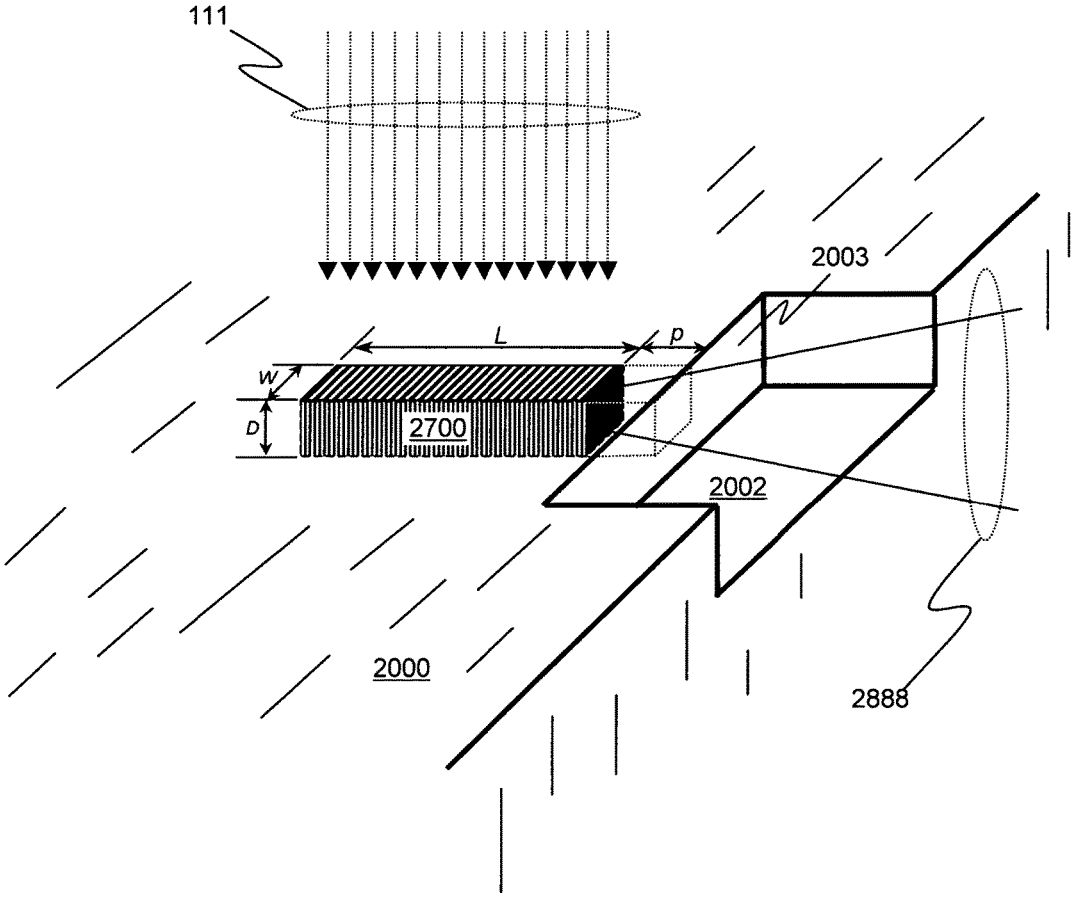
FIG. 14 illustrates a perspective view of a target comprising a single rectangular microstructure arranged on a substrate with a recessed region that may be used in some embodiments of the invention.

An illustration of a portion of a target as may be used in some embodiments of the invention is presented in FIG. 14. In FIG. 14, an x-ray generating region comprising a single microstructure 2700 is configured at or near a recessed edge 2003 of the substrate on a shelf 2002, similar to the situation illustrated in FIG. 11. The x-ray generating microstructure 2700 is in the shape of a rectangular bar of width W, length L, and depth or thickness D that is embedded in the substrate 2000 and produces x-rays 2888 when bombarded with electrons 111.

The thickness of the bar D (along the surface normal of the target) is selected to be between one third and two thirds of the electron penetration depth of the x-ray generating material at the incident electron energy for optimal thermal performance. It may also be selected to obtain a desired x-ray source size in the vertical direction. The width of the bar W is selected to obtain a desired source size in the corresponding direction. As illustrated, W≈1.5D, but could be substantially smaller or larger, depending on the size of the source spot desired.

The length of the bar L as illustrated is L≈4D, but may be any dimension, and may typically be determined to be between ¼ to 3 times the x-ray attenuation length for the selected x-ray generating material. The distance between the edge of the shelf and the edge of the x-ray generating material p as illustrated is p≈W, but may be selected to be any value, from flush with the edge 2003 (p=0) to as much as 1 mm, depending on the x-ray reabsorption properties of the substrate material, the relative thermal properties, and the amount of heat expected to be generated when bombarded with electrons.

Figure 15:
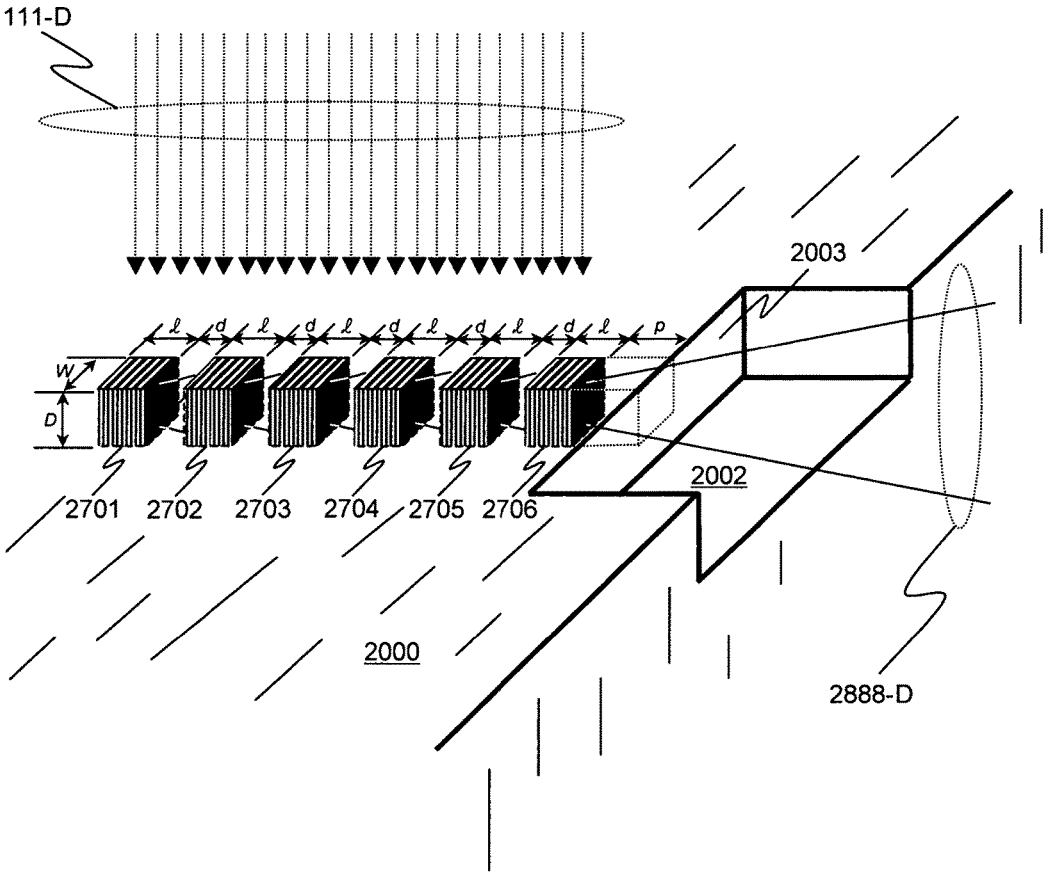
FIG. 15 illustrates a perspective view of a target comprising a multiple rectangular microstructure arranged in a line on a substrate with a recessed region that may be used in some embodiments of the invention.

An illustration of a portion of an alternative target as may be used in some embodiments of the invention is presented in FIG. 15. In this target, an x-ray generating region with six microstructures 2701, 2702, 2703, 2704, 2705, 2706 is configured at or near a recessed edge 2003 of the target substrate 2000 on a shelf 2002, similar to the situation illustrated in FIG. 11 and FIG. 14. As shown, the x-ray generating microstructures 2701, 2702, 2703, 2704, 2705, 2706 are arranged in a linear array of x-ray generating right rectangular prisms embedded in the substrate 2000, and produce x-rays 2888-D when bombarded with electrons 111.

In this target as may be used in some embodiments of the invention, the total volume of x-ray generating material is the same as in the previous illustration of FIG. 14. The thickness D of the microstructures 2701-2706 (along the surface normal of the target) is selected to be between one third and two thirds of the electron penetration depth of the x-ray generating material at the incident electron energy for optimal thermal performance, as in the case shown in FIG. 14. The width W of the microstructures 2701-2706 is selected to obtain a desired source size in the corresponding direction and as illustrated, W≈1.5 D, as in the case shown in FIG. 14. As discussed previously, it could also be substantially smaller or larger, depending on the size of the source spot desired.

However, as shown, the single bar 2700 of length L as illustrated in FIG. 14 has been replaced with microstructures 2701, 2702, 2703, 2704, 2705, 2706 in the form of 6 sub-bars, each of length l=L/6. Although the volume of x-ray generation (when bombarded with the same electron density) will be the same, each sub-bar now has five faces transferring heat into the substrate, increasing the heat transfer away from the x-ray generating sub-bars 2701-2706 and into the substrate. As illustrated, the separation between the sub-bars is a distance d≈l, although larger or smaller dimensions may also be used, depending on the amount of x-rays absorbed by the substrate and the relative thermal gradients that may be achieved between the specific materials of the x-ray generating microstructures 2701-2706 and the substrate 2000.

Likewise, the distance between the edge of the shelf and the edge of the x-ray generating material p as illustrated is p≈W, but may be selected to be any value, from flush with the edge 2003 (p=0) to as much as 1 mm, depending on the x-ray reabsorption properties of the substrate material, the relative thermal properties, and the amount of heat expected to be generated when bombarded with electrons.

For a configuration such as shown in FIG. 15, the total length of the x-ray generating sub-bars will commonly be about twice the linear attenuation length for x-rays in the x-ray generating material, but can be selected from half to more than 3 times that distance. Likewise, the thickness D of the sub-bars (along the surface normal of the target) was selected to be equal to one-third to two-thirds of the electron penetration depth of the x-ray generating material at the incident electron energy for optimal thermal performance, but it can be substantially larger. It may also be selected to obtain a desired x-ray source size in that direction which is approximately equal.

The bars may be embedded in the substrate (as shown), but if the thermal load generated in the x-ray generating material is not too large, they may also be placed on top of the substrate.

Figure 16A:
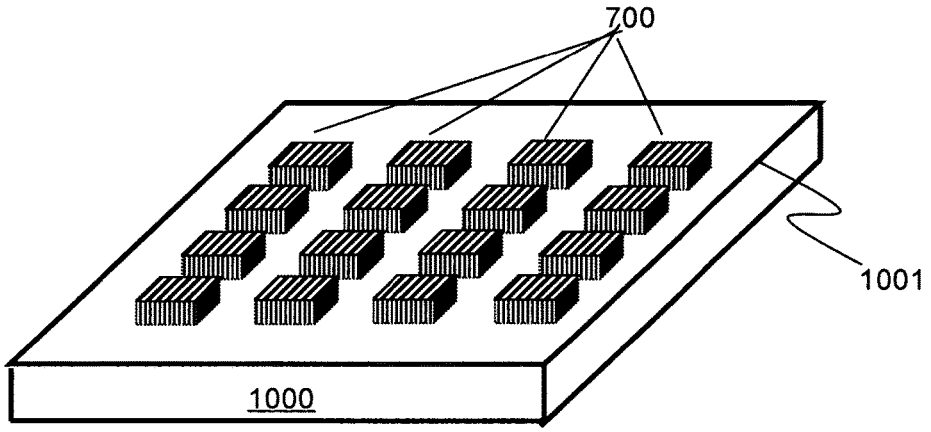
FIG. 16A illustrates a perspective view of a target comprising a grid of embedded rectangular target microstructures that may be used in some embodiments of the invention.
Figure 16B:
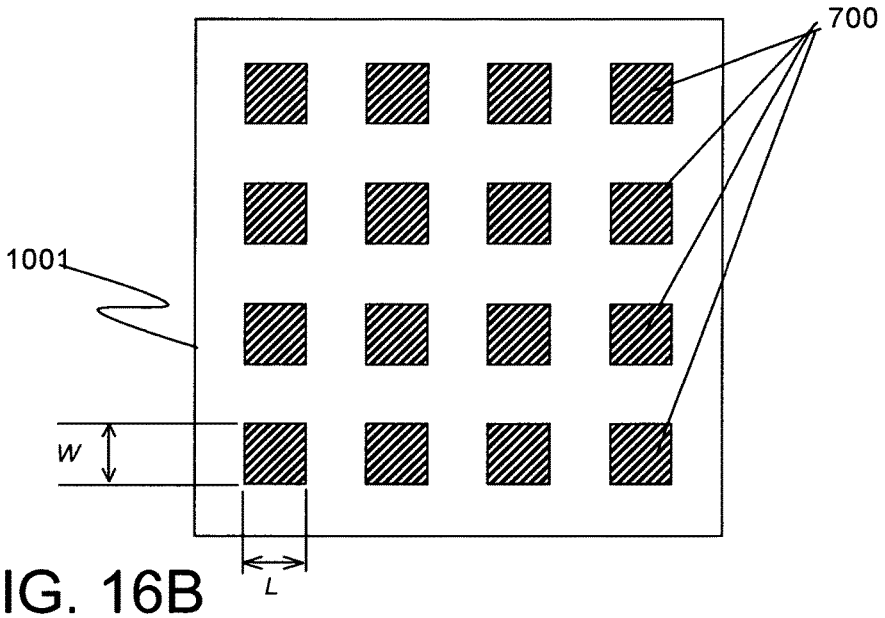
FIG. 16B illustrates a top view of the target of FIG. 16A.
Figure 16C:
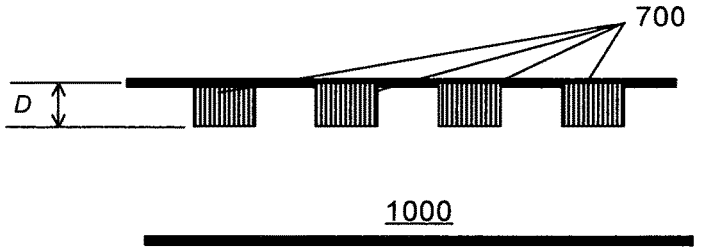
FIG. 16C illustrates a side/cross-section view of the target of FIGS. 16A and 16B.

FIGS. 16A-C illustrates a region 1001 of a target as may be used in some embodiments of the invention that comprises an array of microstructures 700 in the form of right rectangular prisms comprising x-ray generating material arranged in a regular array. FIG. 16A presents a perspective view of the sixteen microstructures 700 for this target, while FIG. 16B illustrates a top down view of the same region, and FIG. 16C presents a side/cross-section view of the same region. (For the term "side/cross-section view" in this disclosure, the view meant is one as if a cross-section of the object had been made, and then viewed from the side towards the cross-sectioned surface. This shows both detail at the point of the cross-section as well as material deeper inside that might be seen from the side, assuming the substrate itself were transparent [which, in the case of diamond, is generally true for visible light].)

In the targets of FIGS. 16A-C, the microstructures have been fabricated such that they are in close thermal contact on five of six sides with the substrate. As illustrated, the top of the microstructures 700 are flush with the surface of the substrate, but other targets in which the microstructures are recessed may be fabricated, and still other targets in which the microstructures present a topographical "bump" relative to the surface of the substrate may also be fabricated.

An alternative target as may be used in some embodiments of the invention may have several microstructures of right rectangular prisms simply deposited upon the surface of the substrate. In this case, only the bottom base of the prism would be in thermal contact with the substrate. For a structure comprising the microstructures embedded in the substrate with a side/cross-section view as shown in FIG. 16C with depth D and lateral dimensions in the plane of the substrate of W and L, the ratio of the total surface area in contact with the substrate for the embedded microstructures vs. deposited microstructures is $$\frac{A_{Embedded}}{A_{Deposited}} = 1 + 2D\frac{(W+L)}{(W \times L)} \quad \text{[Eqn. 2]}$$

With a small value for D relative to W and L, the ratio is essentially 1. For larger thicknesses, the ratio becomes larger, and for a cube (D=W=L) in which 5 equal sides are in thermal contact, the ratio is 5. If a cap layer of a material with similar properties as the substrate in terms of mass density and thermal conductivity is used, the ratio may be increased to 6.

Figure 17:
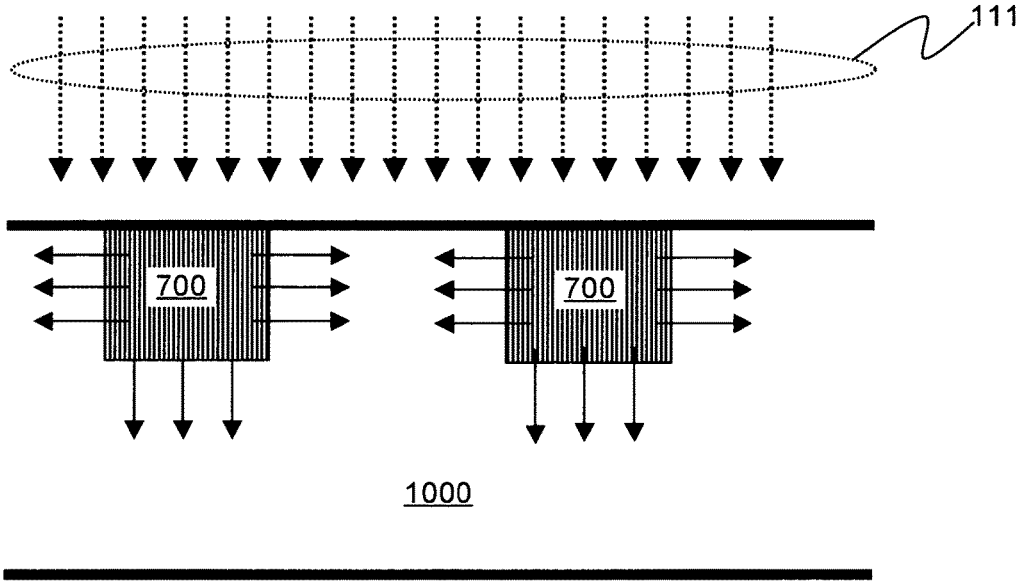
FIG. 17 illustrates a cross-section view of the target of FIG. 16, showing thermal transfer to a thermally conducting substrate under electron beam exposure.

The heat transfer is illustrated with representative arrows in FIG. 17, in which the heat generated in microstructures 700 embedded in a substrate 1000 is conducted out of the microstructures 700 through the bottom and sides (arrows for transfer through the sides out of the plane of the drawing are not shown). The amount of heat transferred per unit time (ΔQ) conducted through a material of area A and thickness d given by:

$$\Delta Q = \frac{\kappa \cdot A \cdot \Delta T}{d} \quad \text{[Eqn. 3]}$$

where κ is the thermal conductivity in W/(m ° C.) and ΔT is the temperature difference across thickness d in ° C. Therefore, an increase in surface area A, a decrease in thickness d and an increase in ΔT all lead to a proportional increase in heat transfer.

Figure 18A:
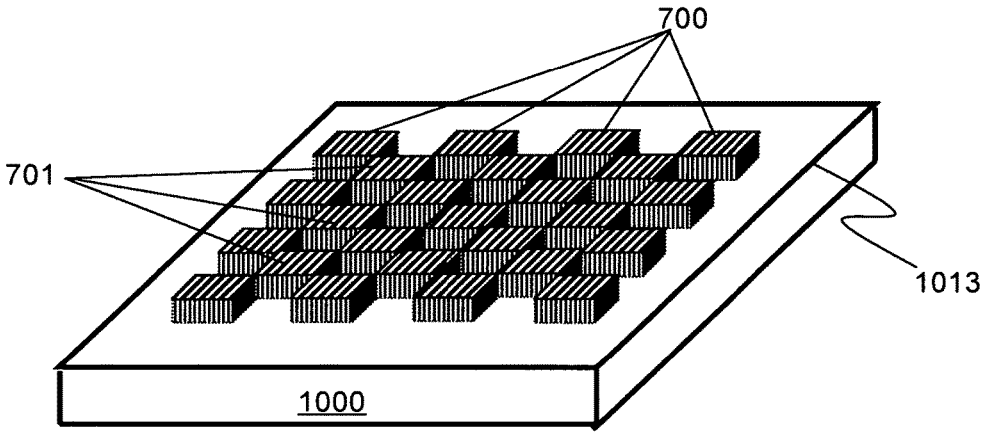
FIG. 18A illustrates a perspective view of a target comprising a checkerboard configuration of embedded target microstructures that may be used in some embodiments of the invention.
Figure 18B:
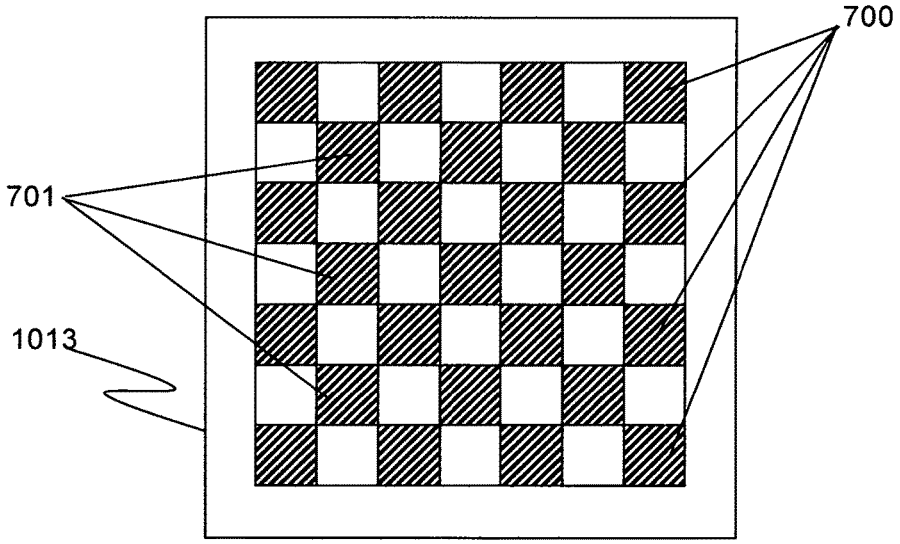
FIG. 18B illustrates a top view of the target of FIG. 18A.
Figure 18C:
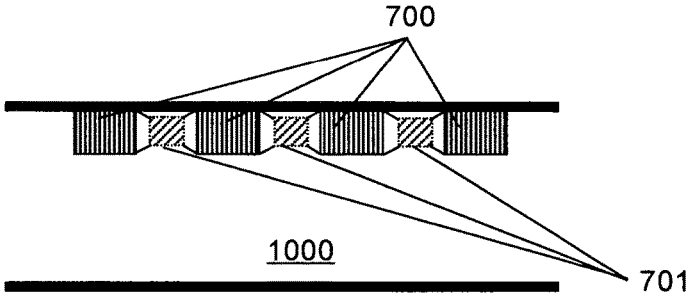
FIG. 18C illustrates a side/cross-section view of the target of FIGS. 18A and 18B.

FIGS. 18A-C illustrate a region 1013 of a target according to an embodiment of invention that comprises a checkerboard array of microstructures 700 and 701 in the form of right rectangular prisms comprising x-ray generating material. The array as shown is arranged as an embedded array in the surface of the substrate 1000. FIG. 18A presents a perspective view of the twenty-five embedded microstructures 700 and 701, while FIG. 18B illustrates a top down view of the same region, and FIG. 18C presents a side/cross-section view of the same region with recessed regions shown with dotted lines.

Figure 19A:
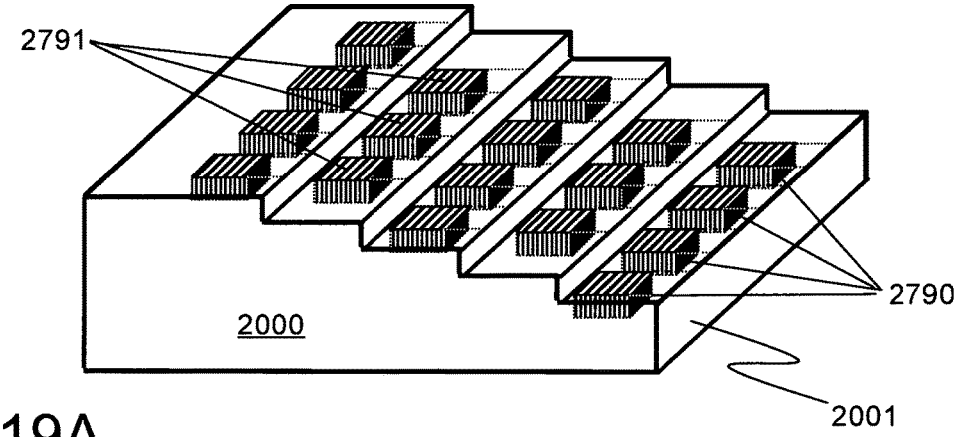
FIG. 19A illustrates a perspective view of a target comprising a grid of embedded rectangular target microstructures arranged on a tiered substrate that may be used in some embodiments of the invention.
Figure 19B:
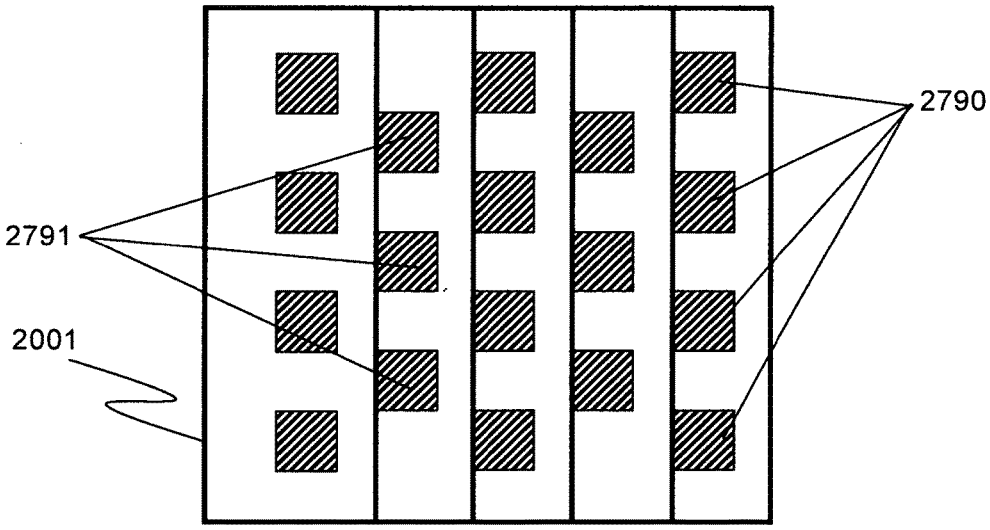
FIG. 19B illustrates a top view of the target of FIG. 19A.
Figure 19C:
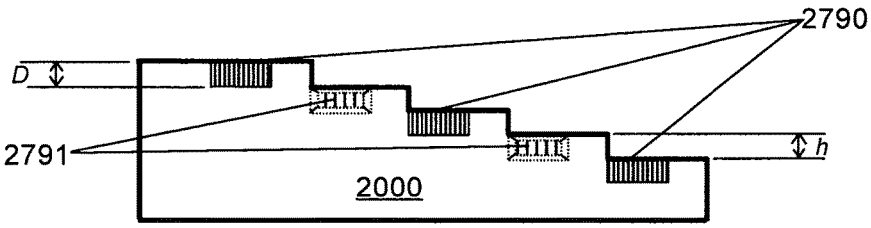
FIG. 19C illustrates a side/cross-section view of the target of FIGS. 19A and 19B.

An illustration of a region 2001 of another target as may be used in some embodiments of the invention is presented in FIGS. 19A-C, which shows a region 2001 of a target according to an embodiment of invention with an array of microstructures 2790 and 2791 comprising x-ray generating material having a thickness D. The array as shown is a modified checkerboard pattern of right rectangular prisms, but other configurations and arrays of microstructures may be used as well.

As in the targets used in other embodiments, these microstructures 2790 and 2791 are embedded in the surface of the substrate. However, the surface of the substrate comprises a predetermined non-planar topography, and in this particular case, a plurality of steps along the surface normal of the substrate 2000. As illustrated, the height of each step is h≈D, but the step height may be selected to be between 1× and 3× the thickness of the microstructures. The total height of all the steps may be selected to be equal or less than the desired x-ray source size along the vertical (thickness) direction.

The total width of the microstructured region may be equal to the desired x-ray source size in the corresponding direction. The overall appearance resembles a staircase of x-ray sources. FIG. 19A presents a perspective view of the eighteen embedded microstructures 2790 and 2791, while FIG. 19B illustrates a top down view of the same region, and FIG. 19C presents a side/cross-section view of the same region. An electrically conductive layer may be coated on the top of the staircase structures when the substrate is beryllium, diamond, sapphire, silicon, or silicon carbide.

Figure 20:
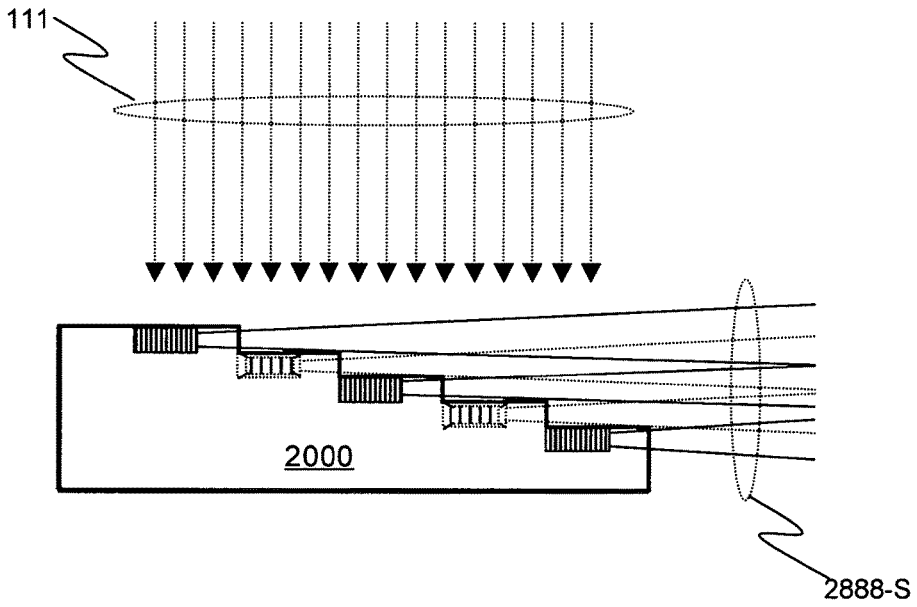
FIG. 20 illustrates a side/cross-section view of the target of FIG. 19C radiating x-rays under electron bombardment.

FIG. 20 illustrates the x-ray radiation 2888-S from the staircase target of FIG. 19C when bombarded by electrons 111. As in the targets used in other embodiments, the prisms of x-ray generating material heat up when electrons collide with them, and because each of the prisms of x-ray generating material has five sides in thermal contact with the substrate 2000, conduction of heat away from the x-ray generating material is still larger than a configuration in which the x-ray generating material is deposited on the surface. However, to one side, the radiation of x-rays is unattenuated by absorption from other neighboring prisms and negligibly attenuated by neighboring substrate material.

The brightness of x-rays from each prism will therefore be increased, especially when compared to the x-ray radiation from the target of FIGS. 18A-C, which also illustrates a number of prisms 700 and 701 of x-ray generating material arranged in a checkerboard pattern. In the configuration of FIGS. 18A-C, each prism is embedded in the substrate, therefore having five surfaces in thermal contact with the substrate 1000, but the radiation to the side at 0° will be attenuated by both the prisms of the neighboring columns and the substrate material.

Such an embodiment comprising a target with topography may be manufactured by first preparing a substrate with topography, and then embedding the prisms of x-ray generating material following the fabrication processes for the previously described planar substrates. Alternatively, the initial steps that create cavities to be filled with x-ray generating material may be enhanced to create the staircase topography structure in an initially flat substrate. In either case, additional alignment steps, such as those known to those skilled in the art of planar processing, may be employed if overlay of the embedded prisms with a particular feature of topography is desired.

Microstructures may be embedded with some distance to the edges of the staircase, as illustrated in FIGS. 19A-C and 20, or flush with as edge (as was shown in FIG. 10). A determination of which configuration is appropriate for a specific application may depend on the exact properties of the x-ray generation material and substrate material, so that, for example, the additional brightness achieved with increased electron current enabled by the thermal transfer through five vs. four surfaces may be compared with the additional brightness achieved with free space radiation vs. reabsorption through a section of substrate material. The additional costs associated with the alignment and overlay steps, as well as the multiple processing steps that may be needed to pattern multiple prisms on multiple layers, may need to be considered in comparison to the increased brightness achievable.

Other target configurations that may be used in embodiments of the invention, as has been described in the above cited U.S. patent application Ser. No. 14/465,816, are microstructures comprising multiple x-ray generating materials, microstructures comprising alloys of x-ray generating materials, microstructures deposited with an anti-diffusion layer or an adhesion layer, microstructures with a thermally conducting overcoat, microstructures with a thermally conducting and electrically conducting overcoat, microstructured buried within a substrate and the like.

Other target configurations that may be used in embodiments of the invention, as has been described in the above cited U.S. patent application Ser. No. 14/465,816, are arrays of microstructures that may comprise any number of conventional x-ray target materials (such as copper (Cu), molybdenum (Mo) and tungsten (W)) that are patterned as features of micron scale dimensions on (or embedded in) a thermally conducting substrate, such as diamond or sapphire. In some embodiments, the microstructures may alternatively comprise unconventional x-ray target materials, such as tin (Sn), sulfur (S), titanium (Ti), antimony (Sb), etc. that have thus far been limited in their use due to poor thermal properties.

Other target configurations that may be used in embodiments of the invention, as has been described in the above cited U.S. patent application Ser. No. 14/465,816, are arrays of microstructures that take any number of geometric shapes, such as cubes, rectangular blocks, regular prisms, right rectangular prisms, trapezoidal prisms, spheres, ovoids, barrel shaped objects, cylinders, triangular prisms, pyramids, tetrahedra, or other particularly designed shapes, including those with surface textures or structures that enhance surface area, to best generate x-rays of high brightness and that also efficiently disperse heat.

Other target configurations that may be used in embodiments of the invention, as has been described in the above cited U.S. patent application Ser. No. 14/465,816, are arrays of microstructures comprising various materials as the x-ray generating materials, including aluminum, titanium, vanadium, chromium, manganese, iron, cobalt, nickel, copper, gallium, zinc, yttrium, zirconium, molybdenum, niobium, ruthenium, rhenium, rhodium, palladium, silver, tin, iridium, tantalum, tungsten, indium, cesium, barium, gold, platinum, lead and combinations and alloys thereof.

The embodiments described so far include a variety of x-ray target configurations that comprise a plurality of microstructures comprising x-ray generating material that can be used as targets in x-ray sources to generate x-rays with increased brightness. These target configurations have been described as being bombarded with electrons and generating x-rays, but may be used as the static x-ray target in an otherwise conventional source, replacing either the target 01 from the transmission x-ray source 08 of FIG. 1, or the target 100 from the reflective x-ray source 80 of FIG. 2 with a microstructured target to form an x-ray source in accord with some embodiments of the invention.

It is also possible that the targets described above may be embodied in a moving x-ray target, replacing, for example, the target 500 from the rotating anode x-ray source 80 of FIGS. 6A and 6B with a microstructured target as described above to create a source with a moving microstructured target in accord with other embodiments of the invention.

2. Generic Considerations for a Linear Accumulation X-Ray Source

Figure 21:
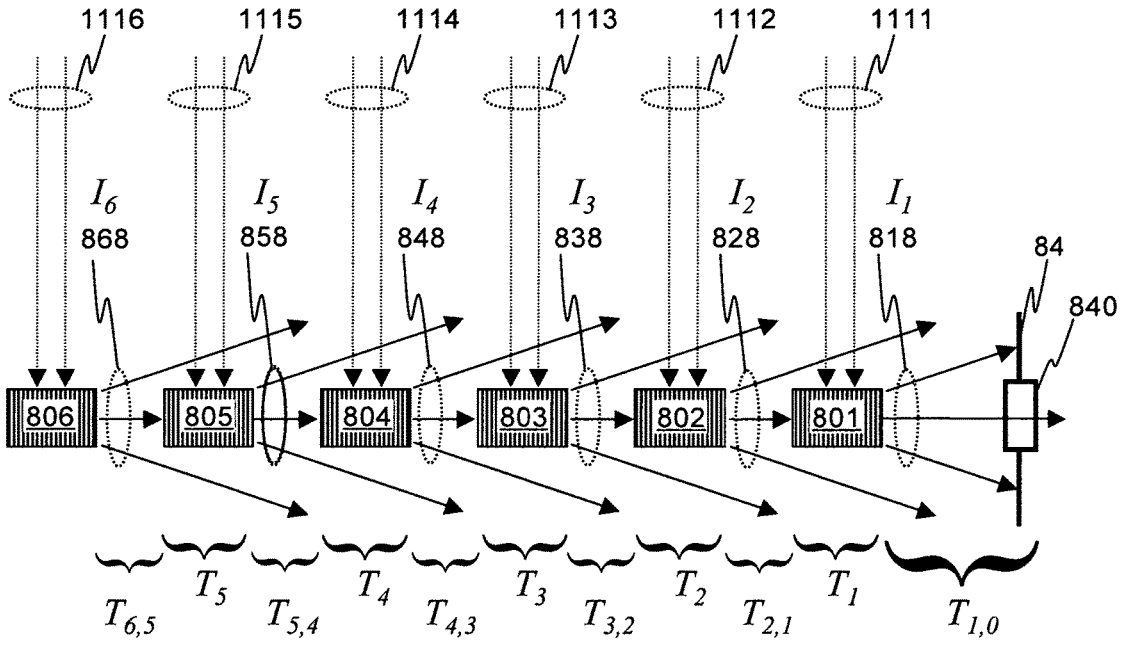
FIG. 21 illustrates a collection of x-ray sub-sources arranged in a linear array as may be used in some embodiments of the invention.

FIG. 21 illustrates a collection of x-ray sub-sources arranged in a linear array. The long axis of the linear array runs from left to right in the figure, while the short axis would run in and out of the plane of the figure. Several x-ray generating elements 801, 802, 803, 804 . . . etc. comprising one or more x-ray generating materials are bombarded by beams of electrons 1111, 1112, 1113, 1114, . . . etc. at high voltage (anywhere from 1 to 250 keV), and form sub-sources that produce x-rays 818, 828, 838, 848, . . . etc. Although the x-rays tend to be radiated isotropically, this analysis is for a view along the axis down the center of the linear array of sub-sources, where a screen 84 with an aperture 840 has been positioned.

It should be noted that, as drawn in FIG. 21, the aperture allows the accumulated zero-angle x-rays to emerge from the source, but in practice, an aperture which allows several degrees of x-rays radiated at ±3° or even at ±6° to the surface normal may be designed for use in some applications. It is generally preferred that the window be at normal or near normal incidence to the long axis of the linear array, but in some embodiments, a window tilted to an angle as large as 85° may be useful.

Assuming the ith sub-source 80*i* produces x-rays 8*i*8 along the axis to the right in FIG. 21, the radiation for the right-most sub-source as illustrated simply propagates to the right through free space. However, the x-rays from the other sub-sources are attenuated through absorption, scattering, or other loss mechanisms encountered while passing through whatever material lies between sub-sources, and also by divergence from the propagation axis and by losses encountered by passage through the neighboring sub-source(s) as well.

If we define:

$I_i$ as the x-ray radiation intensity 8*i*8 from the ith sub-source 80*i*;

$T_{1,0}$ as the x-ray transmission factor for propagation to the right of the 1$^{st}$ sub-source 801;

$T_{i,i-1}$ as the x-ray transmission factor for propagation from the ith sub-source 80*i* to the i−1-th sub-source 80(*i*−1); and $T_i$ as the x-ray transmission factor for propagation through the ith sub-source 80*i* (with $T_0 \equiv 1$), the total intensity of x-rays on-axis to the right of the array of N sub-sources can be expressed as:

$$I_{tot} = I_1 \times T_{1,0} + I_2 \times T_{2,1} \times T_1 \times T_{1,0} + I_3 \times T_{3,2} \times T_2 \times T_{2,1} \times T_1 \times T_{1,0} + I_4 \times T_{4,3} \times T_3 \times T_{3,2} \times T_2 \times T_{2,1} \times T_1 \times T_{1,0} + \ldots + I_N \times T_{N,N-1} \times T_{N-1,N-2} \times \ldots \times T_2 \times T_{2,1} \times T_1 \times T_{1,0} \quad \text{[Eqn. 4]}$$

making $$I_{tot} = \sum_{i=1}^{N} I_i \sum_{j=0}^{i-1} T_j \prod_{k=0}^{i-1} T_{k+1,k} \quad \text{[Eqn. 5]}$$

For a source design in which all sub-sources produce approximately the same intensity of x-rays $$I_i \approx I_0 \quad \text{[Eqn. 6]}$$

(which can be achieved if the x-ray generating elements of the array are similar sizes and shapes, and they are bombarded with electrons with similar energy and density), the total intensity becomes $$I_{tot} = I_0 \sum_{i=1}^{N} \sum_{j=0}^{i-1} T_j \prod_{k=0}^{i-1} T_{k+1,k} \quad \text{[Eqn. 7]}$$

Furthermore, if the sub-sources are arranged in a regular array with essentially the same value for transmission between elements:

$$T_{a,a-1} = T_{2,1}, a>1, \quad \text{[Eqn. 8]}$$

and if the sizes and shapes of the x-ray generating elements are similar enough such that the transmission through any given element will also be the same:

$$T_a = T_1, a>0, \quad \text{[Eqn. 9]}$$

then the total intensity becomes $$I_{tot} = I_0 T_0 T_{1,0} \left(1 + \sum_{i=2}^{N} T_1^{(i-1)} T_{2,1}^{(i-1)}\right) \quad \text{[Eqn. 10]}$$

$$I_{tot} = I_0 T_{1,0} \left(1 + \sum_{n=1}^{N-1} (T_1 T_{2,1})^n\right) \quad \text{[Eqn. 11]}$$

$$I_{tot} = I_0 T_{1,0} \left(\sum_{n=0}^{N-1} (T_1 T_{2,1})^n\right) \quad \text{[Eqn. 12]}$$

Note that $T_i$ and $T_{i,i-1}$ represent a reduction in transmission due to losses, and therefore always have values between 0 and 1. If N is large, the sum on the right can be approximated by the geometric series $$\frac{1}{(1-x)} = \sum_{0}^{\infty} x^n \text{ for } |x| < 1 \quad \text{[Eqn. 13]}$$

making the approximate intensity $$I_{tot} \approx I_0 T_{1,0} \frac{1}{(1 - T_1 T_{2,1})} \quad \text{[Eqn. 14]}$$

This suggests making the product of the transmission factors $T_1$ and $T_{2,1}$ as close to 1 as possible will increase $I_{tot}$.

Note that this can also be used to estimate how many generating elements can be arranged in a row before losses and attenuation would make the addition of another x-ray generating element unproductive. For example, if the width of a generating element is the 1/e attenuation length for x-rays, transmission through the element gives $T_1$=1/e=0.3679. Assuming a transmission between elements of $T_{i,i-1}=T_{2,1}$=0.98, this makes $$I_{tot} \approx I_0 T_{1,0} \frac{1}{(1 - (0.3679)(0.98))} = I_0 T_{1,0}(1.564) \quad \text{[Eqn. 15]}$$

This suggests that a large number of elements with a width equal to the 1/e length could only improve the intensity by a factor of 1.564, implying that a large number is not more productive on-axis than 2 elements would be.

For a narrower element, with an x-ray attenuation of, for example, $T_1$=0.80, $$I_{tot} \approx I_0 T_{1,0} \frac{1}{(1 - (0.80)(0.98))} = I_0 T_{1,0}(4.360) \quad \text{[Eqn. 16]}$$

implying that up to approximately 5 of these elements may be arranged in a row to produce a source as bright as a source with a large number of x-ray generating elements.

It should be noted that the x-ray attenuation may be different for x-rays of different energies, and that the product of $T_1$ and $T_{2,1}$ may vary considerably for a given material over a range of wavelengths.

Figure 22:
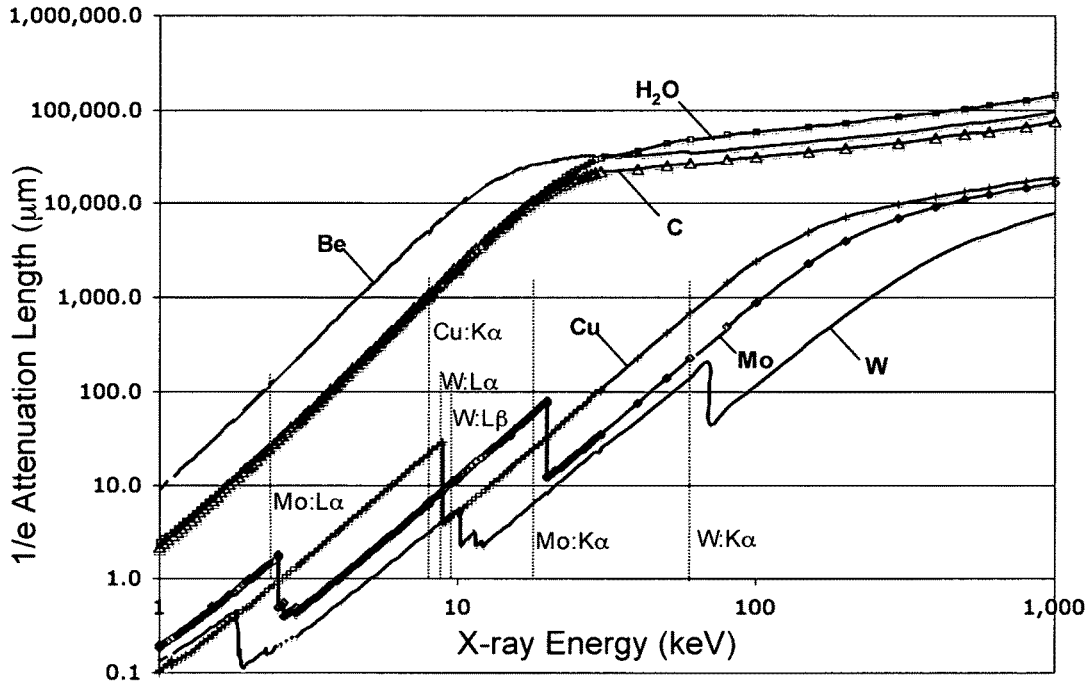
FIG. 22 illustrates the 1/e attenuation length for several materials for x-rays having energies ranging from 1 keV to 400 keV.

FIG. 22 illustrates the 1/e attenuation length for x-rays having energies ranging from 1 keV to 1000 keV for three x-ray generating materials: molybdenum (Mo), copper (Cu), tungsten (W); and from 10 keV to 1000 keV for three substrate materials: graphite (C), beryllium (Be) and water ($H_2O$). [The data presented here were originally published by B. L. Henke, E. M. Gullikson, and J. C. Davis, in "X-ray interactions: photoabsorption, scattering, transmission, and reflection at E=50-30000 eV, Z=1-92", Atomic Data and Nuclear Data Tables vol. 54 (no. 2), pp. 181-342 (July 1993), and may be also accessed at: henke.lbl.gov/optical_constants/atten2.html.

Other x-ray absorption tables are available at physics.nist.gov/PhysRefData/XrayMassCoef/chap2.html.]

The 1/e attenuation length $L_{1/e}$ for a material is related to the transmission factors above for a length L by $$T_i = e^{-\alpha_i L} = e^{-L/L_{1/e}} \quad \text{[Eqn. 17]}$$

Therefore, a larger $L_{1/e}$ means a larger $T_i$.

As an example of using the values in FIG. 22, for 60 keV x-rays in tungsten, $L_{1/e} \approx 200$ μm, making the transmission of a 20 μm wide x-ray generating element $$T_i = e^{-L/L_{1/e}} = e^{-20/200} = 0.905 \quad \text{[Eqn. 18]}$$

For 60 keV x-rays in a beryllium substrate, $L_{1/e} \approx 50{,}000$ μm, which makes the transmission of a 100 μm wide beryllium gap between embedded tungsten x-ray generating elements to be:

$$T_{i,i-1} = e^{-L/L_{1/e}} = e^{-100/50{,}000} = 0.998 \quad \text{[Eqn. 19]}$$

Therefore, for a periodic array of tungsten elements 20 μm wide embedded in a Beryllium substrate and spaced 100 μm apart, the best-case estimate for the on-axis intensity is:

$$I_{tot} \approx I_0 T_{1,0} \frac{1}{(1 - (0.905)(0.998))} = I_0 T_{1,0}(10.312) \quad \text{[Eqn. 20]}$$

which would represent an increase in x-ray intensity by an order of magnitude when compared to a single tungsten x-ray generating element.

3. X-Ray Source Controls

There are several variables through which such a generic linear accumulation source may be "tuned" or adjusted to improve the x-ray output. Embodiments of the invention may allow the control and adjustment of some, all, or none of these variables.

3.1. E-Beam Variations.

First, in some embodiments, the beam or beams of electrons 111 or 1111, 1112, 1113, etc. bombarding the x-ray generating elements 801, 802, 803 . . . etc. may be shaped and directed using one or more electron control mechanisms 70 such as electron optics, electrostatic lenses or magnetic focusing elements. Typically, electrostatic lenses are placed within the vacuum environment of the x-ray source, while the magnetic focusing elements can be placed outside the vacuum. Various other electron imaging techniques, such as the reflective electron beam control system disclosed in the prior art REBL (Reflective Electron Beam Lithography system) as described in U.S. Pat. No. 6,870,172 "Maskless reflection electron beam projection lithography" may also be used to create a complex pattern of electron exposure.

Figure 23A:
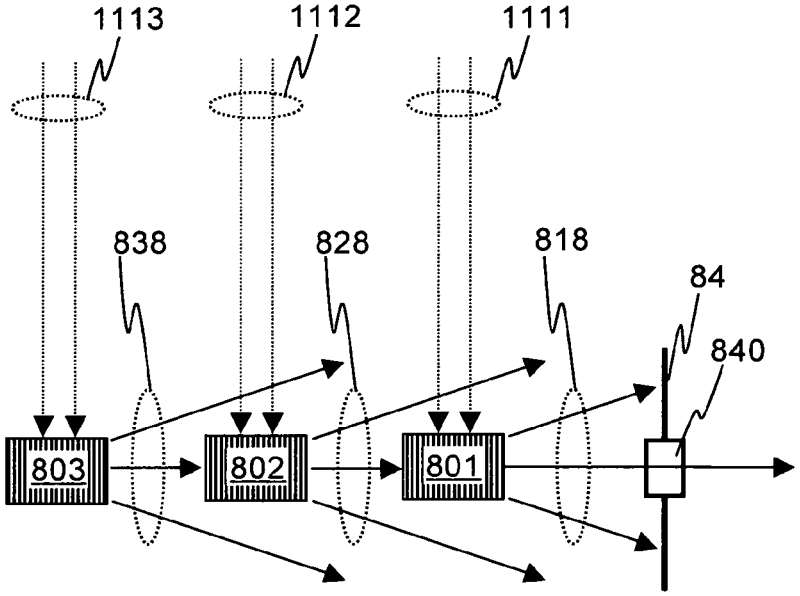
FIG. 23A illustrates a linear array of x-ray sub-sources being exposed to normal incidence electron beams as may be used in some embodiments of the invention.
Figure 23B:
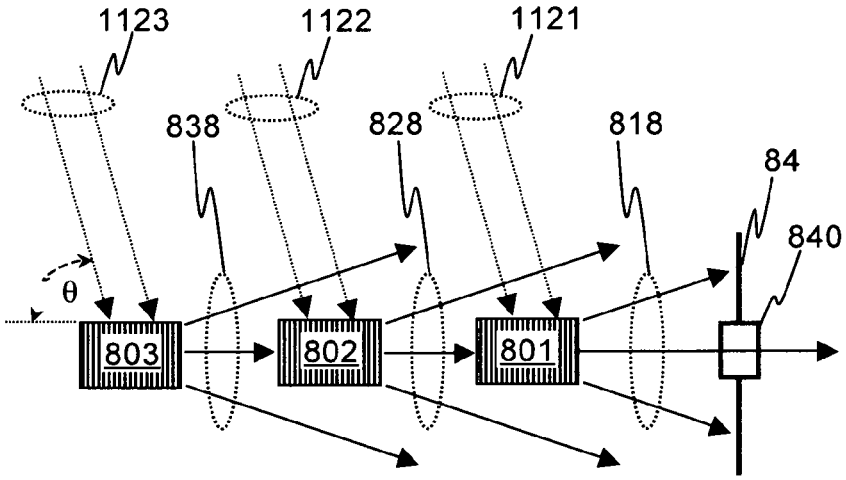
FIG. 23B illustrates a linear array of x-ray sub-sources being exposed to electron beams incident at an angle θ as may be used in some embodiments of the invention.
Figure 23C:
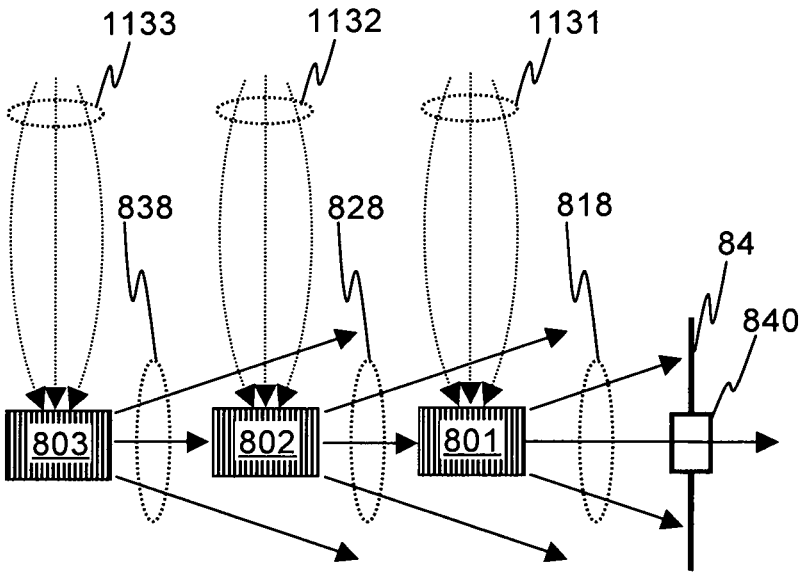
FIG. 23C illustrates a linear array of x-ray sub-sources being exposed to a focused electron beam as may be used in some embodiments of the invention.
Figure 23D:
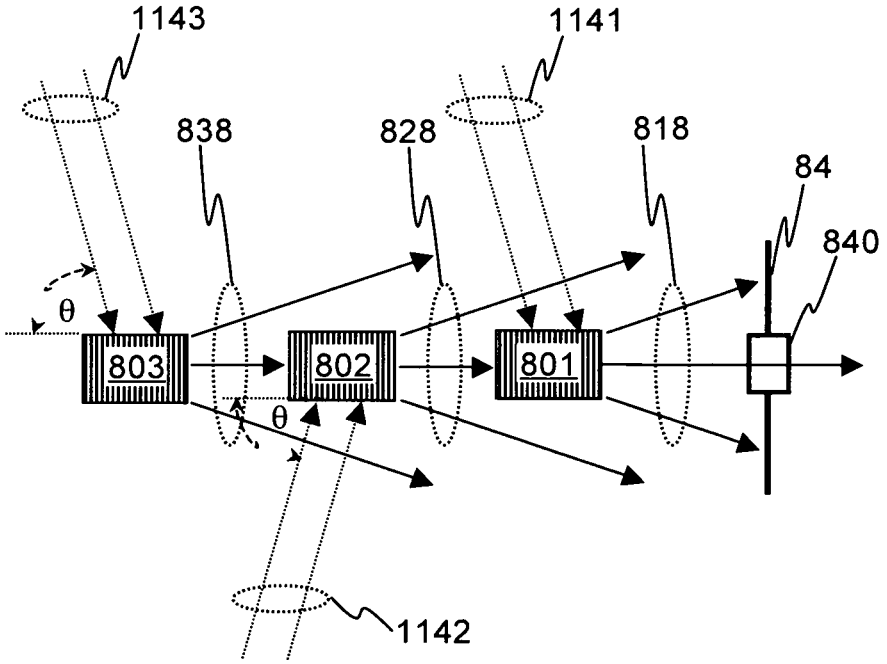
FIG. 23D illustrates a linear array of x-ray sub-sources being exposed to electron beams incident at an angle θ from multiple directions as may be used in some embodiments of the invention.
Figure 23E:
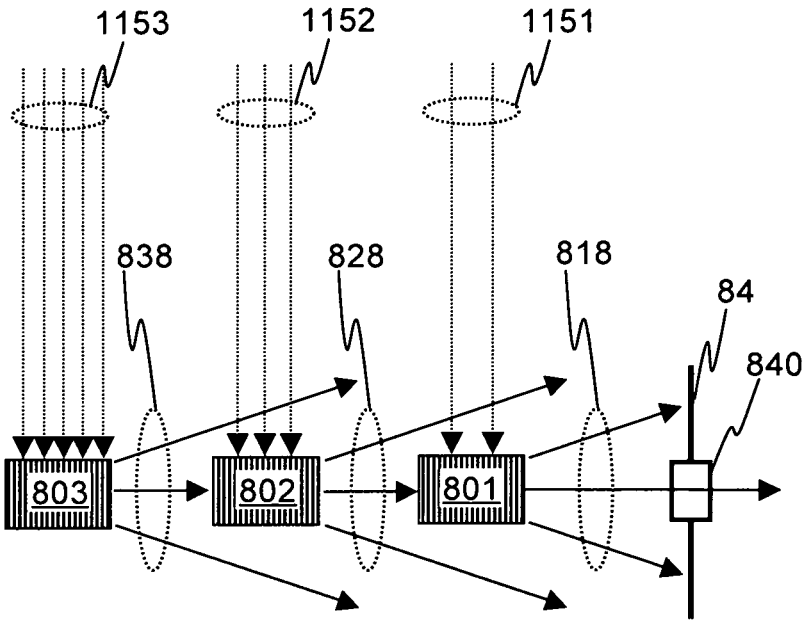
FIG. 23E illustrates a linear array of x-ray sub-sources being exposed electron beams of various electron densities as may be used in some embodiments of the invention.
Figure 23F:
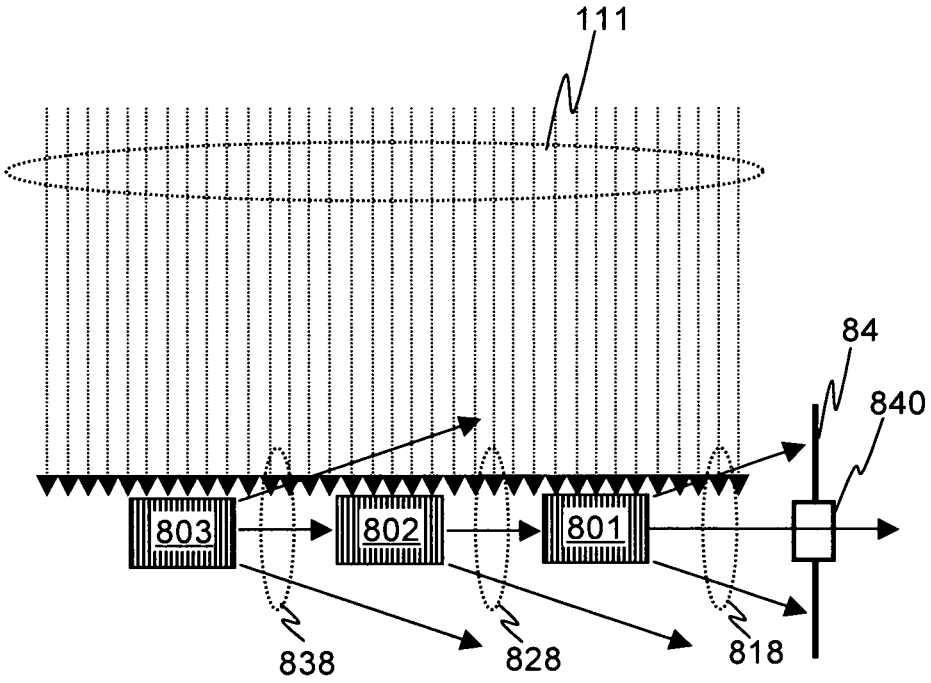
FIG. 23F illustrates a linear array of x-ray sub-sources being exposed to a uniform electron beam as may be used in some embodiments of the invention.

Electrons may bombard the microstructure elements 801, 802, 803 etc. at normal incidence, as illustrated in FIG. 21 and again illustrated in FIG. 23A; with electron beams 1121, 1122, 1123 etc. at an angle θ, as illustrated in FIG. 23B; with electron beams 1131, 1132, 1133 etc. at multiple angles (such as a focused electron beam), as illustrated in FIG. 23C; with electron beams 1141, 1142, 1143 etc. from opposite sides and at an angle θ, as illustrated in FIG. 23D; with electron beams 1151, 1152, 1153 etc. each with varying intensity or electron density, as illustrated in FIG. 23E; with a uniform large area beam of electrons 111 as illustrated in FIG. 23F, or any combination of the many arrangements of electron beams that may be devised by those skilled in the art.

The actual design of the pattern for electron exposure may depend in part on the material properties of the x-ray generating material and/or the material filling the regions between the x-ray generating elements. If the x-ray generating material is highly absorbing, greater electron density may be used to bombard the regions that produce x-rays that have to travel the greatest distance through other x-ray generating elements, as illustrated in FIG. 23E. Likewise, if the electron penetration depth is large, the x-ray generating material may be bombarded with electrons at an angle, as illustrated in FIG. 23B. If the electron penetration depth is larger than desired, thinner regions of x-ray generating material may be used, creating a source with smaller vertical dimensions.

In many embodiments, the area of electron exposure can be adjusted so that the electron beam or beams primarily bombard the x-ray generating elements and do not bombard the regions in between the elements. In many embodiments, the space between x-ray generating elements can be filled not with vacuum but with a solid material that facilitates heat transfer away from the x-ray generating elements. Such source targets comprising arrays of multiple x-ray generating elements embedded or buried in a thermally conducting substrate such as diamond were disclosed in the co-pending U.S. patent application Ser. No. 14/465,816 as discussed above, which has been incorporated by reference in its entirety.

If the area between the x-ray generating elements comprises solid material and is also bombarded with electrons, it too will tend to heat up under electron exposure, which will reduce the thermal gradient with the x-ray generating elements and therefore reduce the heat flow out of the x-ray generating element. Because the limit on the amount of electron energy and density is often dictated in part by the amount of energy that can be absorbed by the x-ray generating material before thermal damage, such as melting, occurs, increasing the heat transfer away from the x-ray generating elements is generally preferred, and may be in part accomplished by reducing the electron exposure of non-x-ray-producing regions. It should be noted that the generated heat from electron exposure tends to increase with increasing atomic number Z, and so selecting a substrate comprising a low Z material, such as beryllium (Z=4) or diamond (Z=6), may be preferred.

Figure 24:
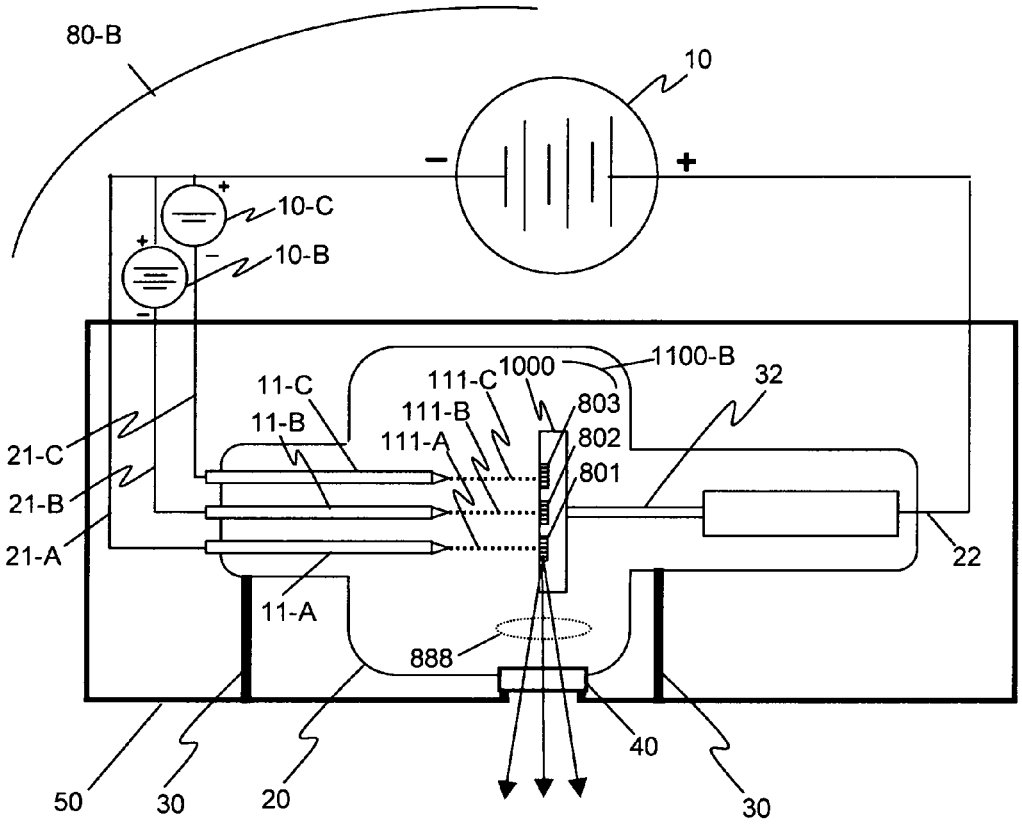
FIG. 24 illustrates a schematic cross-section view of an embodiment of an x-ray system according to the invention comprising multiple electron emitters.

A source having multiple electron beams that are used to bombard distinct x-ray generating elements independently may also be configured to allow a different accelerating voltage to be used with the different electron beam sources. Such a source 80-B is illustrated in FIG. 24. In this illustration, the previous high voltage source 10 is again connected through a lead 21-A to an electron emitter 11-A that emits electrons 111-A towards a target 1100-B. However, two additional "boosters" for voltage 10-B and 10-C are also provided, and these higher voltage potentials are connected through leads 21-B and 21-C to additional electron emitters 11-B and 11-C which respectively emit electrons 111-B and 111-C of different energies. Although the target 1100-B comprising the x-ray generating elements 801, 802, 803, . . . etc. will usually be uniformly set to the ground potential, the individual electron beam sources used to target the different x-ray generating elements may be set to different potentials, and electrons of varying energy may therefore be used to bombard the different x-ray generating elements 801, 802, 803, . . . etc.

This may offer advantages for x-ray radiation management, in that electrons of different energies may generate different x-ray radiation spectra, depending on the materials used in the individual x-ray generating elements. The heat load generated may also be managed through the use of different electron energies. The design of the electron optics for such a multiple beam configuration to keep the various multiple beams from interfering with each other and providing electrons of the wrong energy to the wrong target element may be complex.

3.2. Material Variations.

Although it is simpler to treat the x-ray generating elements as identical units, and to have the intervening regions also be considered identical, there may be advantages in some embodiments to having variations in these parameters.

In some embodiments, the different x-ray generating elements may comprise different x-ray generating materials, so that the on-axis view presents a diverse spectrum of characteristic x-rays from the different materials. Materials that are relatively transparent to x-rays may be used in the position closest to the output window 840 (e.g. the element 801 furthest to the right in FIG. 21), while those that are more strongly absorbing may be used for elements on the other side of the array, so that they attenuate the other x-ray sub-sources less.

In some embodiments, the distance between the x-ray generating elements may be varied, depending on the expected thermal load for different materials. For example, a larger space between elements may be used for elements that are expected to generate more heat under electron bombardment, while smaller gaps may be used if less heat is expected.

3.3. Variations in Size and Shape.

Figure 25:
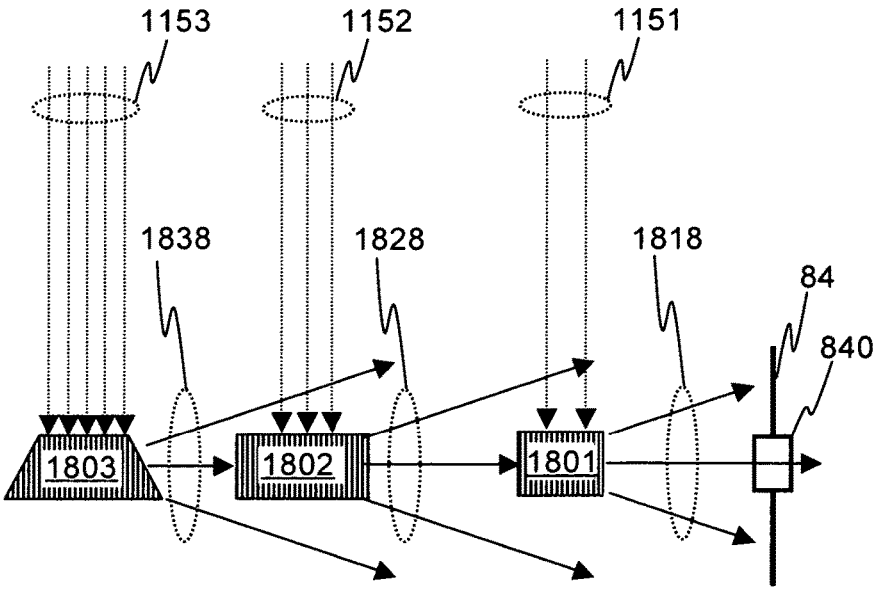
FIG. 25 illustrates a collection of non-uniform x-ray sub-sources being exposed to electron beams of different electron densities as may be used in some embodiments of the invention.

In some embodiments, as illustrated in FIG. 25, the x-ray generating elements 1801, 1802, 1803, . . . etc. may have varying sizes and geometric shapes. This may be especially useful for situations where different materials are used, and the electron deceleration processes and x-ray absorption are different for the different materials.

Figure 26A:
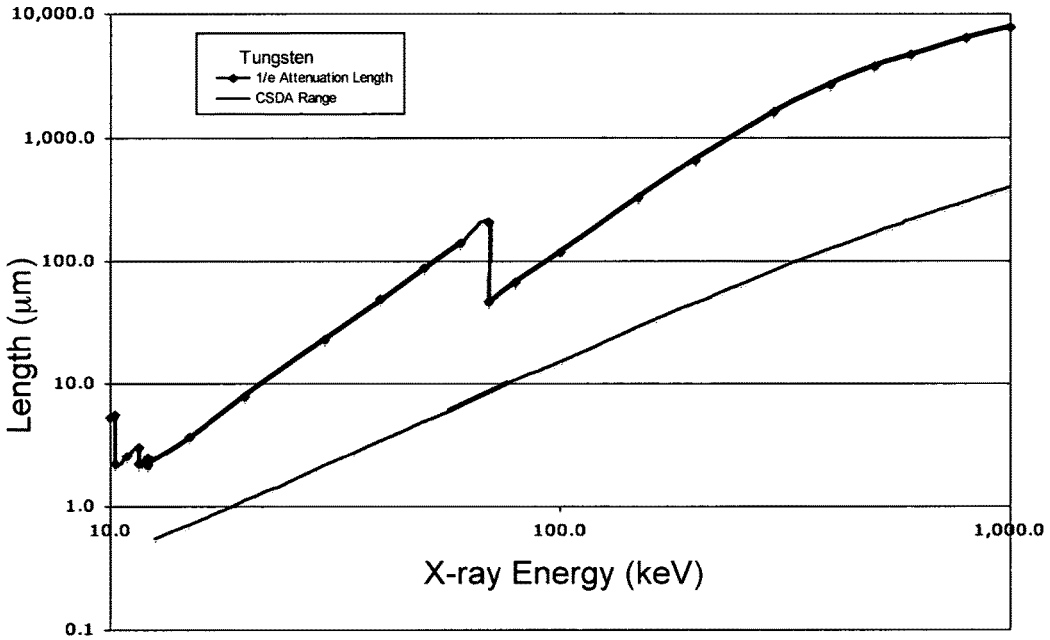
FIG. 26A illustrates a plot of the attenuation length and the CSDA (continuous slowing down approximation of electrons) for tungsten over a range of x-ray energies.
Figure 26B:
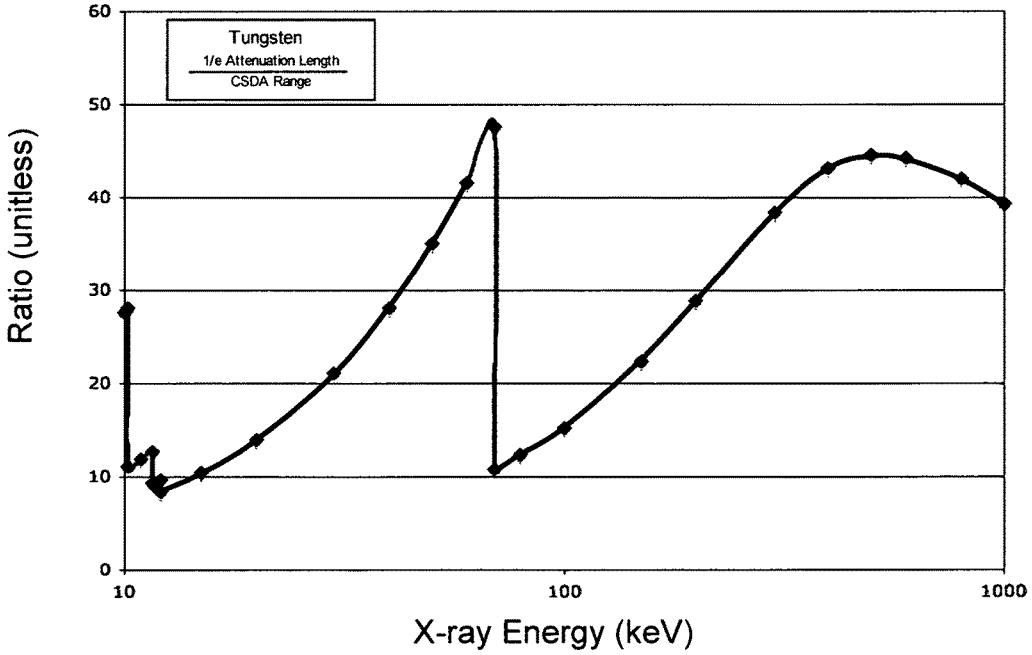
FIG. 26B illustrates a plot of the ratio of attenuation length and CSDA for tungsten over a range of x-ray energies.

A useful figure of merit that may be considered in the design of the x-ray generating elements for linear accumulation x-ray sources is the ratio of the 1/e attenuation length for the x-rays within the material to one half of the "continuous slowing down approximation" (CSDA) range for the electrons. The CSDA range for the electrons is typically larger than the penetration depth, since an electron can lose energy through several collisions as it slows down. FIG. 26A illustrates a plot of these two functions for tungsten, and FIG. 26B illustrates a plot of the ratio. The x-ray data is from the previously cited source by Henke et al., while the CSDA range data is from the Physical Measurement Laboratory of NIST, which may be found at: physics.nist.gov/PhysRefData/Star/Text/ESTAR.html. This ratio may be considered a figure-of-merit for the generation of x-rays for a material when used for the linear accumulation of x-rays, since its value is large when the x-ray transparency of the material is large (increasing $T_i$ for that microstructure) but its value is also large when the CDSA range is small, (which means the electrons are absorbed quickly, and the x-rays appear to be radiated from a spot of smaller depth).

Figure 27:
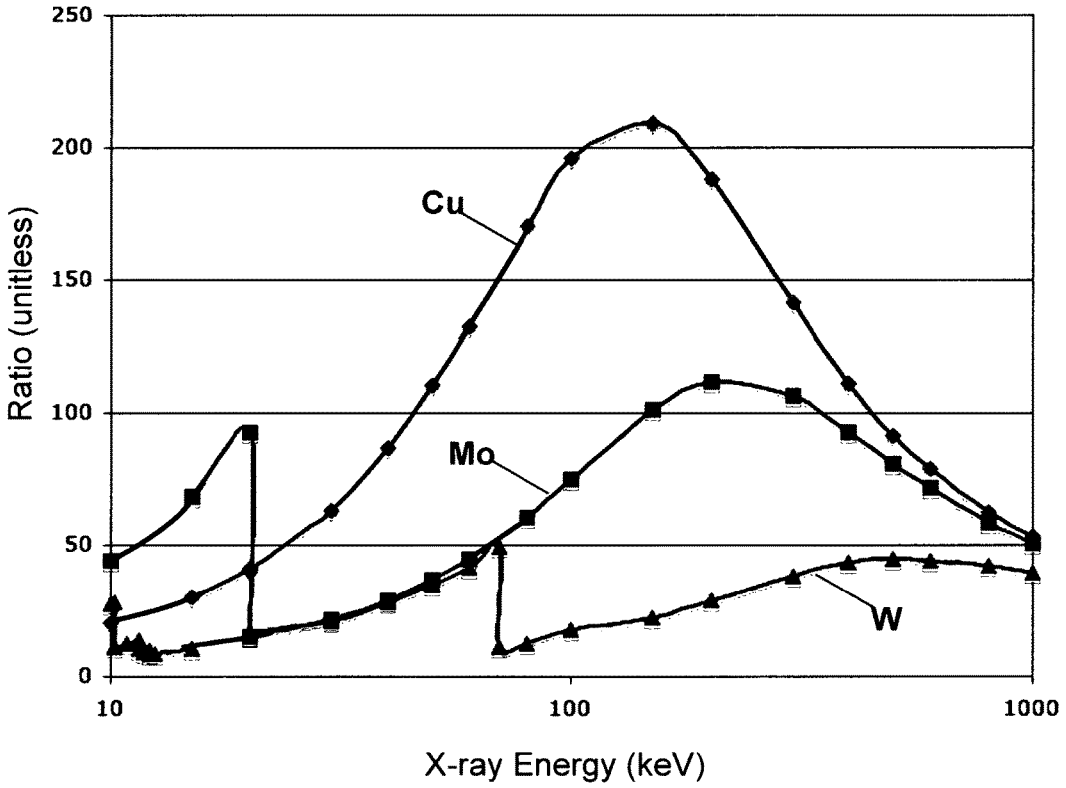
FIG. 27 illustrates a plot of the ratio of attenuation length and CSDA for several materials over a range of x-ray energies.

FIG. 27 shows a plot of this ratio for a large range of x-ray energies for three materials (Cu, Mo and W). Once an x-ray generating material has been selected for the characteristic lines desired, this ratio may be used to suggest a particular energy range (such as ~55 keV for tungsten) where the system may be configured to operate so that this figure-of-merit is relatively large.

As a rule of thumb, the thickness of the microstructures may be set to be ½ or less of CSDA as measured in the direction of e-beam propagation. For some selections of target materials, a thin foil coating of material may be sufficient to provide the x-ray radiation needed, and more complex embedded or buried microstructures may not be required.

3.4. Time-Multiplexed X-Ray Generation.

In other embodiments, the x-ray generating elements 801, 802, 803, 804, . . . etc. need not be continuously bombarded by electrons, but the electron beams 1211, 1212, 1213, 1214, . . . etc. may be switched on and off to distribute the heat load over time. This may be particularly effective when viewed on-axis, since all x-rays appear to be coming from the same origin.

Figure 28A:
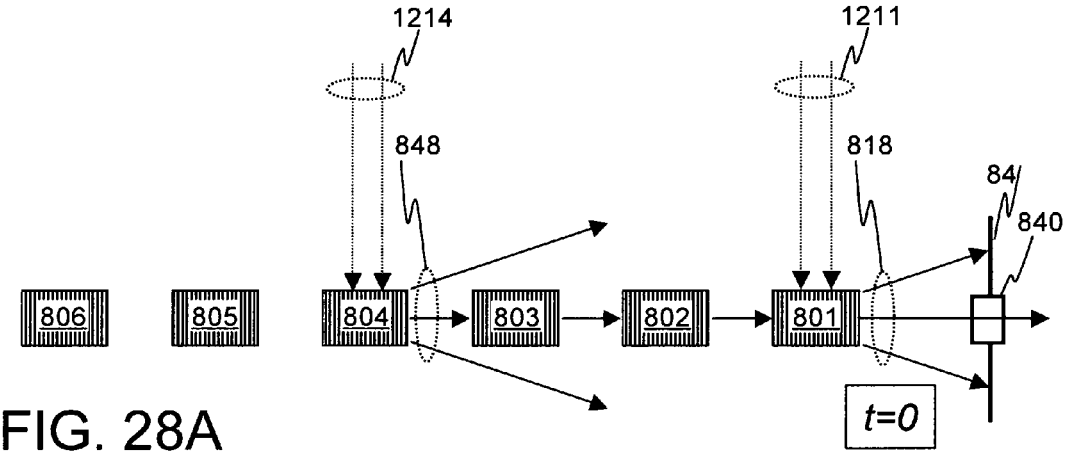
FIG. 28A illustrates a collection of x-ray sub-sources arranged in a linear array in a time multiplexed electron beam exposure at time step t=0, as may be used in some embodiments of the invention.
Figure 28B:
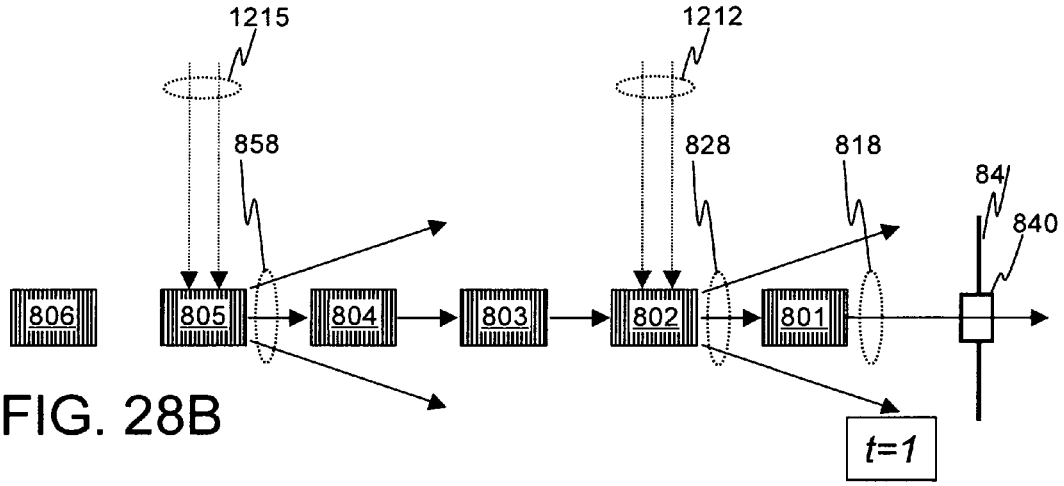
FIG. 28B illustrates the collection of x-ray sub-sources of FIG. 28A at the next time step t=1.
Figure 28C:
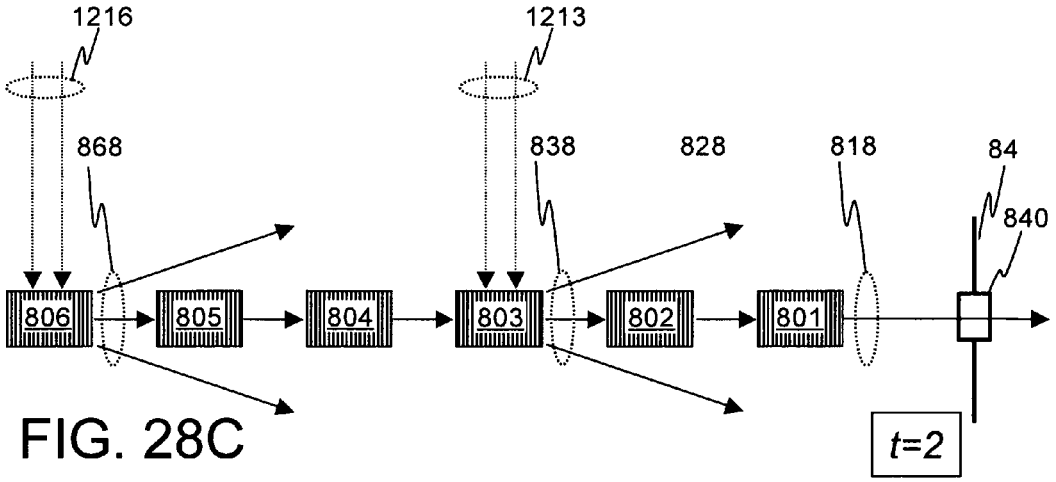
FIG. 28C illustrates the collection of x-ray sub-sources of FIGS. 28A and 28B at the next time step t=2.

A time-multiplexed embodiment is illustrated in FIG. 28. In FIG. 28A, at an initial time step t=0, the electron beams 1211 and 1214 for elements 801 and 804 respectively are on, while the others are off. In FIG. 28B, at the next time step t=1, the electron beams 1212 and 1215 for elements 802 and 805 are on, while the others are off. In FIG. 28C, at the next time step t=2, the electron beams 1213 and 1216 for elements 803 and 806 are on, while the others are off. The system may be switched between these configurations simply by blanking the various electron beams, or by blocking the beams with mechanical shutters, or by repositioning the electron beams.

Additionally, in some embodiments, electron beams may simply scan over target comprising the x-ray generating materials. In some embodiments, this may be a regular raster scan, while in other embodiments, the scan may be non-uniform, "dwelling" on or scanning over the x-ray generating region more slowly, while moving rapidly from one x-ray generating region to another. In other embodiments, an electron beam may be designed to bombard all x-ray generating regions simultaneously, or to have multiple electron beams impinging the x-ray generating regions near simultaneously, but having the electron beam(s) turn on and off rapidly, creating a "pulsed" x-ray source. This may have some advantages for certain specific applications.

Sources with variable timing for electron exposures may also be especially useful for embodiments that use different types of embedded microstructures bombarded with electrons at different potentials, as mentioned above, to excite a diverse spectrum of x-ray energies.

3.5. Off-Axis Configurations.

In other embodiments, a slightly off-axis configuration may be preferred. Examples of such configurations are illustrated in FIGS. 29A and 29B.

Figure 29A:
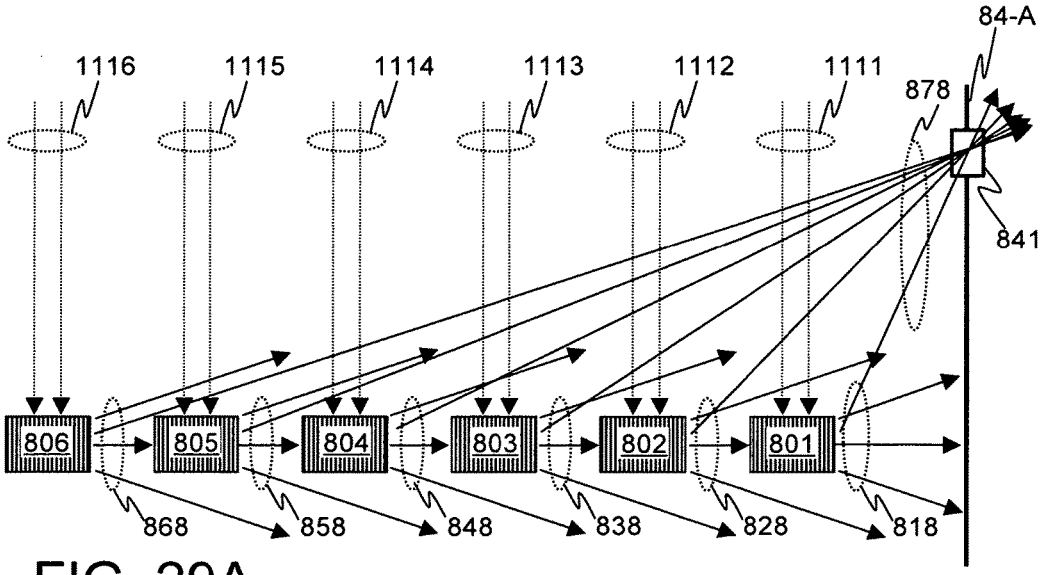
FIG. 29A illustrates off-axis radiation of x-rays from a collection of x-ray sub-sources arranged in a linear array as may be used in some embodiments of the invention.

In FIG. 29A, the x-ray radiation through an off-axis window 841 or aperture in a screen 84-A or wall is illustrated. Because the x-ray radiation is generally isotropic, radiation from all microstructures bombarded with electrons will radiate in this direction as well. However, the various rays of this radiation 878 that pass through the aperture 841 will not propagate in the same direction and will diverge, giving the appearance of an extended source. If the appearance of an extended source is desired, however, using such an off-axis, small-angle collection configuration for the x-rays may be suitable.

Figure 29B:
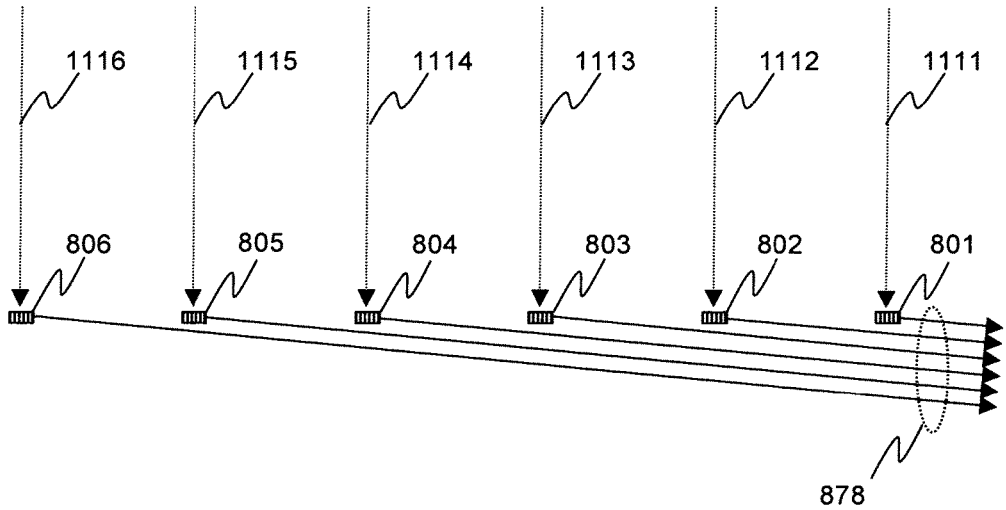
FIG. 29B illustrates off-axis radiation of x-rays from a collection of x-ray sub-sources arranged in a widely spaced linear array as may be used in some embodiments of the invention.

FIG. 29B illustrates the radiation from multiple microstructures, this time in a direction away from the incident electron beams 1111, 1112, 1113, etc. In this example, the spacing of the microstructures 801, 802, 803 . . . is much larger relative to their size, so the off-axis angle that x-rays can propagate without attenuation from neighboring x-ray generating elements is much smaller than for the situation illustrated in FIG. 29A.

3.6. Multiple Independent Electron Beams.

Figure 30:
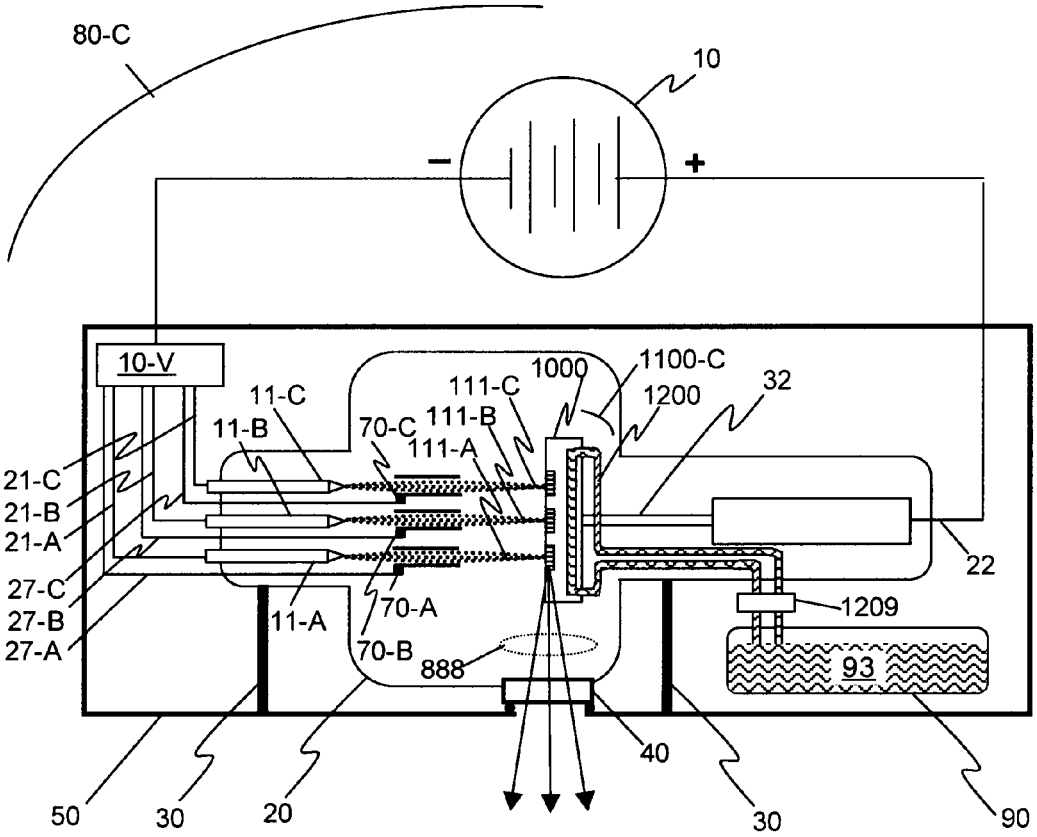
FIG. 30 illustrates a schematic cross-section view of an embodiment of an x-ray system according to the invention comprising multiple electron emitters and a cooling system.
Figure 31:
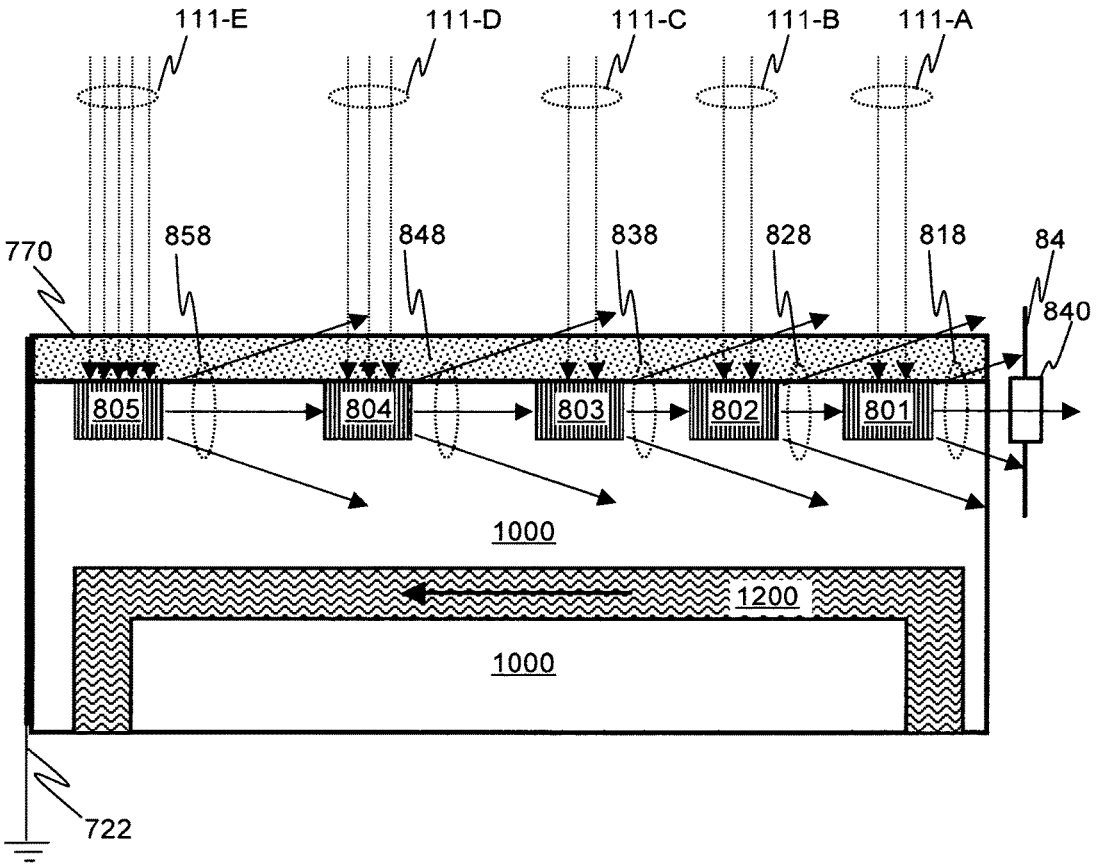
FIG. 31 illustrates a cross-section of the target of the x-ray system of FIG. 30.

Illustrated in FIG. 30 and also in FIG. 31 (which shows more detail for the target) is a more general x-ray system 80-C, incorporating some of the above-discussed elements. The system comprises an electron system controller 10-V that directs various voltages through a number of leads 21-A, 21-B, and 21-C to a number of electron emitters 11-A, 11-B, and 11-C that produce electron beams 111-A, 111-B, 111-C. Each of these electron beams 111-A, 111-B, 111-C may be controlled by signals from the system controller 10-V through leads 27-A, 27-B, and 27-C that govern electron optics 70-A, 70-B, and 70-C.

As illustrated, the system additionally comprises a cooling system, comprising a reservoir 90 filled with a cooling fluid 93, typically water, that is moved by means of a mechanism 1209 such as a pump through cooling channels 1200, of which a portion passes through the substrate 1000 of the target 1100-C.

It should be noted that these illustrations are presented to aid in the understanding of the invention, and the various elements (microstructures, surface layers, cooling channels, etc.) are NOT drawn to scale.

FIG. 31 illustrates a portion of the target 1100-C under bombardment by electrons in an extended version of this system in which two additional electron beams 111-D and 111-E have been added. As illustrated, both of the beams 111-D and 111-E have a higher current than the three electron beams to the right 111-A, 111-B, and 111-C, and the leftmost electron beam 111-E has a highest current density of all the beams, illustrating that the various electron beams need not have equal electron density. The leftmost x-ray generating elements 804 and 805 receiving the higher current are also illustrated as having larger gaps between them and their neighboring microstructures than is provided between the rightmost elements 801, 802, and 803, which receive lower electron current. In some embodiments, 804 and 805 may be comprised of materials that are higher in atomic number than 801, 802, and 803.

Also shown in FIG. 31 is a conducting overcoat 770 that is both thermally conducting (to remove heat) and electrically conducting, providing a return path to ground 722 for the electrons. Also shown is a screen 84 with an aperture 840 to allow x-rays that are on-axis to radiate away from the target.

3.7. Materials Selection for the Substrate.

For the substrate of a target with microstructures of x-ray generating material, as shown above it is preferred that the transmission of x-rays T for the substrate be near 1. For a substrate material of length L and linear absorption coefficient $\alpha_s$, $$T=e^{-\alpha_s L}=e^{-L/L_{1/e}} \quad \text{[Eqn. 21]}$$

where $L_{1,e}$ is the length at which the x-ray intensity has dropped by a factor of 1/e.

Generally, $$L_{1/e} \propto X^3/Z^4 \quad \text{[Eqn. 22]}$$

where X is the x-ray energy in keV and Z is the atomic number. Therefore, to make $L_{1/e}$ large (i.e. make the material more transparent), higher x-ray energy is called for, and a lower atomic number is highly preferred. For this reason, both beryllium (Z=4) and carbon (Z=6) in its various forms (e.g. diamond, graphite, etc.) may be desirable as substrates, both because they are highly transparent to x-rays, but also because they have high thermal conductivity (see Table I).

4. Other Examples of Embodiments of the Invention

4.1. Two-sided Target

Figure 32:
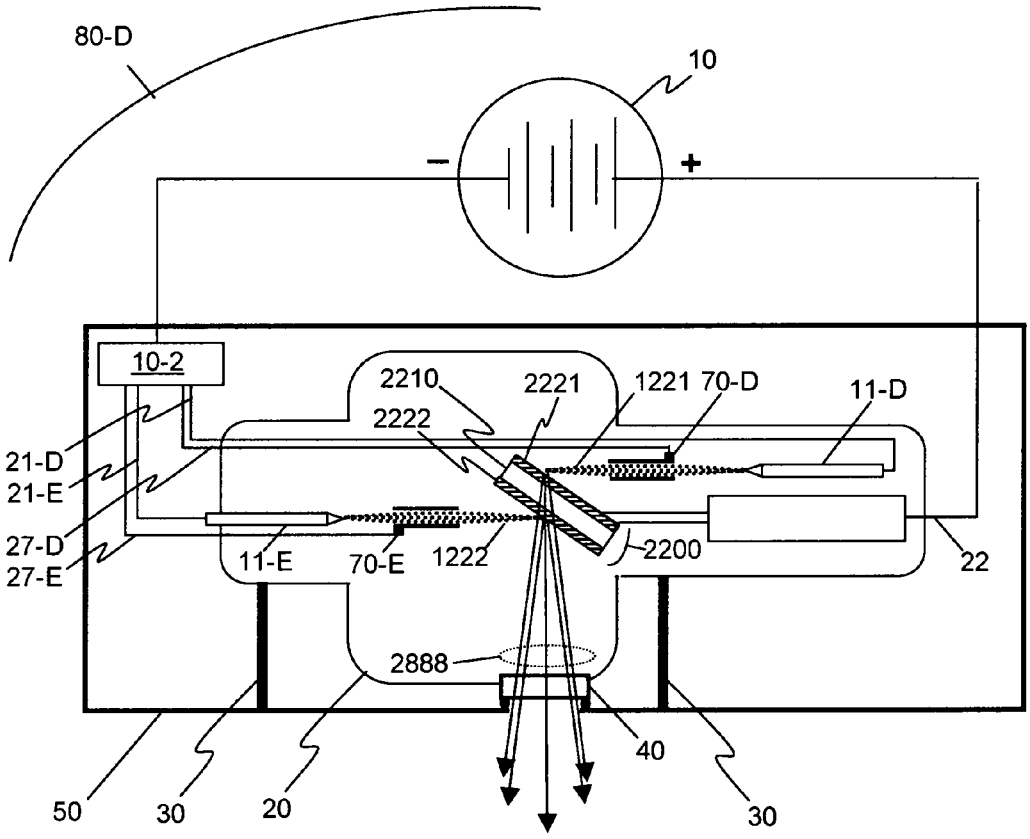
FIG. 32 illustrates a schematic cross-section view of an embodiment of an x-ray system according to the invention comprising a two-sided target.
Figure 33:
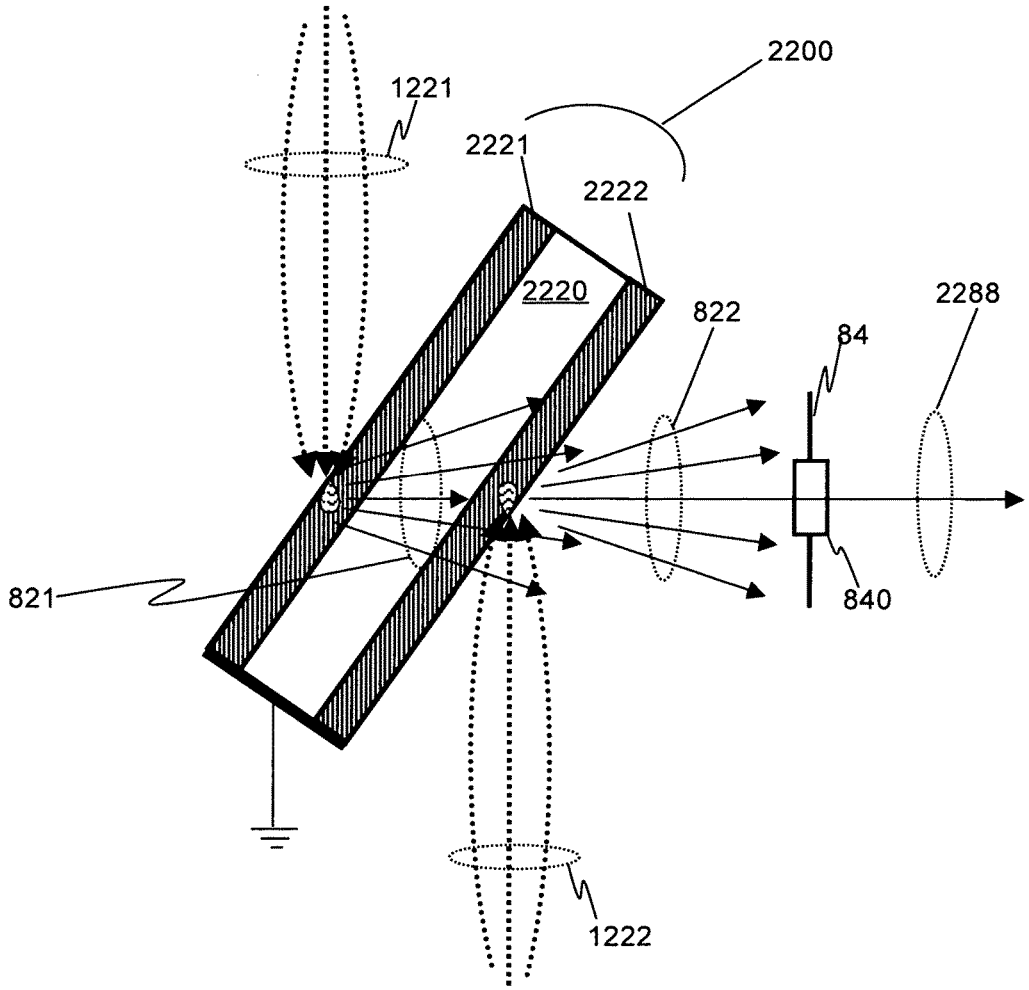
FIG. 33 illustrates a cross-section of the target of the x-ray system of FIG. 32.

One embodiment of a source 80-D using a target with multiple x-ray generating elements arranged for linear accumulation is illustrated in FIG. 32, with the target 2200 shown in more detail in FIG. 33.

In the embodiment shown in FIG. 32, a controller 10-2 provides high voltage to two emitters 11-D and 11-E that emit electron beams 1221 and 1222 towards opposite sides of a target 2200. The properties of the electron beams 1221 and 1222, such as the position, direction, focusing etc. are controlled by electron optics 70-D and 70-E, through leads 27-D and 27-E respectively that coordinate the properties of the beam with the beam current and high voltage settings, all governed by the controller 10-2. The target 2200 comprises a substrate 2200 and two thin coatings 2221 and 2222 of x-ray generating material, one on each side of the substrate 2200.

The electron beams 1221 and 1222 are directed by the electron optics 70-D and 70-E to bombard the thin coatings 2221 and 2222 on opposite sides of the target 2200 at locations such that the x-rays 821 and 822 that are generated from each location are aligned with an aperture 840 in a screen 84 that allows a beam of x-rays 2888 to by radiated from the source 80-D.

Although large area bombardment by electrons may achieve a greater overlap, higher x-ray radiation will occur if the electron density is higher, and so the electron optics 70-D and 70-E may be used to focus the electron beams 1221 and 1222 to spots as small as 25 μm or even smaller. For such small spots in a configuration as shown, the alignment of the two electron bombardment spots to produce superimposed x-ray radiation patterns (and thereby achieve linear accumulation for the two spots) will be carried out by placing an x-ray detector beyond the aperture 840 and measuring the intensity of the x-ray beam 2888 as the position and focus of the electron beams 1221 and 1222 are changed using electron optics 70-D and 70-E. The two spots can be considered aligned when the simultaneous intensity from both spots is maximized on the detector.

The target 2200 may be rigidly mounted to structures within the vacuum chamber, or may be mounted such that its position may be varied. In some embodiments, the target may be mounted as a rotating anode, to further dissipate heating.

As discussed above, the thickness of the coatings 2221 and 2222 can be selected based on the anticipated electron energy and the penetration depth or the CSDA estimate for the material. If the bombardment occurs at an angle to the surface normal, as illustrated, the angle of incidence can also affect the selection of the coating thickness. Although the tilt of the target 2200 relative to the electron beams 1221 and 1222 is shown as ~45°, any angle from 0° to 90° that allows x-rays to be radiated may be used.

Figure 34:
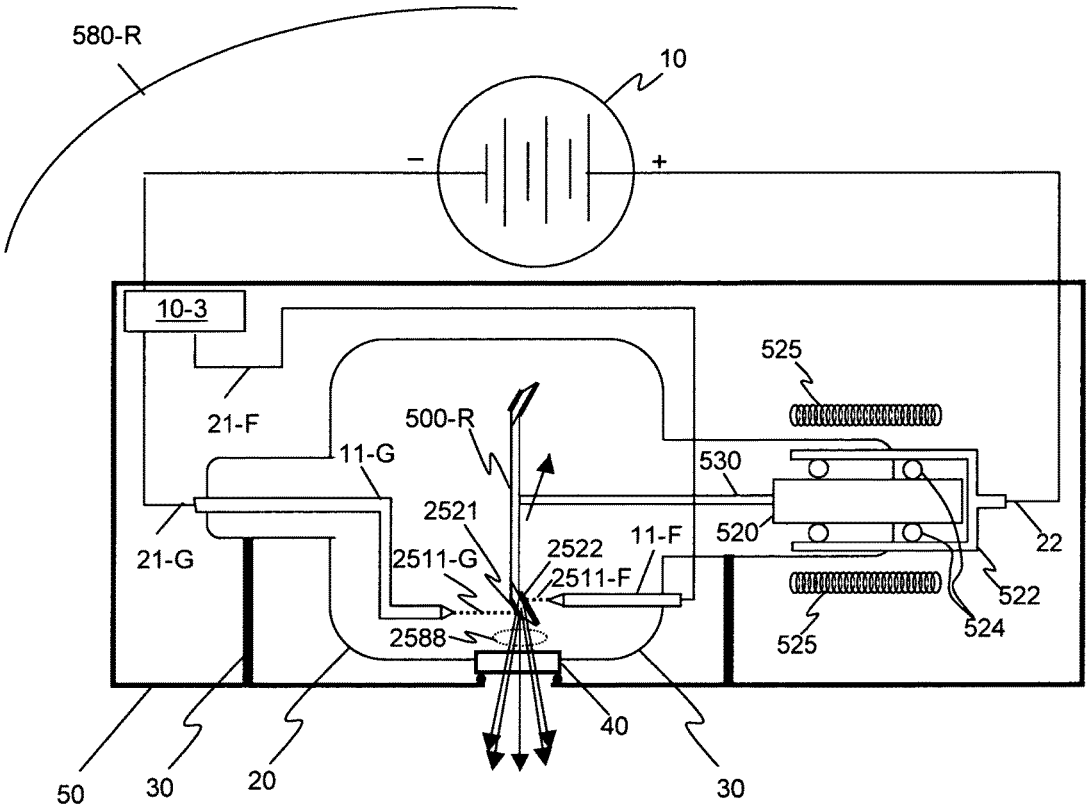
FIG. 34 illustrates a schematic cross-section view of an x-ray system according to an embodiment of the invention comprising multiple electron emitters bombarding opposite sides of a rotating anode.

It should also be noted that the two-sided target described above might also be used in an embodiment comprising a rotating anode, distributing the heat as the anode rotates. A system 580-R comprising these features is illustrated in FIG. 34. In this embodiment, many of the elements are the same as in a conventional rotating anode system, as was illustrated in FIG. 6A, but in the embodiment as illustrated, a controller 10-3 provides high voltage through leads 21-F and 21-G to two emitters 11-F and 11-G respectively that emit electron beams 2511-F and 2511-G respectively. These electron beams bombard opposite sides the beveled portion of a target 500-R which has been coated on both sides with coatings 2521 & 2522 with an x-ray generating material to produce x-rays 2588. It should also be clear that embodiments with additional controls, such as beam steering electron optics, or apertures to define the output x-ray beam may also be designed.

4.2. Multiple Two-Sided Target

Figure 35:
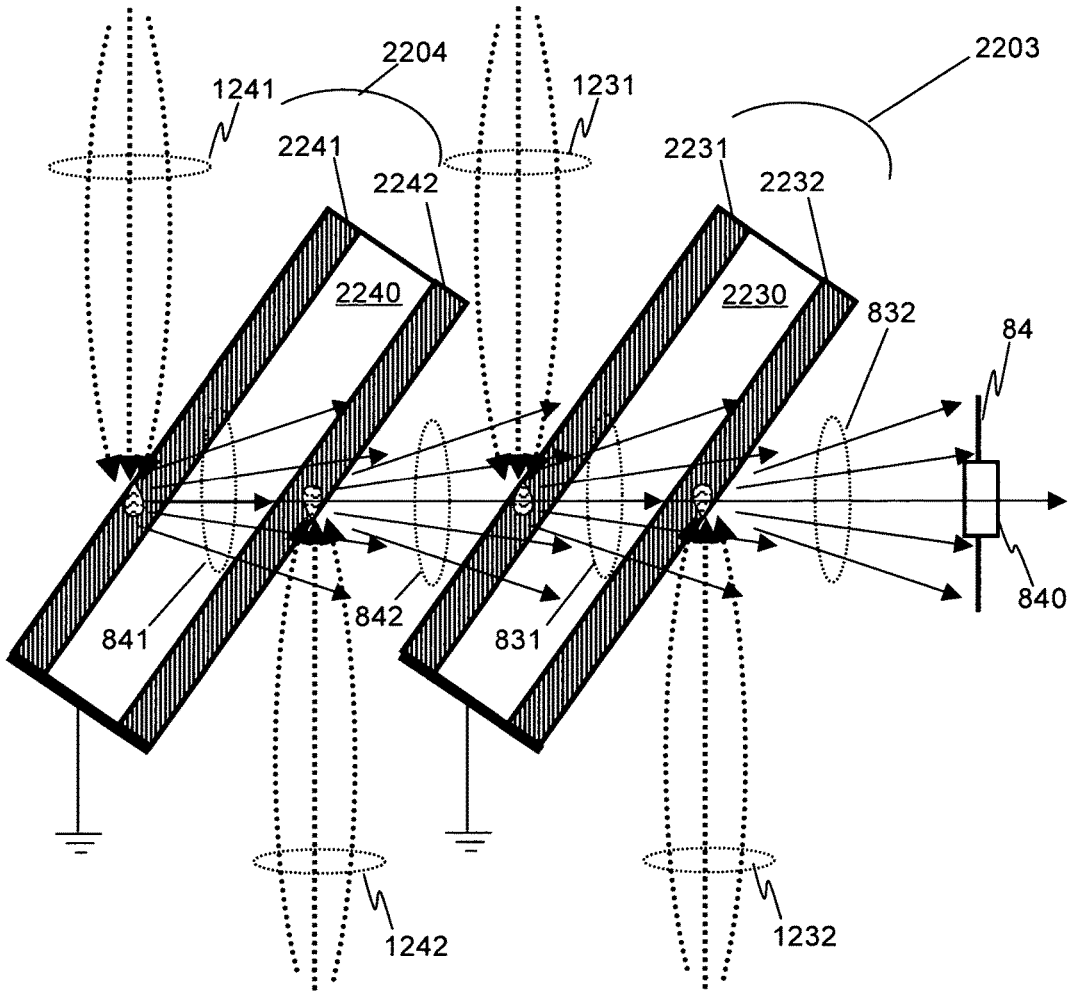
FIG. 35 illustrates a cross-section of multiple targets aligned for linear accumulation for use in a system according to the invention.

A source 80-D as described above is not limited to a single target with two sides. Shown in FIG. 35 is a pair of targets 2203, 2204, each with two coatings 2231 and 2232, and 2241 and 2242 respectively, of x-ray generating material on a substrate 2230 and 2240, respectively. In this embodiment, the source will have a similar configuration to that illustrated in FIG. 32, except that there are now four electron beams 1231, 1232, 1241, 1242 that are controlled to bombard the respective coatings on two targets 2203, 2204 and generate x-rays 831 and 832, and 841 and 842 respectively.

In this embodiment, the four x-ray generating spots are aligned with an aperture 840 in a screen 84 to appear to originate from a single point of origin. An alignment procedure as discussed above for the case of a two-sided target, except that now the four electron beams 1231, 1232, 1241, and 1242 are adjusted to maximize the total x-ray intensity at a detector placed beyond the aperture 840.

As discussed above, the targets 2203 and 2204 may be rigidly mounted to structures within the vacuum chamber, or may be mounted such that their position may be varied. In some embodiments, the targets 2203 and 2204 may be mounted as rotating anodes, to further dissipate heating. The rotation of the targets 2203 and 2204 may be synchronized or independently controlled.

As discussed above, the thickness of the coatings 2231, 2232 and 2241, 2242 can be selected based on the anticipated electron energy and the penetration depth or the CSDA estimate for the material. If the bombardment occurs at an angle to the surface normal, as illustrated, the angle of incidence can also affect the selection of the coating thickness. Although the tilt of the targets 2203 and 2204 relative to the electron beams 1231, 1232 and 1222 is shown as ~45°, any angle from 0° to 90° that allows x-rays to be radiated may be used.

Although only two targets with four x-ray generating surfaces are illustrated in FIG. 35, embodiments with any number of targets comprising surfaces coated with x-ray generating material may be used in the same manner, each target being bombarded on one or both sides with an independently controlled electron beam. Furthermore, the coatings for the various targets may be selected to be different x-ray generating materials. For example, the upstream coatings 2241 and 2242 may be selected to be a material such as silver (Ag) or palladium (Pd) while the downstream coatings 2231 and 2232 may be selected to be rhodium (Rh), which has a higher transmission for the characteristic x-rays generated by the upstream targets. This may provide a blended x-ray spectrum, comprising multiple characteristic lines from multiple elements. Furthermore, by adjusting the various electron beam currents and densities, a tunable blend of x-rays may be achieved.

Likewise, the coatings themselves need not be uniform materials, but may be alloys of various x-ray generating substances, designed to produce a blend of characteristic x-rays.

4.3. Two-Sided Target with Embedded Structures

Figure 36:
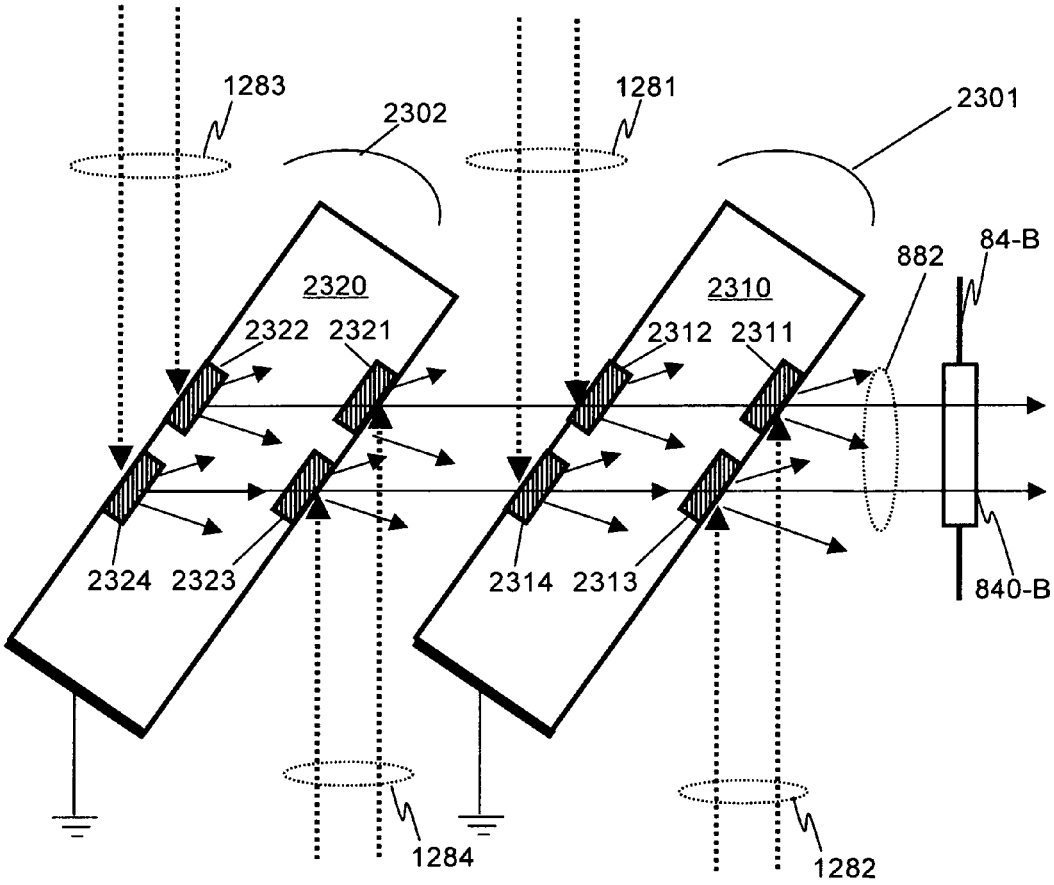
FIG. 36 illustrates a cross-section of multiple targets comprising microstructures of x-ray generating material aligned for linear accumulation for use in a system according to the invention.

FIG. 36 illustrates another embodiment in which the targets comprise microstructures of x-ray generating material embedded in the substrate instead of thin coatings.

Two targets 2301 and 2302 are shown (although a single target, such as illustrated in FIGS. 32 and 33, may also be configured in this manner as well), each with four microstructures of x-ray generating material 2311, 2312, 2313, 2314, and 2321, 2322, 2323, 2324 respectively, are embedded to on each side of a substrate 2310, 2320 respectively. Electron beams 1281, 1282, 1283, and 1284 are directed onto the targets 2301, 2302, and produce x-rays that form a beam 882 that appears to originate from the same source when aligned with an aperture 840-B in a screen 84-B.

As discussed above, the embedded microstructures for this embodiment may comprise different x-ray generating materials, or an alloy or blend of x-ray generating materials to achieve a desired spectral output.

4.4. Multiple Locations on a Slanted Surface

Figure 37A:
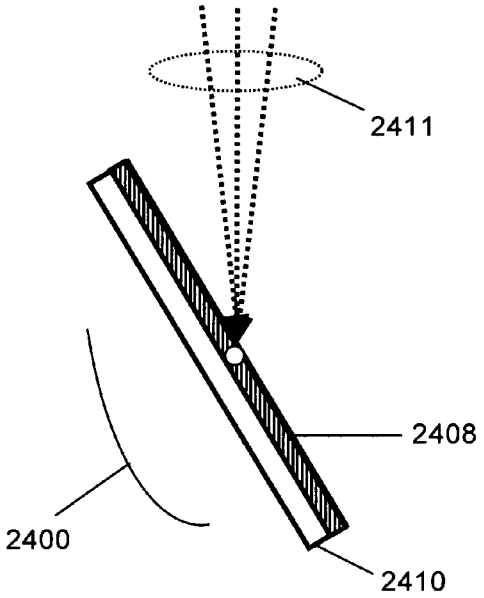
FIG. 37A illustrates a side view of a target comprising an x-ray coating being bombarded using a distributed electron beam as may be used in some embodiments of the invention.
Figure 37B:
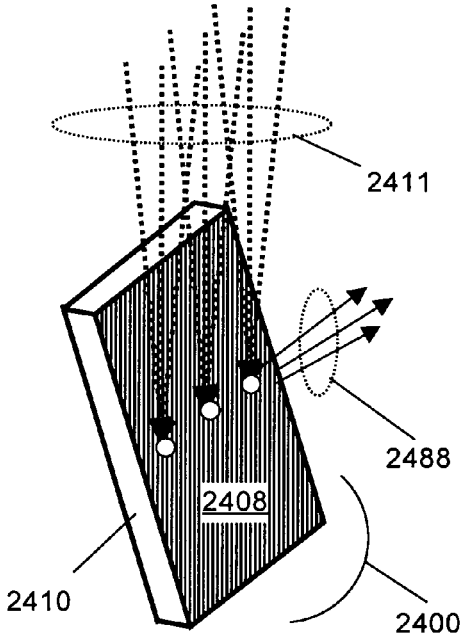
FIG. 37B illustrates a perspective view of the target and distributed electron beam of FIG. 37A.
Figure 37C:
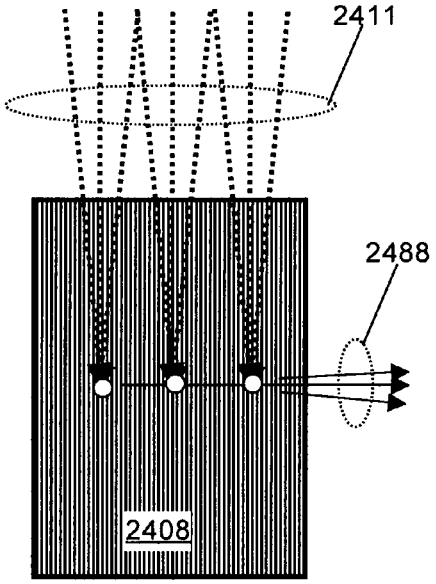
FIG. 37C illustrates a front view of the target and distributed electron beam of FIGS. 37A and 37B.

Another embodiment in which the target 2400 is aligned with a distributed electron beam 2411 is illustrated in FIGS. 37A-C. In this embodiment, the electron beam 2411 is focused to several spots onto a coating 2408 of x-ray generating material formed on a substrate 2410. The electron beam 2411 may be adjusted so that the multiple spots are formed in an aligned row, and their x-ray radiation 2488 along the row (at zero-angle) will appear to originate from a single point of origin.

Figure 38A:
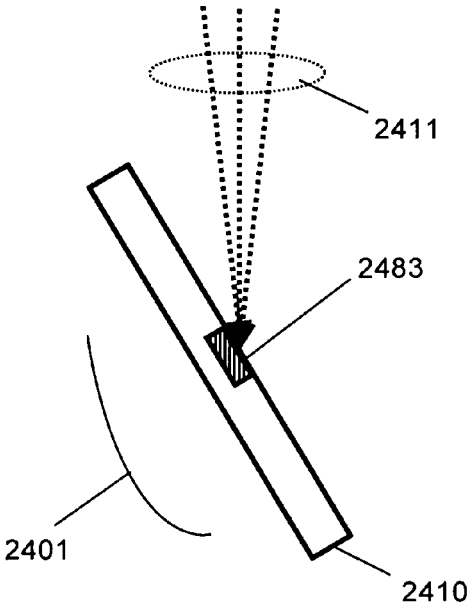
FIG. 38A illustrates a side view of a target comprising microstructures being bombarded using a distributed electron beam as may be used in some embodiments of the invention.
Figure 38B:
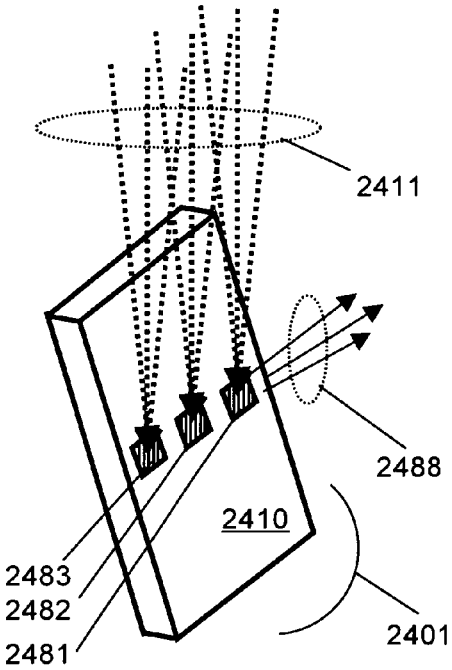
FIG. 38B illustrates a perspective view of the target and distributed electron beam of FIG. 38A.
Figure 38C:
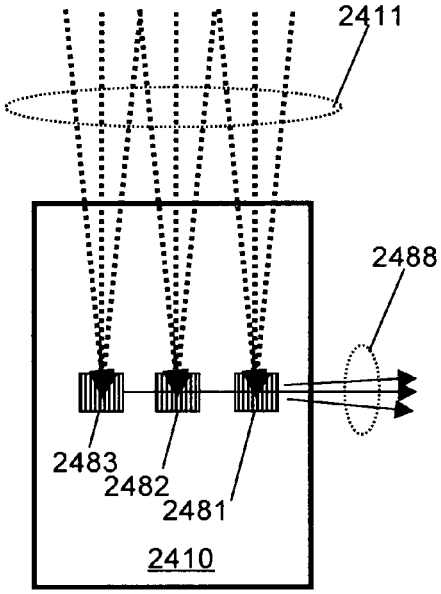
FIG. 38C illustrates a front view of the target and distributed electron beam of FIGS. 38A and 38B.

A variation of this embodiment is illustrated in FIGS. 38A-C. For the target 2401 of this embodiment, instead of a coating, microstructures 2481, 2482, 2483 of x-ray generating material are embedded in the substrate 2410. The distributed electron beam 2411 bombards these microstructures, again generating x-rays 2488 that appear to originate from a single point of origin.

5. X-Ray Concentration Using Additional X-Ray Optics

In the embodiments described up to this point, multiple x-ray radiation patterns from several points of origin are simply aligned such that they appear to be overlapped, and hence appear to simply be a single, brighter x-ray source when viewed from a particular angle.

However, characteristic line x-ray radiation is generally isotropic, and therefore most of the x-ray energy is lost if an aperture with only a small viewing angle is used.

This can be addressed by collecting additional x-rays generated from the multiple points of origin at other angles using x-ray optical elements. Conventional optical elements for x-rays, such as grazing angle mirrors, mirrors with multilayer coatings, or more complex Wolter optics or capillary optics may be used.

In general, the relation between the targets and the optics will be established at the time of fabrication. The optics may be secured in place, either with a particular mount or an epoxy designed for use in a vacuum, and by using an alignment procedure such as those well known by those skilled in the art of optical fabrication. The final alignment may be accomplished as described previously, by placing an x-ray detector at the output aperture and adjusting the focus and position for the various electron beams to achieve maximum x-ray intensity. Final adjustments may also be made for the alignment of the optical elements using x-rays. It should be notes that the detector may also be used to provide feedback to the electron beam controllers, providing, for example, a measure of spectral output, which may in turn be used to direct an electron beam generating a particular characteristic line to increase or decrease its power.

It should also be noted that not all targets need to be bombarded with electrons with the same angle of incidence. For configurations with multiple x-ray generating materials, some materials may have different penetration depths, and therefore bombarding with electrons at a different angle of incidence may be more efficient at producing x-rays for that particular target. Also, as described in the previous embodiments, different electron densities, energies, angles, focus conditions, etc. may be used for different targets.

It should also be noted that radiation occurs isotropically from all the targets, and that the collection and focusing x-ray optics lenses operate on x-rays propagating in both directions. Therefore, a second beam of x-rays will be radiated in the opposite direction to the initial beam discussed above, and may be used either as a second x-ray exposure system, or may be used in conjunction with a detector placed on the opposite end of the chain of targets that serves as a monitor for the overall power of the x-ray system, or as a monitor for other beam properties such as the brightness, intensity, x-ray spectrum, the beam profile, or other useful properties.

5.1. General Reflective Optics.

Figure 39:
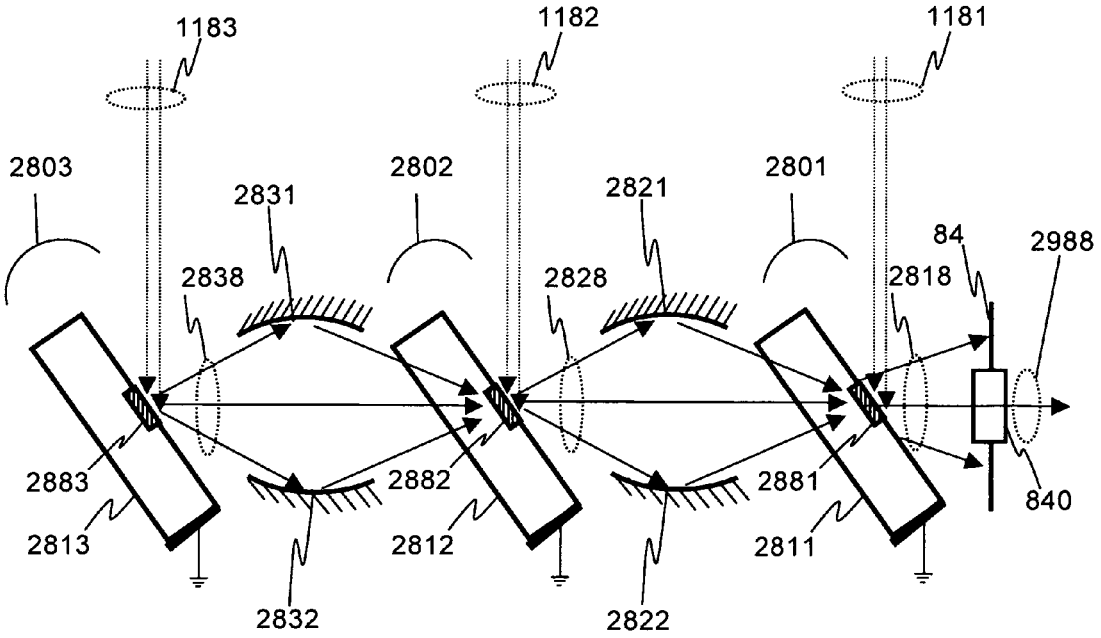
FIG. 39 illustrates a cross-section of multiple targets comprising microstructures of x-ray generating material in which reflecting optics are used to collect and focus x-rays for use in a system according to the invention.

FIG. 39 illustrates an embodiment using three aligned targets 2801, 2802, 2803 each comprising a microstructure 2881, 2882, 2883 of x-ray generating material embedded in a substrate 2811, 2812, 2813. Each of the targets is bombarded by an electron beam 1181, 1182, 1183 respectively to generate x-rays 2818, 2828, 2838 respectively.

Between each of the x-ray generating targets, x-ray imaging mirror optics 2821, 2822, 2831, 2832 are positioned to collect x-rays generated at wider angles and redirect them to a focus at a position corresponding to the x-ray generating spot another x-ray target. As illustrated, the focus is set to be the x-ray generating spot in the adjacent target, but in some embodiments, all the x-ray mirrors may be designed to focus x-rays to the same point, for example, at the final x-ray generating spot in the final (rightmost) x-ray target. As in the previous embodiments, generated x-rays 2818, 2828, 2838 pass through an aperture 840 in a screen 84 to form an x-ray beam 2988.

These imaging mirror optics 2821, 2822, 2831, 2832 may be any conventional x-ray imaging optical element, such as an ellipsoidal mirror with a reflecting surface typically fabricated from glass, or surface coated with a high mass density material, or an x-ray multilayer coated reflector (typically fabricated using layers of molybdenum (Mo) and silicon (Si)) or a crystal optic, or a combination thereof. The selection of the material and structure for an x-ray optic and its coatings may be different, depending on the spectrum of the x-rays to be collected and refocused. Although illustrated as cross sections, the entire x-ray optic or a portion thereof may have cylindrical symmetry.

Figure 40:
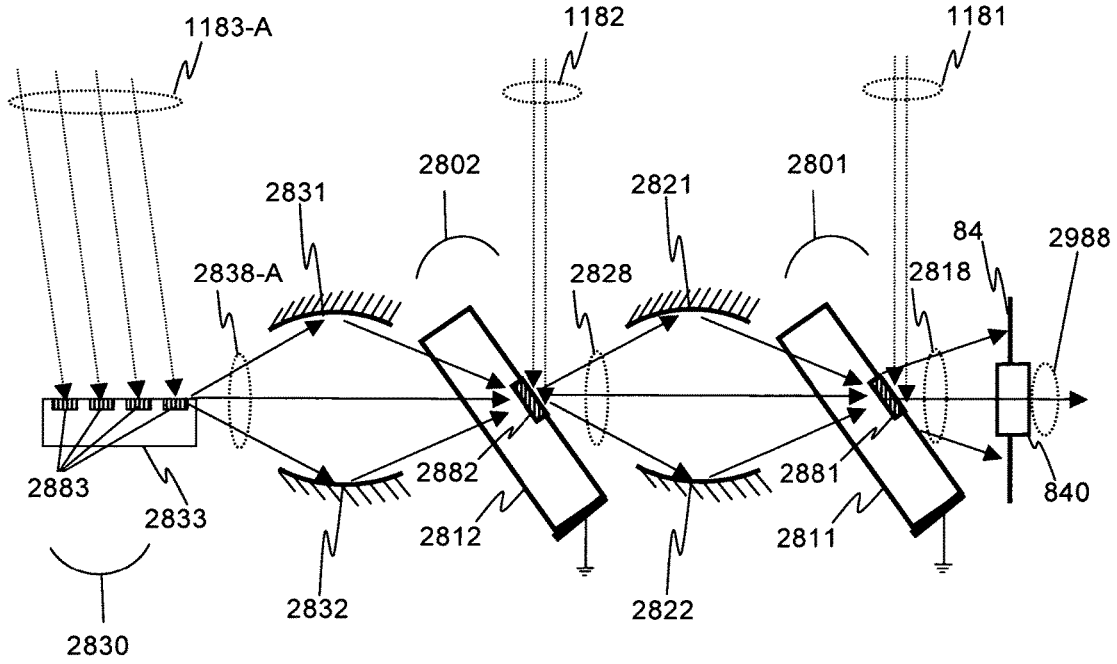
FIG. 40 illustrates a cross-section of multiple targets comprising microstructures of x-ray generating material of various orientations in which reflecting optics are used to collect and focus x-rays for use in a system according to the invention.

A variation of this embodiment is illustrated in FIG. 40. In this embodiment, the first (upstream) x-ray target 2830 now comprises a substrate 2833 in which microstructures 2883 of x-ray generating material have been embedded, as has been described elsewhere. The intensity of the x-rays 2838-A radiated from this target 2830 will be increased due to the linear accumulation of the x-rays generated by these several microstructures 2883, and may contribute to a brighter overall x-ray source in this embodiment, just as they do in the previously described embodiments. However, for this embodiment, the electron beam 1183-A may be adjusted to have a different incidence angle (as illustrated), size, shape and focus from the embodiment of FIG. 39 in order to bombard the microstructures 2883 more effectively.

Figure 41:
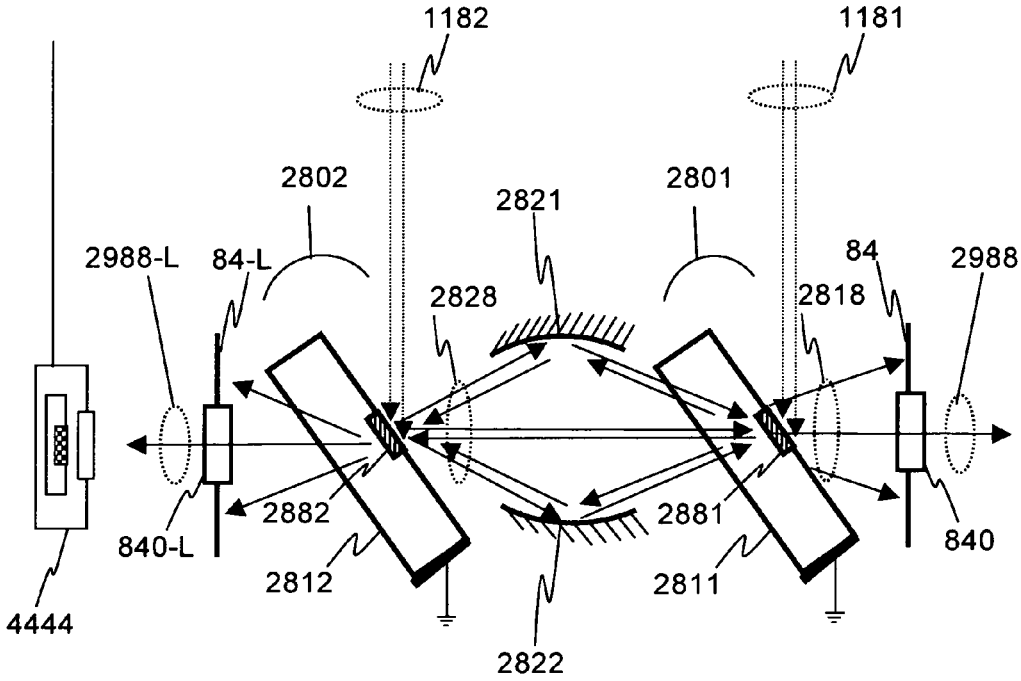
FIG. 41 illustrates a variation of the configuration of FIG. 39 in which x-rays propagate in both directions within a system according to the invention.

Another variation of this embodiment is illustrated in FIG. 41. In this illustration, the second x-ray beam 2988-L propagating to the left is also illustrated. This second x-ray beam propagates through a second aperture 840-L in a plate 84-L, and can be used as a second x-ray exposure source, or can be used in conjunction with a detector 4444 to serve as a monitor for x-ray beam properties such as brightness, brilliance, total intensity, flux, energy spectrum, beam profile, and divergence or convergence.

5.2. Wolter and Other Multi-Element X-Ray Optics.

Figure 42:
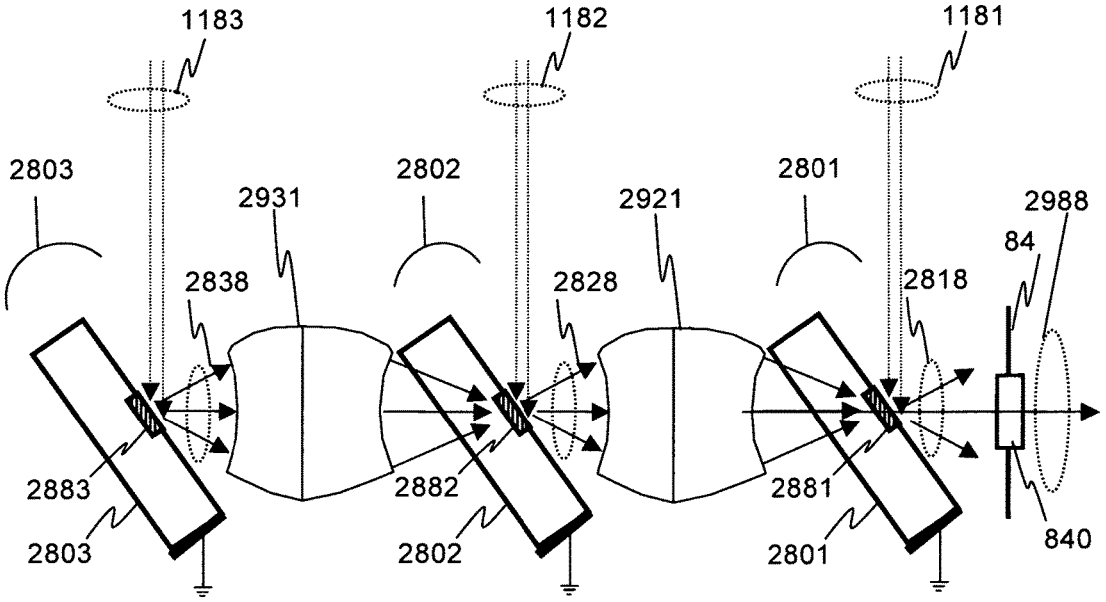
FIG. 42 illustrates a cross-section of multiple targets comprising microstructures of x-ray generating material in which Wolter optics are used to collect and focus x-rays for use in a system according to the invention.

Another embodiment of the invention is illustrated in FIG. 42. In this embodiment, the optical elements 2921 and 2931 collecting x-rays radiated from one target and focusing them downstream are now optical elements known as Wolter optics. Wolter optics are a well-known system of nested mirrors to collect and focus x-rays, typically having parabolic and/or hyperbolic reflecting surfaces, with each element typically used at grazing angle. Typically the reflecting surface is a glass. The glass surface may be coated with a high mass density material or an x-ray multilayer (typically fabricated using layers of molybdenum (Mo) and silicon (Si)).

Figure 43A:
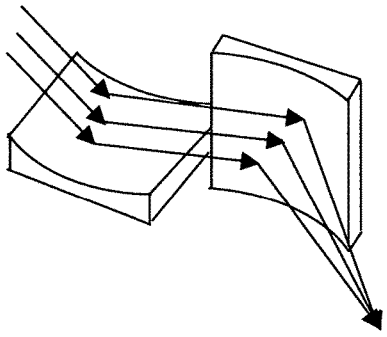
Prior Art FIG. 43A
FIG. 43A illustrates a prior art embodiment of x-ray optics with two cylindrical optical elements.
Figure 43B:
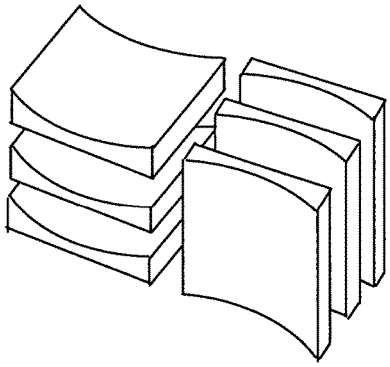
Prior Art FIG. 43B
FIG. 43B illustrates a prior art embodiment of x-ray optics with multiple cylindrical optical elements.

FIG. 43A and FIG. 43B illustrate prior art embodiments of multi-element optics used for x-rays comprising a variety of curved lenses oriented both horizontally and vertically. FIG. 43A illustrates a pair of optical elements, one oriented to focus x-rays in one dimension while the other focuses x-rays in the orthogonal dimension. FIG. 43B illustrates a stack of these pairs of curved elements. As described above, the material selection and coatings used for these optical elements may be selected to match the spectrum of x-rays anticipated to be generated from the various x-ray origins.

5.3. Polycapillary Optics.

Figure 44:
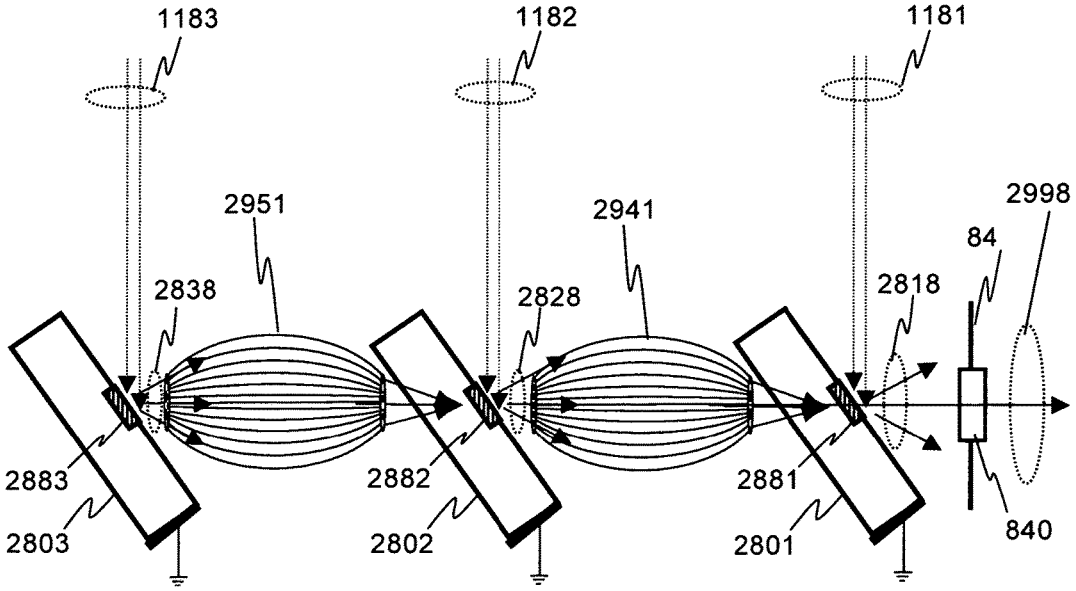
FIG. 44 illustrates a cross-section of multiple targets comprising microstructures of x-ray generating material in which capillary optics are used to collect and focus x-rays for use in a system according to the invention.

Another embodiment of the invention is illustrated in FIG. 44. In this embodiment, the optical elements 2941 and 2951 collecting x-rays generated from one target and focusing them downstream are now optical elements known as polycapillary optics. Polycapillary optics are similar to fiber optics, in that x-rays are guided through a thin fiber to emerge at the other end in a desired position. However, unlike fiber optics, which comprise a solid fiber of glass that reflects using total internal reflection, polycapillary optics comprise a number of hollow tubes, and the x-rays are guided down the tubes by an external reflection from the material at grazing angles. As in the previous embodiments, generated x-rays 2818, 2828, 2838 pass through an aperture 840 in a screen 84 to form an x-ray beam 2998.

Polycapillary optics are a well-known means of collecting and redirecting x-rays, and any of a number of conventional polycapillary optical elements may be used in the embodiments of the invention disclosed here. It is generally considered, however, that a polycapillary optic comprising multiple capillary fibers be used so that x-rays radiated at many angles can be collected and directed to a point of desired focus.

5.4. Variations.

Although specific options have been presented in the illustrations showing the reflective, Wolter or polycapillary optics, these are in no way meant to be limiting. The optical configurations illustrated in FIGS. 39 through 44 may be interchangeable, with for example, the Wolter optics 2921 and/or 2931 of FIG. 42 replacing the mirrors 2821 & 2822 and/or 2831 & 2832 in FIG. 40 or 41. It should also be noted that, although targets comprising microstructures are used in these illustrations, targets comprising thin films such as were illustrated in FIGS. 33 and 35 may be used in conjunction with these focusing x-ray optics as well.

6. Limitations and Extensions

With this application, several embodiments of the invention, including the best mode contemplated by the inventors, have been disclosed. It will be recognized that, while specific embodiments may be presented, elements discussed in detail only for some embodiments may also be applied to others.

While specific materials, designs, configurations and fabrication steps have been set forth to describe this invention and the preferred embodiments, such descriptions are not intended to be limiting. Modifications and changes may be apparent to those skilled in the art, and it is intended that this invention be limited only by the scope of the appended claims.

We claim:

1. An x-ray source comprising:

a vacuum chamber;

a window transparent to x-rays attached to the wall of the vacuum chamber;

and, within the vacuum chamber, at least one electron beam emitter; and an anode target comprising:

a substrate comprising a first selected material, and a planar first surface, from which thickness is measured in a direction perpendicular to the first planar surface, and two orthogonal lateral dimensions are measured parallel to the first planar surface; and a plurality of discrete structures embedded into the first planar surface of the substrate such that each of the plurality of discrete structures is in thermal contact with the substrate, the plurality of discrete structures comprising a second material selected for its x-ray generation properties;

in which at least two of the plurality of discrete structures are arranged on an axis;

in which the axis is parallel to the first planar surface of the substrate;

in which the axis passes through the first window;

in which each of the discrete structures has a thickness of less than 20 microns, in which each of the plurality of discrete structures has a lateral dimension in the direction of the axis of less than 50 microns; and a means for directing an electron beam emitted by the at least one electron beam emitter onto the at least two arranged discrete structures such that x-rays are generated from each of the at least two arranged discrete structures;

in which at least a portion of the generated x-rays propagating on the axis from each of the two arranged discrete structures is transmitted through the window.

2. The x-ray source of claim 1, in which any two of the plurality of discrete structures are separated by distance of 1 micron or greater.

3. The x-ray source of claim 1, in which the plurality of discrete structures are buried into the surface of the substrate within a depth of less than 100 microns.

4. The x-ray source of claim 1, in which the means for directing an electron beam emitted by the at least one electron beam emitter onto the at least two arranged discrete structures in the target comprises electron optics.

5. The x-ray source of claim 4, in which the means for directing an electron beam allows for directing the electron beam in a pattern that corresponds to the positions of at least some the plurality of discrete structures, in which said pattern can be adapted in time in response to a signal from a detector monitoring predetermined properties of the x-rays generated by the directed electron beam, and in which said predetermined properties of the generated x-rays are selected from the group consisting of:

brightness, total intensity, flux, energy spectrum, beam profile, and beam divergence.

6. The x-ray source of claim 4, in which the plurality of discrete structures of the target are aligned such that x-rays generated by a predetermined one of the plurality of discrete structures when exposed to an electron beam directed onto the at least two arranged discrete structures in the target are transmitted through another of the plurality of discrete structures.

7. The x-ray source of claim 6, in which the target is aligned such that x-rays generated by a predetermined number of the plurality of discrete structures when exposed to the directed electron beam are transmitted through one predetermined discrete structure selected from the plurality of discrete structures.

8. The x-ray source of claim 1, in which the plurality of discrete structures are arranged in a linear array.

9. The x-ray source of claim 8, in which the linear array is defined to have a long axis and a short axis, and the long axis of the linear array is aligned with the window; and the angle between the long axis and the surface normal of the window at the point of intersection between the long axis and the window is less than 85 degrees.

10. The x-ray source of claim 9, in which at least one of the discrete structures is positioned to be within 500 microns of an edge of the substrate that is closest to the window.

11. The x-ray source of claim 1, in which the plurality of discrete structures are fabricated to have similar shapes.

12. The x-ray source of claim 11, in which the similar shapes are selected from the group consisting of regular prisms, right rectangular prisms, cubes, triangular prisms, trapezoidal prisms, pyramids, tetrahedra, cylinders, spheres, ovoids, and barrel-shapes.

13. The x-ray source of claim 1, in which the first selected material is selected from the group consisting of:

beryllium, diamond, graphite, silicon, boron nitride, silicon carbide, sapphire, and diamond-like carbon.

14. The x-ray source of claim 1, in which the second material is selected from the group consisting of:

aluminum, titanium, vanadium, chromium, manganese, iron, cobalt, nickel, copper, gallium, zinc, yttrium, zirconium, molybdenum, niobium, ruthenium, rhodium, palladium, silver, tin, iridium, tantalum, tungsten, indium, cesium, barium, gold, platinum, lead, and combinations and alloys thereof.

15. The x-ray source of claim 1, in which a subset of the plurality of discrete structures comprise a third material selected for its x-ray generation properties.

16. The x-ray source of claim 15, in which the third material is selected from the group consisting of:

aluminum, titanium, vanadium, chromium, manganese, iron, cobalt, nickel, copper, gallium, zinc, yttrium, zirconium, molybdenum, niobium, ruthenium, rhodium, palladium, silver, tin, iridium, tantalum, tungsten, indium, cesium, barium, gold, platinum, lead, and combinations and alloys thereof.

17. The x-ray source of claim 1, in which at least one of the discrete structures is positioned to be within 500 microns of an edge of the substrate.

18. The x-ray source of claim 1, additionally comprising:

a cooling system comprising:

a reservoir for storing a cooling fluid;

a channel within the substrate for conducting the cooling fluid;

an additional channel to conduct the fluid from the reservoir to the channel in the substrate;

an additional channel to conduct the fluid from the channel in the substrate to the reservoir; and a pumping mechanism to pump the fluid through the system.

19. The x-ray source of claim 1, additionally comprising:

a mechanism to rotate the target while being bombarded with electrons from said electron beam emitter.

20. The x-ray source of claim 1, in which the plurality of discrete structures are aligned to produce a beam of x-rays with a take-off angle of less than 6° relative to said planar first surface.

* * * * *